US005747443A

United States Patent [19]

Wahl et al.

[11] Patent Number: 5,747,443

[45] Date of Patent: May 5, 1998

[54] FABRIC SOFTENING COMPOUND/ COMPOSITION

[75] Inventors: Errol Hoffman Wahl, Cincinnati; Toan Trinh, Maineville; Eugene Paul Gosselink, Cincinnati; James Carey Letton, Forest Park; Mark Robert Sivik, Fairfield, all of Ohio

[73] Assignee: The Procter & Gamble Company, Cincinnati, Ohio

[21] Appl. No.: 679,694

[22] Filed: Jul. 11, 1996

[51] Int. Cl.[6] ..... C11D 1/62; C11D 1/645; C11D 3/50

[52] U.S. Cl. ..... 510/515; 510/276; 510/280; 510/303; 510/308; 510/329; 510/330; 510/504; 510/521; 510/522; 510/101; 510/102; 510/104

[58] Field of Search ..... 510/276, 280, 510/303, 308, 329, 330, 504, 521, 522, 515, 101, 102, 104

[56] References Cited

U.S. PATENT DOCUMENTS 5,500,138 3/1996 Bacon et al. ..... 252/8.8

5,545,350 8/1996 Baker et al. ..... 510/517

5,574,179 11/1996 Wahl et al. ..... 554/110

*Primary Examiner*—Paul Lieberman

*Assistant Examiner*—Charles Boyer

*Attorney, Agent, or Firm*—Robert B. Aylor

[57] ABSTRACT

Fabric softening actives having hydrophobic moieties containing, preferably, ester, or amide, linkages and mixed branched and unsaturated hydrophobic groups provide improved processing and stability as well as surprisingly good softening. Preferred compositions contain mono-ol and diol principal solvents having a ClogP of from about 0.15 to about 0.64, that have the ability to make clear aqueous fabric softener compositions containing relatively high concentrations of the said fabric softener actives having ester linkages in their long, hydrophobic chains. Other solvents may be present. Premixes of the fabric softening actives, the principal solvents, and, optionally, other solvents are useful in the preparation of complete formulations by obviating/limiting the need for heating. Other compositions can be prepared which are solid or dispersions of the said fabric softening actives.

27 Claims, No Drawings

FABRIC SOFTENING COMPOUND/ COMPOSITION

TECHNICAL FIELD

The present invention relates to fabric softening compounds and/or compositions preferably for use in formulating translucent, or, more preferably, clear, aqueous, concentrated, liquid softening compositions useful for softening cloth. It especially relates to fabric softening compounds and/or compositions suitable for formulating textile softening compositions for use in the rinse cycle of a textile laundering operation to provide excellent fabric-softening/static-control benefits, the compositions being characterized by, e.g., reduced staining of fabric, excellent water dispersibility, rewettability, and/or storage and viscosity stability at sub-normal temperatures, i.e., temperatures below normal room temperature, e.g., 25° C.

BACKGROUND OF THE INVENTION

The art discloses clear, concentrated fabric conditioning formulations. For example, European Patent Application No. 404,471, Machin et al., published Dec. 27, 1990, teaches isotropic liquid softening compositions with at least 20% by weight softener and at least 5% by weight of a short chain organic acid.

The present invention provides fabric softener actives suitable for formulating e.g., concentrated, preferably clear, preferably aqueous, liquid textile treatment compositions, preferably with low organic solvent level (i.e., below about 40%, by weight of the composition), that have improved stability (i.e., remain clear or translucent and do not precipitate, gel, thicken, or solidify) at normal, i.e., room temperatures and sub-normal temperatures under prolonged storage conditions. Said compositions also provide reduced staining, of fabrics, good cold water dispersibility, together with excellent softening, anti-static and fabric rewettability characteristics, as well as reduced dispenser residue buildup and excellent freeze-thaw recovery. However, in order to formulate such compositions, a fabric softener active is required with a relatively fluid nature. Such fabric softener actives can be prepared by using highly unsaturated materials, but there are many problems associated with such materials, including the fact that they are subject to chemical instability and normally are not as effective as saturated materials for softening.

SUMMARY OF THE INVENTION

Fabric softener actives for use herein are biodegradable, and contain ester linkages in the long hydrophobic chains. They contain both branched and unsaturated acyl chains. Specifically, the actives preferably have the formulas:

1.

$$[(R)_{4-m}-N^{(+)}-[(CH_2)_n-Y-R^1]_m]\ X^{(-)} \quad (1)$$

wherein each R substituent is hydrogen or a short chain $C_1$–$C_6$, preferably $C_1$–$C_3$ alkyl or hydroxyalkyl group, e.g., methyl (most preferred), ethyl, propyl, hydroxyethyl, and the like, benzyl, or mixtures thereof; each m is 2 or 3, preferably 2; each n is from 1 to about 4, preferably 2; each Y is —O—(O)C—, —(R)N—(O)C—, —C(O)—N(R)—, or —C(O)—O—, preferably —O—(O)C—; the sum of carbons in each $R^1$, plus one when Y is —O—(O)C— or —(R)N—(O)C— ("$YR^1$ sum"), is $C_6$–$C_{22}$, preferably $C_{12}$–$_{22}$, more preferably $C_{14}$–$C_{20}$, (hereinafter, $R^1$ and $YR^1$ are used interchangeably to represent the hydrophobic chain, the $R^1$ chain lengths in general being even numbered for fatty alcohols and odd for fatty acids), but no more than one $YR^1$ sum being less than about 12 and then the other $R^1$, or $YR^1$, sum is at least about 16, with each $R^1$ comprising a long chain $C_5$–$C_{21}$ (or $C_6$–$C_{22}$), preferably $C_{10}$–$C_{20}$ (or $C_9$–$C_{19}$) branched alkyl or unsaturated alkyl, most preferably $C_{12}$–$C_{18}$ (or $C_{11}$–$C_{17}$) branched alkyl, or unsaturated alkyl, the ratio of branched alkyl to unsaturated alkyl being from about 95:5 to about 5:95, preferably from about 75:25 to about 25:75, more preferably from about 50:50 to about 30:70, and for the unsaturated alkyl group, the Iodine Value of the parent fatty acid of this $R^1$ group is preferably from about 20 to about 140, more preferably from about 50 to about 130; and most preferably from about 70 to about 115 (As used herein, the "branched alkyl" groups include those that contain a substituent that is hydrophobic, even though they are attached to the main chain by bonds that are not carbon to carbon, e.g., by oxygen, as in the alkoxy substituents, and the Iodine Value of a "parent" fatty acid, or "corresponding" fatty acid, is used to define a level of unsaturation for an $R^1$ groups that is the same as the level of unsaturation that would be present in a fatty acid containing the same $R^1$ group. When an individual $R^1$ is both branched and unsaturated, it is treated as if it is branched.); and wherein the counterion, $X^-$, can be any softener-compatible anion, preferably, chloride, bromide, methylsulfate, ethylsulfate, sulfate, and/or nitrate, more preferably chloride;

2. softener having the formula:

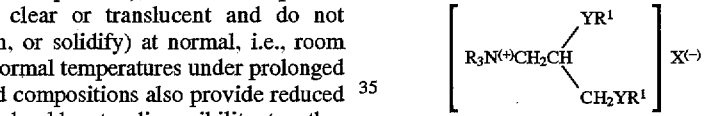

(2)

wherein each Y, R, $R^1$, and $X^{(-)}$ have the same meanings as before (Such compounds include those having the formula:

$$[CH_3]_3\ N^{(+)}[CH_2CH(CH_2O(O)CR^1)O(O)CR^1]Cl^{(-)}$$

where —O—(O)$CR^1$ is derived partly from unsaturated, e.g., oleic, fatty acid and, preferably, each R is a methyl or ethyl group and preferably each $R^1$ is in the range of $C_{15}$ to $C_{19}$ with degrees of branching and substitution being present in the alkyl chains and partly from a branched chain fatty acid like isostearic acid); and 3. mixtures thereof.

The compositions herein preferably comprise:

A. from about 2% to about 80%, preferably from about 13% to about 75%, more preferably from about 15% to about 70%, and even more preferably from about 19% to about 65%, by weight of the composition, of biodegradable fabric softener active selected from the group consisting of:

1. softener active having the formula:

$$[(R)_{4-m}-N^{(+)}-[(CH_2)_n-Y-R^1]_m]\ X^{(-)} \quad (1)$$

wherein each R substituent is hydrogen or a short chain $C_1$–$C_6$, preferably $C_1$–$C_3$ alkyl or hydroxyalkyl group, e.g., methyl (most preferred), ethyl, propyl, hydroxyethyl, and the like, benzyl, or mixtures thereof; each m is 2 or 3, preferably 2; each n is from 1 to about 4; preferably 2, each Y is —O—(O)C—, —(R)N—(O)C—, —C(O)—N(R)—, or —C(O)—O—, preferably —O—(O)C—; the sum of carbons in each $R^1$, plus one when Y is —O—(O)C— or —(R)N—(O)C—, is $C_6$–$C_{22}$, preferably $C_{12-22}$, more preferably $C_{14}$–$C_{20}$, but no more than one $R^1$, or $YR^1$, sum being less than about 12 and then the other $R^1$, or $YR^1$, sum is at least about 16, with each $R^1$ being a long chain $C_5$–$C_{21}$ (or $C_6$–$C_{22}$), preferably $C_9$–$C_{19}$ (or $C_{10}$–$C_{20}$), or, more preferably $C_{11}$–$C_{17}$, (or $C_{12}$–$C_{18}$) branched alkyl and unsaturated alkyl (e.g., alkenyl, also referred to sometimes as "alkylene", and including polyunsaturated alkyl), the ratio of branched alkyl to unsaturated alkyl being from about 5:95 to about 95:5, preferably from about 75:25 to about 25:75, more preferably from about 50:50 to about 30:70, and for the unsaturated alkyl group, the Iodine Value of the parent fatty acid of this $R^1$ group is preferably from about 20 to about 140, more preferably from about 50 to about 130; and most preferably from about 70 to about 115; and wherein the counterion, $X^-$, can be any softener-compatible anion, preferably, chloride, bromide, methylsulfate, ethylsulfate, sulfate, and/or nitrate, more preferably chloride;

2. softener active having the formula:

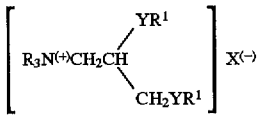

(2)

wherein each Y, R, $R^1$, and $X^{(-)}$ have the same meanings as before; and 3. mixtures thereof.

[In one preferred biodegradable quaternary ammonium fabric softening compound, $C(O)R^1$ is derived partly from unsaturated fatty acid, e.g., oleic acid, and/or fatty acids and/or partially hydrogenated fatty acids, derived from vegetable oils and/or partially hydrogenated vegetable oils, such as: canola oil; safflower oil; peanut oil; sunflower oil; soybean oil; corn oil; tall oil; rice bran oil; etc. and partly from a branched chain fatty acid like isostearic acid.] [As used hereinafter, these biodegradable fabric softener actives containing ester linkages are referred to as "DEQA", which includes both diester, triester, and monoester compounds containing from one to three, preferably two, long chain hydrophobic groups. The corresponding amide softener actives and the mixed ester-amide softener actives can also contain from one to three, preferably two, long chain hydrophobic groups.]

B. optionally, but preferably, the compositions can also contain less than about 40%, preferably from about 10% to about 35%, more preferably from about 12% to about 25%, and even more preferably from about 14% to about 20%, by weight of the composition of principal solvent having a ClogP of from about 0.15 to about 0.64, preferably from about 0.25 to about 0.62, and more preferably from about 0.40 to about 0.60, said principal solvent preferably containing insufficient amounts of solvents selected from the group consisting of: 2,2,4-trimethyl-1,3-pentane diol; the ethoxylate, diethoxylate, or triethoxylate derivatives of 2,2,4-trimethyl-1,3-pentane diol; and/or 2-ethylhexyl-1,3-diol, and mixtures thereof, when used alone, to provide a clear product, preferably insufficient to provide a stable product, more preferably insufficient to provide a detectable change in the physical characteristics of the composition, and especially completely free thereof, and the principal solvent preferably being selected from the group disclosed hereinafter;

C. optionally, but preferably, an effective amount, sufficient to improve clarity, of low molecular weight water soluble solvents like ethanol, isopropanol, propylene glycol, 1,3-propanediol, propylene carbonate, etc., said water soluble solvents being at a level that will not form clear compositions by themselves;

D. optionally, but preferably, an effective amount to improve clarity, of water soluble calcium and/or magnesium salt, preferably chloride; and E. the balance being water.

Preferably, the compositions herein are aqueous, translucent or clear, preferably clear, compositions containing from about 3% to about 95%, preferably from about 10% to about 80%, more preferably from about 30% to about 70%, and even more preferably from about 40% to about 60%, water and from about 3% to about 40%, preferably from about 10% to about 35%, more preferably from about 12% to about 25%, and even more preferably from about 14% to about 20%, of the above principal alcohol solvent B. These preferred products (compositions) are not translucent, or clear, without principal solvent B. The amount of principal solvent B. required to make the compositions translucent, or clear, is preferably more than 50%, more preferably more than about 60%, and even more preferably more than about 75%, of the total organic solvent present.

The compositions can also be prepared as conventional dispersions of the fabric softener active containing from about 2% to about 50%, preferably from about 10% to about 40%, more preferably from about 15% to about 30%, of the fabric softener active. The compositions can also be prepared as solids, either granular, or attached to substrates, as disclosed hereinafter.

The pH of the aqueous compositions should be from about 1 to about 7, preferably from about 1.5 to about 5, more preferably from about 2 to about 3.5.

DETAILED DESCRIPTION OF THE INVENTION

I. FABRIC SOFTENING ACTIVE

The present invention relates to fabric softening actives and compositions containing, as an essential component, from about 2% to about 80%, preferably from about 13% to about 75%, more preferably from about 15% to about 70%, and even more preferably from about 19% to about 65%, by weight of the composition, of said fabric softener actives, said fabric softener actives being selected from the compounds identified hereinafter, and mixtures thereof.

(A) Diester Quaternary Ammonium Fabric Softening Active Compound (DEQA)

(1) The first type of DEQA preferably comprises, as the principal active, compounds of the formula $$[(R)_{4-m}—N^{(+)}—[(CH_2)_n—Y—R^1]_m]\ X^{(-)} \quad (1)$$

wherein each R substituent is hydrogen or a short chain $C_1$–$C_6$, preferably $C_1$–$C_3$ alkyl or hydroxyalkyl group, e.g., methyl (most preferred), ethyl, propyl, hydroxyethyl, and the like, benzyl, or mixtures thereof; each m is 2 or 3; each n is from 1 to about 4, preferably 2; each Y is —O—(O)C—, —(R)N—(O)C—, —C(O)—N(R)—, or —C(O)—O—, preferably —O—(O)C—; the sum of carbons in each $R^1$, plus one when Y is —O—(O)C— or —(R)N—(O)C—, is $C_6$–$C_{22}$, preferably $C_{12-22}$, more preferably $C_{14}$–$C_{20}$, but no more than one $R^1$, or $YR^1$, sum being less than about 12 and then the other $R^1$, or $YR^1$, sum is at least about 16, with each $R^1$ being a long chain $C_5$–$C_{21}$ (or $C_6$–$C_{22}$), preferably $C_9$–$C_{19}$ (or $C_9$–$C_{20}$), most preferably $C_{11}$–$C_{17}$ (or $C_{12}$–$C_{18}$), branched alkyl and unsaturated alkyl (including polyunsaturated alkyl), the ratio of branched alkyl to unsaturated alkyl being from about 5:95 to about 95:5, preferably from about 75:25 to about 25:75, more preferably from about 50:50 to about 30:70, especially 35:65, and for the unsaturated alkyl group, the Iodine Value of $R^1$ of the parent fatty acid of this $R^1$ group is preferably from about 20 to about 140, more preferably from about 50 to about 130; and most preferably from about 70 to about 115; and wherein the counterion, $X^-$, can be any softener-compatible anion, preferably, chloride, bromide, methylsulfate, ethylsulfate, sulfate, and/or nitrate, more preferably chloride;

2. softener having the formula:

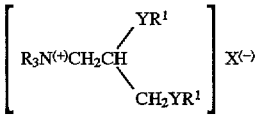

(2)

wherein each Y, R, $R^1$, and $X^{(-)}$ have the same meanings as before (Such compounds include those having the formula:

$$[CH_3]_3N^{(+)}[CH_2CH(CH_2O(O)CR^1)O(O)CR^1]Cl^{(-)}$$

where —O(O)$CR^1$ is derived partly from unsaturated, e.g., oleic, fatty acid and, preferably, each R is a methyl or ethyl group and preferably each $R^1$ is in the range of $C_{15}$ to $C_{19}$ with degrees of branching and substitution being present in the alkyl chains and partly from a branched chain fatty acid like isostearic acid); and 3. mixtures thereof.

The counterion, $X^{(-)}$ above, can be any softener-compatible anion, preferably the anion of a strong acid, for example, chloride, bromide, methylsulfate, ethylsulfate, sulfate, nitrate and the like, more preferably chloride. The anion can also, but less preferably, carry a double charge in which case $X^{(-)}$ represents half a group.

The fabric softener active can comprise mixtures of compounds containing, respectively, branched and unsaturated compounds. Preferred biodegradable quaternary ammonium fabric softening compounds useful in preparing such mixtures can contain the group —O—(O)$CR^1$ which is derived from unsaturated, and polyunsaturated, fatty acids, e.g., oleic acid, and/or partially hydrogenated fatty acids, derived from vegetable oils and/or partially hydrogenated vegetable oils, such as, canola oil, safflower oil, peanut oil, sunflower oil, corn oil, soybean oil, tall oil, rice bran oil, etc. Mixtures of unsaturated fatty acids, and mixtures of DEQAs that are derived from different unsaturated fatty acids can be used, and are preferred. Non-limiting examples of DEQAs prepared from preferred unsaturated fatty acids are disclosed hereinafter as $DEQA^1$ to $DEQA^8$.

$DEQA^6$ is prepared from a soy bean fatty acid, $DEQA^7$ is prepared from a slightly hydrogenated tallow fatty acid, and $DEQA^8$ is prepared from slightly hydrogenated canola fatty acids.

DEQAs prepared with $R^1$ groups that contain branched chains, e.g., from isostearic acid, for at least part of the $R^1$ groups comprise the other part of the mixture. It is also preferred that the fabric softener active itself comprise compounds containing mixed branched-chain and unsaturated $R^1$ groups. The total of active represented by the branched chain groups is typically from about 5% to about 95%, preferably from about 25% to about 75%, more preferably from about 35% to about 50%.

Suitable branched chain fatty acids that can be used to prepare branched, or mixed branched alkyl and unsaturated alkyl DEQAs, can be prepared by a variety of methods. The corresponding branched chain fatty alcohols can be prepared by reduction of the branched chain fatty acids by standard reactions, e.g., using borane-THF after the method of Brown, J. Amer. Chem. Soc. (1970), 92, 1637, incorporated herein by reference. The following are non-limiting examples of branched chain fatty acids.

Branched Chain Fatty Acid 1: 2-n-Heptylundecanoic Acid

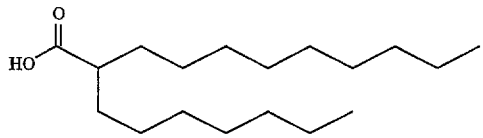

2-n-Heptylundecanoic acid [22890-21-7] is available from TCI America, catalog number IO281. It can be made by oxidizing the Guerbet alcohol 2-heptylundecanol which is, in turn, the aldol condensation product of nonanal. Guerbet alcohols are available commercially from Condea under the trade name ISOFOL® Alcohols.

Branched Chain Fatty Acid 2: 2-n-Hexyldecanoic Acid

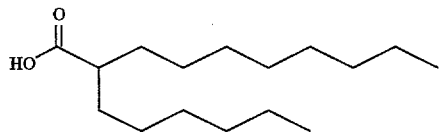

2-n-Heptylundecanoic acid [25354-97-6] is available from TCI America, catalog number H0507. It can be made by oxidizing the Guerbet alcohol 2-hexyldecanol which is, in turn, the aldol condensation product of octanal.

Branched Chain Fatty Acid 3: 2-n-Butyloctanoic Acid

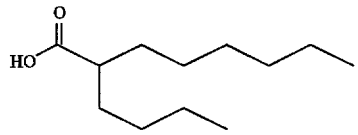

2-n-Butyloctanoic Acid is available from Union Carbide under the trade name ISOCARB® 12 Acid. It can be made by oxidizing the Guerbet alcohol 2-butyloctanol.

Branched Chain Fatty Acid 4: 5,7,9-Trimethylnonanoic Acid

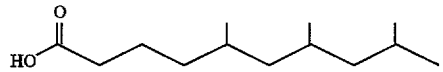

5,7,9-Trimethylnonanoic acid and 3,5,7,9-tetramethylnonanoic acid are made by the Union Camp Corporation using the oxo process described by N. E. Lawson, et. al. in *J Am. Oil. Chem. Soc.* 1981, 58, 59.

Branched Chain Fatty Acid 5: Alpha-alkylated Carboxylic Acids $$RR'CHCO_2H$$

Alpha substituted acids can be prepared by the C-alkylation of an enamine which is derived from a straight chained aldehyde such as octanal or decanal. The derived enamine will form the carbanion on the carbon alpha to the terminal nitrogen. Reaction of the enamine anion with an alkyl bromide, in the presence of a catalytic amount of NaI, will give the branched chain enamine which upon hydrolysis gives the alpha alkylated aldehyde. The aldehyde can then be oxidized to the corresponding carboxylic acid.

Alpha-heptyldecanoic acid

Decanal (aldehyde) can be reacted with an excess of a cyclic amine such as pyrrolidine, by heating at reflux in toluene in the presence of a trace amount of p-toluene sulfonic acid. As the amine condenses with the aldehyde, water is formed and can be removed by reflux through a water trap. After the theoretical amount of water has been removed, heptylbromide and sodium iodide can be added an the alkylation completed in the same solvent system. Following alkylation (overnight), the reaction mixture is poured over ice and made acidic with 20% HCl. This hydrolysis converts the alkylated enamine to the alpha-heptyl decanal. The product can be isolated by separation, washing, then drying, of the solvent layer and subsequent removal of the solvent by vacuum distillation.

The isolated branched aldehyde can then be converted to the desired carboxylic acid by oxidation in an appropriate solvent system. Examples of oxidizing agents are; aqueous potassium permanganate; The Jones Reagent ($CrO_3/H_2SO_4/H_2O$) in acetone; $CrO_3$-acetic acid,etc. Separation of the desired alpha-heptyldecanoic acid from the oxidizing medium will be facilitated by the high molecular weight of the acid.

Branched Chain Fatty Acid 6: 9- and 10-Alkoxyoctadecanoic Acids, Other Positional Isomers, and the Corresponding Alkoxyoctadecanols 9- and 10-Methoxyoctadecanoic Acids. The method of Siouffi et. al. described in Chemistry and Physics of Lipids, (1972), 8(2), 91–101 is followed. About 5 g portion of methyl oleate is dissolved in about 8 g of methanol and treated with tert-butyl hypobromite to give the mixed methoxybromo derivatives. These are isolated and debrominated with Rany catalyst and the crude acid is isolated after acidification. Hydrogenation of olefinic components in the crude acid is conducted in cyclohexane using platinum oxide. This produces the crude mixture of the desired 9- and 10-methoxyoctadecanoic acids.

9- and 10-Isopropoxvoctadecanoic Acids. The same procedure is used except that 2-propanol is substituted for methanol in the bromination step. This yields the desired 9- and 10-isopropoxyoctadecanoic acids.

Positional Isomers of Alkoxyoctadecanoic Acids: The same procedure is used except that oleic acid is first isomerized to a mixture of unsaturated acids by heating with methanesulfonic acid. The alkoxybromination-reduction sequence in this case leads to mixtures of additional positional isomers of alkoxyoctadecanoic acids.

Corresponding Fatty Alcohols. The substituted octadecanoic acids are reduced to the corresponding octadecanols using borane-THF after the method of Brown, J. Amer. Chem. Soc. (1970), 92, 1637.

Branched Chain Fatty Acid 7: Phenyloctadecanoic Acid, Alkylphenyloctadecanoic Acid, and the Corresponding Octadecanols Phenyloctadecanoic Acid. The method of Nakano and Foglia described in The Journal of the American Oil Chemists Society, (1984),61(3), 569–73 is used. About 5 g portion of oleic acid and about 6.91 g of benzene are treated dropwise with about 10.2 g of methanesulfonic acid at about 50° C. and then allowed to stir for about 6 hours. The reaction mixture is added to water and extracted with diethyl ether. Removal of the solvents by vacuum stripping gives the crude mixture of positional isomers of phenyloctadecanoic acid.

Methylphenyloctadecanoic Acid. The synthesis is repeated but with toluene instead of benzene to yield the mixed positional isomers of methylphenyloctadecanoic acid.

Corresponding Octadecanols. The substituted octadecanoic acids are reduced to the corresponding octadecanols using borane-THF after the method of Brown, J. Amer. Chem. Soc. (1970), 92, 1637.

Branched Chain Fatty Acid 8: Phenoxyoctadecanoic Acid, Hydroxyphenyloctadecanoic Acid, and the Corresponding Octadecanols Hydroxyphenyloctadecanoic Acids. The method of Nakano and Foglia described in The Journal of the American Oil Chemists Society, (1984),61(3), 569–73 is used. About 1:5:6 mole ratio of oleic acid, phenol, and methanesulfonic acid are allowed to react at about 25° C. for about 48 hours. The reaction mixture is added to water and extracted with ether. The extract is stripped of solvent and phenol to give the desired crude mixed positional isomers of hydroxyphenyloctadecanoic acid.

Phenoxyoctadecanoic Acids. The reaction is repeated with about 1:5:2 mole ratio of oleic acid, phenol, and methanesulfonic acid. The isolated crude product is predominantly phenoxyoctadecanoic acid, but also contains hydroxyphenyloctadecanoic acid. A purified mixture of phenoxyoctadecanoic acid positional isomers is obtained by chromatography.

Corresponding Octadecanols. The substituted octadecanoic acids are reduced to the corresponding octadecanols using borane-THF after the method of Brown, J. Amer. Chem. Soc. (1970), 92, 1637.

Branched Chain Fatty Acids 9: Isostearic Acids

Isostearic acids are produced from the monomeric acids obtained in the dimerization of unsaturated $C_{18}$ fatty acids, according to U.S. Pat. No. 2,812,342, issued Nov. 5, 1957 to R. M. Peters, incorporated herein by reference.

Suitable branched fabric softening actives which can be mixed with the above described unsaturated fabric softening actives (DEQAs) to form the fabric softening actives of this invention can be formed using the above branched chain fatty acids, and/or the corresponding branched chain fatty alcohols. Similarly, the branched chain fatty acids and/or alcohols can be used with unsaturated fatty acids and/or alcohols to form suitable mixed chain actives. Specific examples of DEQAs containing branched chains disclosed hereinafter as $DEQA^{10}$–$DEQA^{25}$ can be blended with unsaturated DEQAs. $DEQA^{10}$–$DEQA^{12}$ are prepared from different commercially available isostearic acids.

As disclosed hereinbefore, other preferred DEQA's are those that are prepared as a single DEQA from blends of all the different branched and unsaturated fatty acids that are represented (total fatty acid blend), rather than from blends of mixtures of separate finished DEQA's that are prepared from different portions of the total fatty acid blend.

It is preferred that at least a substantial percentage of the fatty acyl groups are unsaturated, e.g., from about 25% to 70%, preferably from about 50% to about 65%. Polyunsaturated fatty acid groups can be used. The total level of active containing polyunsaturated fatty acyl groups (TPU) can be from about 3% to about 30%, preferably from about 5% to about 25%, more preferably from about 10% to about 18%. Both cis and trans isomers can be used, preferably with a cis/trans ratio of from 1:1 to about 50:1, the minimum being 1:1, preferably at least 3:1, and more preferably from about 4:1 to about 20:1. (As used herein, the "percent of softener active" containing a given $R^1$ group is the same as the percentage of that same $R^1$ group is to the total $R^1$ groups used to form all of the softener actives.)

The unsaturated, including the polyunsaturated, fatty acyl groups, discussed hereinbefore and hereinafter, surprisingly provide effective softening when used with the branched chain fatty acyl groups, and also provide good rewetting characteristics, good antistatic characteristics, and especially, superior recovery after freezing and thawing.

The mixed branched-chain and unsaturated materials are easier to formulate than conventional saturated straight chain fabric softener actives. They can be used to form concentrated premixes that maintain their low viscosity and are therefore easier to process, e.g., pump, mix, etc. These materials with only the low amount of solvent that normally is associated with such materials, i.e., from about 5% to about 20%, preferably from about 8% to about 25%, more preferably from about 10% to about 20%, weight of the total softener/solvent mixture, are also easier to formulate into concentrated, stable compositions of the present invention, even at ambient temperatures. This ability to process the actives at low temperatures is especially important for the polyunsaturated groups, since it mimimizes degradation. Additional protection against degradation can be provided when the compounds and softener compositions contain effective antioxidants, chelants, and/or reducing agents, as disclosed hereinafter. The use of branched chain fatty acyl groups improves the resistance to degradation while maintaining fluidity and improving softening.

The present invention can also contain some medium-chain biodegradable quaternary ammonium fabric softening compound, DEQA, having the above formula (1) and/or formula (2), below, wherein:

each Y is —O—(O)C—, or —C(O)—O—, preferably —O—(O)C—;

m is 2 or 3, preferably 2;

each n is 1 to 4, preferably 2;

each R substituent is a $C_1$–$C_6$ alkyl, preferably a methyl, ethyl, propyl, benzyl groups and mixtures thereof, more preferably a $C_1$–$C_3$ alkyl group;

each $R^1$, or $YR^1$, is a saturated $C_8$–$C_{14}$, preferably a $C_{12-14}$ hydrophobic group comprising hydrocarbyl, or substituted hydrocarbyl substituent (the IV is preferably about 10 or less more preferably less than about 5), (The sum of the carbons in the acyl group, $R^1$+1, when Y is —O—(O)C— or —(R)N—(O)C—.) and the counterion, $X^-$, is the same as above. Preferably $X^-$does not include phosphate salts.

The saturated $C_8$–$C_{14}$ fatty acyl groups can be pure derivatives, or can be mixed chain lengths.

Suitable fatty acid sources for said fatty acyl groups are coco, lauric, caprylic, and capric acids.

For $C_{12}$–$C_{14}$ (or $C_{11}$–$C_{13}$) hydrocarbyl groups, the groups are preferably saturated, e.g., the IV is preferably less than about 10, preferably less than about 5.

It will be understood that the branched $R^1$ substituents can contain various groups such as alkoxyl groups which act as branching, and a small percentage can be straight, so long as the $R^1$ groups maintain their basically hydrophobic character. The preferred compounds can be considered to be biodegradable diester variations of hardened ditallow dimethyl ammonium chloride (hereinafter referred to as "DTDMAC"), which is a widely used fabric softener.

As used herein, when the diester is specified, it can include the monoester that is present. Preferably, at least about 80% of the DEQA is in the diester form, and from 0% to about 20% can be DEQA monoester, e.g., one $YR^1$ group is either —OH, or —C(O)OH, and, for Formula 1., m is 2. The corresponding diamide and/or mixed ester-amide can also include the active with one long chain hydrophobic group, e.g., one $YR^1$ group is either —N(R)H, or —C(O)OH. In the following, any disclosure, e.g., levels, for the monoester actives is also applicable to the monoamide actives. For softening, under no/low detergent carry-over laundry conditions the percentage of monoester should be as low as possible, preferably no more than about 5%. However, under high, anionic detergent surfactant or detergent builder carry-over conditions, some monoester can be preferred. The overall ratios of diester to monoester are from about 100:1 to about 2:1, preferably from about 50:1 to about 5:1, more preferably from about 13:1 to about 8:1. Under high detergent carry-over conditions, the di/monoester ratio is preferably about 11:1. The level of monoester present can be controlled in manufacturing the DEQA.

The above compounds, as exemplified hereinafter, used as the biodegradable quaternized ester-amine softening material in the practice of this invention, can be prepared using standard reaction chemistry. In one synthesis of a di-ester variation of DTDMAC, an amine of the formula $RN(CH_2CH_2OH)_2$ is esterified at both hydroxyl groups with an acid chloride of the formula $R^1C(O)Cl$, to form an amine which can be made cationic by acidification (one R is H) to be one type of softener, or then quaternized with an alkyl halide, RX, to yield the desired reaction product (wherein R and $R^1$ are as defined hereinbefore). However, it will be appreciated by those skilled in the chemical arts that this reaction sequence allows a broad selection of agents to be prepared.

Yet another DEQA softener active that is suitable for the formulation of the fabric softening actives and concentrated, clear liquid fabric softener compositions of the present invention has the above formula (1) wherein one R group is a $C_{1-4}$ hydroxy alkyl group, preferably one wherein one R group is a hydroxyethyl group.

(2) The second type of DEQA active has the general formula:

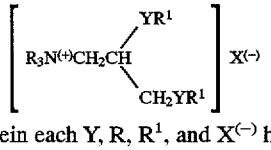

(2)

wherein each Y, R, $R^1$, and $X^{(-)}$ have the same meanings as before. Such compounds include those having the formula:

$$[CH_3]_3N^{(+)}[CH_2CH(CH_2O(O)CR^1)O(O)CR^1]Cl^{(-)}$$

where each R is a methyl or ethyl group and preferably each $R^1$ is in the range of $C_{15}$ to $C_{19}$. Degrees of substitution can be present in the alkyl or unsaturated alkyl chains. The anion $X^{(-)}$ in the molecule is the same as in DEQA (1) above. As used herein, when the diester is specified, it can include the monoester that is present. The amount of monoester that can be present is the same as in DEQA (1). An example of a preferred DEQA of formula (2) is the "propyl" ester quaternary ammonium fabric softener active having the formula 1,2-di(acyloxy)-3-trimethylammoniopropane chloride, wherein the acyl group is the same as that of $DEQA^5$, exemplified hereinafter as $DEQA^9$.

These types of agents and general methods of making them are disclosed in U.S. Pat. No. 4,137,180, Naik et al., issued Jan. 30, 1979, which is incorporated herein by reference..

In suitable softener actives (1) and (2), each $R^1$ is a branched alkyl, monounsaturated unsaturated alkyl, or polyunsaturated alkyl group; the actives containing mixtures of branched alkyl and unsaturated alkyl $R^1$ groups, especially within the individual molecules, in the ratios disclosed hereinbefore.

The DEQAs herein can contain a low level of fatty acid, which can be from unreacted starting material used to form the DEQA and/or as a by-product of any partial degradation (hydrolysis) of the softener active in the finished composition. It is preferred that the level of free fatty acid be low, preferably below about 10%, and more preferably below about 5%, by weight of the softener active.

II. OPIONAL, BUT PREFERRED, PRINCIPAL SOLVENT SYSTEM

The compositions of the present invention preferably comprise less than about 40%, preferably from about 10% to about 35%, more preferably from about 12% to about 25%, and even more preferably from about 14% to about 20%, of the principal solvent, by weight of the composition. Said principal solvent is selected to minimize solvent odor impact in the composition and to provide a low viscosity to the final composition. For example, isopropyl alcohol is not very effective and has a strong odor. n-Propyl alcohol is more effective, but also has a distinct odor. Several butyl alcohols also have odors but can be used for effective clarity/stability, especially when used as part of a principal solvent system to minimize their odor. The alcohols are also selected for optimum low temperature stability, that is they are able to form compositions that are liquid with acceptable low viscosities and translucent, preferably clear, down to about 40° F. (about 4.4° C.) and are able to recover after storage down to about 20° F. (about 6.7° C.).

The principal solvents are desirably kept to the lowest levels that are feasible in the present compositions for obtaining translucency or clarity. The presence of water exerts an important effect on the need for the principal solvents to achieve clarity of these compositions. The higher the water content, the higher the principal solvent level (relative to the softener level) is needed to attain product clarity. Inversely, the less the water content, the less principal solvent (relative to the softener) is needed. Thus, at low water levels of from about 5% to about 15%, the softener active-to-principal solvent weight ratio is preferably from about 55:45 to about 85:15, more preferably from about 60:40 to about 80:20. At water levels of from about 15% to about 70%, the softener active-to-principal solvent weight ratio is preferably from about 45:55 to about 70:30, more preferably from about 55:45 to about 70:30. But at high water levels of from about 70% to about 80%, the softener active-to-principal solvent weight ratio is preferably from about 30:70 to about 55:45, more preferably from about 35:65 to about 45:55. At even higher water levels, the softener to principal solvent ratios should also be even higher.

The suitability of any principal solvent for the formulation of the liquid, concentrated, preferably clear, fabric softener compositions herein with the requisite stability is surprisingly selective. Suitable solvents can be selected based upon their octanol/water partition coefficient (P). Octanol/water partition coefficient of a principal solvent is the ratio between its equilibrium concentration in octanol and in water. The partition coefficients of the principal solvent ingredients of this invention are conveniently given in the form of their logarithm to the base 10, logP.

The logP of many ingredients has been reported; for example, the Pomona92 database, available from Daylight Chemical Information Systems, Inc. (Daylight CIS), Irvine, Calif., contains many, along with citations to the original literature. However, the logP values are most conveniently calculated by the "CLOGP" program, also available from Daylight CIS. This program also lists experimental logP values when they are available in the Pomona92 database. The "calculated logP" (ClogP) is determined by the fragment approach of Hansch and Leo (cf., A. Leo, in Comprehensive Medicinal Chemistry, Vol. 4, C. Hansch, P. G. Sammens, J. B. Taylor and C. A. Ramsden, Eds., p. 295, Pergamon Press, 1990, incorporated herein by reference). The fragment approach is based on the chemical structure of each ingredient, and takes into account the numbers and types of atoms, the atom connectivity, and chemical bonding. These ClogP values, which are the most reliable and widely used estimates for this physicochemical property, are preferably used instead of the experimental logP values in the selection of the principal solvent ingredients which are useful in the present invention. Other methods that can be used to compute ClogP include, e.g., Crippen's fragmentation method as disclosed in J. Chem. Inf. Comput. Sci., 27, 21 (1987); Viswanadhan's fragmentation method as disclose in J. Chem. Inf. Comput. Sci., 29, 163 (1989); and Broto's method as disclosed in Eur. J. Med. Chem. -Chim. Theor., 19, 71 (1984).

The principal solvents herein are selected from those having a ClogP of from about 0.15 to about 0.64, preferably from about 0.25 to about 0.62, and more preferably from about 0.40 to about 0.60, said principal solvent preferably being at least somewhat asymmetric, and preferably having a melting, or solidification, point that allows it to be liquid at, or near room temperature. Solvents that have a low molecular weight and are biodegradable are also desirable for some purposes. The more assymetric solvents appear to be very desirable, whereas the highly symmetrical solvents such as 1,7-heptanediol, or 1,4-bis(hydroxymethyl) cyclohexane, which have a center of symmetry, appear to be unable to provide the essential clear compositions when used alone, even though their ClogP values fall in the preferred range.

The most preferred principal solvents can be identified by the appearance of the softener vesicles, as observed via cryogenic electron microscopy of the compositions that have been diluted to the concentration used in the rinse. These dilute compositions appear to have dispersions of fabric softener that exhibit a more unilamellar appearance than conventional fabric softener compositions. The closer to uni-lamellar the appearance, the better the compositions seem to perform. These compositions provide surprisingly good fabric softening as compared to similar compositions prepared in the conventional way with the same fabric softener active. The compositions also inherently provide improved perfume deposition as compared to conventional fabric softening compositions, especially when the perfume is added to the compositions at, or near, room temperature.

Operable principal solvents are listed below under various listings, e.g., aliphatic and/or alicyclic diols with a given number of carbon atoms; monols; derivatives of glycerine; alkoxylates of diols; and mixtures of all of the above. The preferred principal solvents are in italics and the most preferred principal solvents are in bold type. The reference numbers are the Chemical Abstracts Service Registry numbers (CAS No.) for those compounds that have such a number. Novel compounds have a method identified, described hereinafter, that can be used to prepare the compounds. Some inoperable principal solvents are also listed below for comparison purposes. The inoperable principal solvents, however, can be used in mixtures with operable principal solvents. Operable principal solvents can be used to make concentrated fabric softener compositions that meet the stability/clarity requirements set forth herein.

Many diol principal solvents that have the same chemical formula can exist as many stereoisomers and/or optical isomers. Each isomer is normally assigned with a different CAS No. For examples, different isomers of 4-methyl-2,3-hexanediol are assigned to at least the following CAS Nos:

146452-51-9; 146452-50-8; 146452-49-5; 146452-48-4; 123807-34-1; 123807-33-0; 123807-32-9; and 123807-31-8.

In the following listings, for simplicity, each chemical formula is listed with only one CAS No. This disclosure is only for exemplification and is sufficient to allow the practice of the invention. The disclosure is not limiting. Therefore, it is understood that other isomers with other CAS Nos, and their mixtures, are also included. By the same token, when a CAS No. represents a molecule which contains some particular isotopes, e.g., deuterium, tritium, carbon-13, etc., it is understood that materials which contain naturally distributed isotopes are also included, and vice versa.

TABLE I

MONO-OLS

| | CAS No. |
|---|---|
| n-propanol | 71-23-8 |
| 2-butanol | 15892-23-6 |
| 2-methyl-2-propanol | 75-65-0 |
| Inoperable Isomer | 78-83-1 |
| 2-methyl-1-propanol | |

TABLE II

C6 DIOLS

| | CAS No. |
|---|---|
| Operable Isomers | |
| 2,3-butanediol, 2,3-dimethyl- | 76-09-5 |
| 1,2-butanediol, 2,3-dimethyl- | 66553-15-9 |
| 1,2-butanediol, 3,3-dimethyl- | 59562-82-2 |
| 2,3-pentanediol, 2-methyl- | 7795-80-4 |
| 2,3-pentanediol, 3-methyl- | 63521-37-9 |
| 2,3-pentanediol, 4-methyl- | 7795-79-1 |
| 2,3-hexanediol | 617-30-1 |
| 3,4-hexanediol | 922-17-8 |
| 1,2-butanediol, 2-ethyl- | 66553-16-0 |
| 1,2-pentanediol, 2-methyl- | 20667-05-4 |
| 1,2-pentanediol, 3-methyl- | 159623-53-7 |
| 1,2-pentanediol, 4-methyl- | 72110-08-8 |
| 1,2-hexanediol | 6920-22-5 |
| Inoperable Isomers | |
| 1,3-propanediol, 2-ethyl-2-methyl- | |
| 1,3-propanediol, 2-isopropyl- | |
| 1,3-propanediol, 2-propyl- | |
| 1,3-butanediol, 2,2-dimethyl- | |
| 1,3-butanediol, 2,3-dimethyl- | |
| 1,3-butanediol, 2-ethyl- | |
| 1,4-butanediol, 2,2-dimethyl- | |
| 1,4-butanediol, 2,3-dimethyl- | |
| 1,4-butanediol, 2-ethyl- | |
| 1,3-pentanediol, 2-methyl- | |
| 1,3-pentanediol, 3-methyl- | |
| 1,3-pentanediol, 4-methyl- | |
| 1,4-pentanediol, 2-methyl- | |
| 1,4-pentanediol, 3-methyl- | |
| 1,4-pentanediol, 4-methyl- | |
| 1,5-pentanediol, 2-methyl- | |
| 1,5-pentanediol, 3-methyl- | |
| 2,4-pentanediol, 2-methyl- | |
| 2,4-pentanediol, 3-methyl- | |
| 1,3-hexanediol | |
| 1,4-hexanediol | |
| 1,5-hexanediol | |
| 1,6-hexanediol | |
| 2,4-hexanediol | |
| 2,5-hexanediol | |

TABLE III

C7 DIOLS

| | CAS No. |
|---|---|
| Operable Isomers | |
| 1,3-propanediol, 2-butyl- | 2612-26-2 |
| 1,3-propanediol, 2,2-diethyl- | 115-76-4 |
| 1,3-propanediol, 2-(1-methylpropyl) | 33673-01-7 |
| 1,3-propanediol, 2-(2-methylpropyl) | 26462-20-8 |
| 1,3-propanediol, 2-methyl-2-propyl | 78-26-2 |
| 1,2-butanediol, 2,3,3-trimethyl- | Method B |
| 1,4-butanediol, 2-ethyl-2-methyl- | 76651-98-4 |
| 1,4-butanediol, 2-ethyl-3-methyl- | 66225-34-1 |
| 1,4-butanediol, 2-propyl- | 62946-68-3 |
| 1,4-butanediol, 2-isopropyl- | 39497-66-0 |
| 1,5-pentanediol, 2,2-dimethyl- | 3121-82-2 |
| 1,5-pentanediol, 2,3-dimethyl- | 81554-20-3 |
| 1,5-pentanediol, 2,4-dimethyl- | 2121-69-9 |
| 1,5-pentanediol, 3,3-dimethyl- | 53120-74-4 |
| 2,3-pentanediol, 2,3-dimethyl- | 6931-70-0 |
| 2,3-pentanediol, 2,4-dimethyl- | 66225-53-4 |
| 2,3-pentanediol, 3,4-dimethyl- | 37164-04-8 |
| 2,3-pentanediol, 4,4-dimethyl- | 89851-45-6 |
| 3,4-pentanediol, 2,3-dimethyl- | Method B |
| 1,5-pentanediol, 2-ethyl- | 14189-13-0 |
| 1,6-hexanediol, 2-methyl- | 25258-92-8 |
| 1,6-hexanediol, 3-methyl- | 4089-71-8 |
| 2,3-hexanediol, 2-methyl- | 59215-55-3 |
| 2,3-hexanediol, 3-methyl- | 139093-40-6 |
| 2,3-hexanediol, 4-methyl- | *** |
| 2,3-hexanediol, 5-methyl- | Method B |
| 3,4-hexanediol, 2-methyl- | Method B |
| 3,4-hexanediol, 3-methyl- | 18938-47-1 |
| 1,3-heptanediol | 23433-04-7 |
| 1,4-heptanediol | 40646-07-9 |
| 1,5-heptanediol | 60096-09-5 |
| 1,6-heptanediol | 13175-27-4 |
| Preferred Isomers | |
| 1,3-propanediol, 2-butyl- | 2612-26-2 |
| 1,4-butanediol, 2-propyl- | 62946-68-3 |
| 1,5-pentanediol, 2-ethyl- | 14189-13-0 |
| 2,3-pentanediol, 2,3-dimethyl- | 6931-70-0 |
| 2,3-pentanediol, 2,4-dimethyl- | 66225-53-4 |
| 2,3-pentanediol, 3,4-dimethyl- | 37164-04-8 |
| 2,3-pentanediol, 4,4-dimethyl- | 89851-45-6 |
| 3,4-pentanediol, 2,3-dimethyl- | Method B |
| 1,6-hexanediol, 2-methyl- | 25258-92-8 |
| 1,6-hexanediol, 3-methyl- | 4089-71-8 |
| 1,3-heptanediol | 23433-04-7 |
| 1,4-heptanediol | 40646-07-9 |
| 1,5-heptanediol | 60096-09-5 |
| 1,6-heptanediol | 13175-27-4 |
| More Preferred Isomers | |
| 2,3-pentanediol, 2,3-dimethyl- | 6931-70-0 |
| 2,3-pentanediol, 2,4-dimethyl- | 66225-53-4 |
| 2,3-pentanediol, 3,4-dimethyl- | 37164-04-8 |
| 2,3-pentanediol, 4,4-dimethyl- | 89851-45-6 |
| 3,4-pentanediol, 2,3-dimethyl- | Method B |
| Inoperable Isomers | |
| 1,3-propanediol, 2-methyl-2-isopropyl- | |
| 1,2-butanediol, 2-ethyl-3-methyl- | |
| 1,3-butanediol, 2,2,3-trimethyl- | |
| 1,3-butanediol, 2-ethyl-2-methyl- | |
| 1,3-butanediol, 2-ethyl-3-methyl- | |
| 1,3-butanediol, 2-isopropyl- | |
| 1,3-butanediol, 2-propyl- | |
| 1,4-butanediol, 2,2,3-trimethyl | |
| 1,4-butanediol, 3-ethyl-1-methyl- | |
| 1,2-pentanediol, 2,3-dimethyl- | |
| 1,2-pentanediol, 2,4-dimethyl- | |
| 1,2-pentanediol, 3,3-dimethyl- | |
| 1,2-pentanediol, 3,4-dimethyl- | |
| 1,2-pentanediol, 4,4-dimethyl- | |
| 1,2-pentanediol, 2-ethyl- | |
| 1,3-pentanediol, 2,2-dimethyl- | |

TABLE III-continued

| C7 DIOLS | CAS No. |
|---|---|
| 1,3-pentanediol, 2,3-dimethyl- | |
| 1,3-pentanediol, 2,4-dimethyl- | |
| 1,3-pentanediol, 2-ethyl- | |
| 1,3-pentanediol, 3,4-dimethyl- | |
| 1,3-pentanediol, 4,4-dimethyl- | |
| 1,4-pentanediol, 2,2-dimethyl- | |
| 1,4-pentanediol, 2,3-dimethyl- | |
| 1,4-pentanediol, 2,4-dimethyl- | |
| 1,4-pentanediol, 3,3-dimethyl- | |
| 1,4-pentanediol, 3,4-dimethyl- | |
| 2,4-pentanediol, 2,3-dimethyl- | |
| 2,4-pentanediol, 2,4-dimethyl- | |
| 2,4-pentanediol, 3,3-dimethyl- | |
| 1,2-hexanediol, 2-methyl- | |
| 1,2-hexanediol, 3-methyl- | |
| 1,2-hexanediol, 4-methyl- | |
| 1,2-hexanediol, 5-methyl- | |
| 1,3-hexanediol, 2-methyl- | |
| 1,3-hexanediol, 3-methyl- | |
| 1,3-hexanediol, 4-methyl- | |
| 1,3-hexanediol, 5-methyl- | |
| 1,4-hexanediol, 2-methyl- | |
| 1,4-hexanediol, 3-methyl- | |
| 1,4-hexanediol, 4-methyl- | |
| 1,4-hexanediol, 5-methyl- | |
| 1,5-hexanediol, 2-methyl- | |
| 1,5-hexanediol, 3-methyl- | |
| 1,5-hexanediol, 4-methyl- | |
| 1,5-hexanediol, 5-methyl- | |
| 2,4-hexanediol, 2-methyl- | |
| 2,4-hexanediol, 3-methyl- | |
| 2,4-hexanediol, 4-methyl- | |
| 2,4-hexanediol, 5-methyl- | |
| 2,5-hexanediol, 2-methyl- | |
| 2,5-hexanediol, 3-methyl- | |
| 1,2-heptanediol | |
| 2,3-heptanediol | |
| 2,4-heptanediol | |
| 2,5-heptanediol | |
| 2,6-heptanediol | |
| 3,4-heptanediol | |
| 1,7-heptanediol | |
| 3,5-heptanediol | |

***146452-51-9; 146452-50-8; 146452-49-5; 146452-48-4; 123807-34-1; 123807-33-0; 123807-32-9; 123807-31-8; and mixtures thereof.

TABLE IV

| Chemical Name | CAS No. |
|---|---|
| OCTANEDIOL ISOMERS | |
| PROPANEDIOL DERIVATIVES | |
| Operable Isomers | |
| 1,3-propanediol, 2-(2-methylbutyl)- | 87194-40-9 |
| 1,3-propanediol, 2-(1,1-dimethylpropyl)- | Method D |
| 1,3-propanediol, 2-(1,2-dimethylpropyl)- | Method D |
| 1,3-propanediol, 2-(1-ethylpropyl)- | 25462-28-6 |
| 1,3-propanediol, 2-(1-methylbutyl)- | 22131-29-9 |
| 1,3-propanediol, 2-(2,2-dimethylpropyl)- | Method D |
| 1,3-propanediol, 2-(3-methylbutyl)- | 25462-27-5 |
| 1,3-propanediol, 2-butyl-2-methyl- | 3121-83-3 |
| 1,3-propanediol, 2-ethyl-2-isopropyl- | 24765-55-7 |
| 1,3-propanediol, 2-ethyl-2-propyl- | 25450-88-8 |
| 1,3-propanediol, 2-methyl-2-(1-methylpropyl)- | 813-60-5 |
| 1,3-propanediol, 2-methyl-2-(2-methylpropyl)- | 25462-42-4 |
| 1,3-propanediol, 2-tertiary-butyl-2-methyl- | 25462-45-7 |
| More Preferred Isomers | |
| 1,3-propanediol, 2-(1,1-dimethylpropyl)- | Method D |

TABLE IV-continued

| Chemical Name | CAS No. |
|---|---|
| 1,3-propanediol, 2-(1,2-dimethylpropyl)- | Method D |
| 1,3-propanediol, 2-(1-ethylpropyl)- | 25462-28-6 |
| 1,3-propanediol, 2-(2,2-dimethylpropyl)- | Method D |
| 1,3-propanediol, 2-ethyl-2-isopropyl- | 24765-55-7 |
| 1,3-propanediol, 2-methyl-2-(1-methylpropyl)- | 813-60-5 |
| 1,3-propanediol, 2-methyl-2-(2-methylpropyl)- | 25462-42-4 |
| 1,3-propanediol, 2-tertiary-butyl-2-methyl- | 25462-45-7 |
| Inoperable Isomers | |
| 1,3-propanediol, 2-pentyl- | |
| BUTANEDIOL DERIVATIVES | |
| Operable Isomers | |
| 1,3-butanediol, 2,2-diethyl- | 99799-77-6 |
| 1,3-butanediol, 2-(1-methylpropyl)- | Method C |
| 1,3-butanediol, 2-butyl- | 83988-22-1 |
| 1,3-butanediol, 2-ethyl-2,3-dimethyl- | Method D |
| 1,3-butanediol, 2-(1,1-dimethylethyl)- | 67271-58-3 |
| 1,3-butanediol, 2-(2-methylpropyl)- | Method C |
| 1,3-butanediol, 2-methyl-2-isopropyl- | Method C |
| 1,3-butanediol, 2-methyl-2-propyl- | 99799-79-8 |
| 1,3-butanediol, 3-methyl-2-isopropyl- | Method C |
| 1,3-butanediol, 3-methyl-2-propyl- | Method D |
| 1,4-butanediol, 2,2-diethyl- | Method H |
| 1,4-butanediol, 2-methyl-2-propyl- | Method H |
| 1,4-butanediol, 2-(1-methylpropyl)- | Method H |
| 1,4-butanediol, 2-ethyl-2,3-dimethyl- | Method F |
| 1,4-butanediol, 2-ethyl-3,3-dimethyl- | Method F |
| 1,4-butanediol, 2-(1,1-dimethylethyl)- | 36976-70-2 |
| 1,4-butanediol, 2-(2-methylpropyl)- | Method F |
| 1,4-butanediol, 2-methyl-3-propyl- | 90951-76-1 |
| 1,4-butanediol, 3-methyl-2-isopropyl- | 99799-24-3 |
| Preferred Isomers | |
| 1,3-butanediol, 2,2-diethyl- | 99799-77-6 |
| 1,3-butanediol, 2-(1-methylpropyl)- | Method C |
| 1,3-butanediol, 2-butyl- | 83988-22-1 |
| 1,3-butanediol, 2-ethyl-2,3-dimethyl- | Method D |
| 1,3-butanediol, 2-(1,1-dimethylethyl)- | 67271-58-3 |
| 1,3-butanediol, 2-(2-methylpropyl)- | Method C |
| 1,3-butanediol, 2-methyl-2-isopropyl- | Method C |
| 1,3-butanediol, 2-methyl-2-propyl- | 99799-79-8 |
| 1,3-butanediol, 3-methyl-2-propyl- | Method D |
| 1,4-butanediol, 2,2-diethyl- | Method H |
| 1,4-butanediol, 2-ethyl-2,3-dimethyl- | Method F |
| 1,4-butanediol, 2-ethyl-3,3-dimethyl- | Method F |
| 1,4-butanediol, 2-(1,1-dimethylethyl)- | 36976-70-2 |
| 1,4-butanediol, 3-methyl-2-isopropyl- | 99799-24-3 |
| More Preferred Isomers | |
| 1,3-butanediol, 2-(1-methylpropyl)- | Method C |
| 1,3-butanediol, 2-(2-methylpropyl)- | Method C |
| 1,3-butanediol, 2-butyl- | 83988-22-1 |
| 1,3-butanediol, 2-methyl-2-propyl- | 99799-79-8 |
| 1,3-butanediol, 3-methyl-2-propyl- | Method D |
| 1,4-butanediol, 2,2-diethyl- | Method H |
| 1,4-butanediol, 2-ethyl-2,3-dimethyl- | Method F |
| 1,4-butanediol, 2-ethyl-3,3-dimethyl- | Method F |
| 1,4-butanediol, 2-(1,1-dimethylethyl)- | 36976-70-2 |
| Inoperable Isomers | |
| 1,4-butanediol, 2-butyl- | |
| 1,2-butanediol, 2-ethyl-3,3-dimethyl- | |
| 1,4-butanediol, 2-methyl-2-isopropyl- | |
| 1,2-butanediol, 3-methyl-2-isopropyl- | |
| 1,4-butanediol, 2,2,3,3-tetramethyl- | |
| TRIMETHYLPENTANEDIOL ISOMERS | |
| Operable Isomers | |
| 1,3-pentanediol, 2,2,3-trimethyl- | 35512-54-0 |
| 1,3-pentanediol, 2,2,4-trimethyl- | 144-19-4 |
| 1,3-pentanediol, 2,3,4-trimethyl- | 116614-13-2 |
| 1,3-pentanediol, 2,4,4-trimethyl- | 109387-36-2 |
| 1,3-pentanediol, 3,4,4-trimethyl- | 81756-50-5 |
| 1,4-pentanediol, 2,2,3-trimethyl- | Method H |

TABLE IV-continued

| Chemical Name | CAS No. |
|---|---|
| 1,4-pentanediol, 2,2,4-trimethyl- | 80864-10-4 |
| 1,4-pentanediol, 2,3,3-trimethyl- | Method H |
| 1,4-pentanediol, 2,3,4-trimethyl- | 92340-74-4 |
| 1,4-pentanediol, 3,3,4-trimethyl- | 16466-35-6 |
| 1,5-pentanediol, 2,2,3-trimethyl- | Method F |
| 1,5-pentanediol, 2,2,4-trimethyl- | 3465-14-3 |
| 1,5-pentanediol, 2,3,3-trimethyl- | Method A |
| 1,5-pentanediol, 2,3,4-trimethyl- | 85373-83-7 |
| 2,4-pentanediol, 2,3,3-trimethyl- | 24892-51-1 |
| 2,4-pentanediol, 2,3,4-trimethyl- | 24892-52-2 |
| Preferred Isomers | |
| 1,3-pentanediol, 2,2,3-trimethyl- | 35512-54-0 |
| 1,3-pentanediol, 2,2,4-trimethyl- | 144-19-4 |
| 1,3-pentanediol, 2,3,4-trimethyl- | 116614-13-2 |
| 1,3-pentanediol, 2,4,4-trimethyl- | 109387-36-2 |
| 1,3-pentanediol, 3,4,4-trimethyl- | 81756-50-5 |
| 1,4-pentanediol, 2,2,3-trimethyl- | Method H |
| 1,4-pentanediol, 2,2,4-trimethyl- | 80864-10-4 |
| 1,4-pentanediol, 2,3,3-trimethyl- | Method F |
| 1,4-pentanediol, 2,3,4-trimethyl- | 92340-74-4 |
| 1,4-pentanediol, 3,3,4-trimethyl- | 16466-35-6 |
| 1,5-pentanediol, 2,2,3-trimethyl- | Method A |
| 1,5-pentanediol, 2,2,4-trimethyl- | 3465-14-3 |
| 1,5-pentanediol, 2,3,3-trimethyl- | Method A |
| 2,4-pentanediol, 2,3,4-trimethyl- | 24892-52-2 |
| More Preferred Iomers | |
| 1,3-pentanediol, 2,3,4-trimethyl- | 116614-13-2 |
| 1,4-pentanediol, 2,3,4-trimethyl- | 92340-74-4 |
| 1,5-pentanediol, 2,2,3-trimethyl- | Method A |
| 1,5-pentanediol, 2,2,4-trimethyl- | 3465-14-3 |
| 1,5-pentanediol, 2,3,3-trimethyl- | Method A |
| Inoperable Isomers | |
| 1,2-pentanediol, 2,3,3-trimethyl- | |
| 1,2-pentanediol, 2,3,4-trimethyl- | |
| 1,2-pentanediol, 2,4,4-trimethyl- | |
| 1,2-pentanediol, 3,3,4-trimethyl- | |
| 1,2-pentanediol, 3,4,4-trimethyl- | |
| 2,3-pentanediol, 2,3,4-trimethyl- | |
| 2,3-pentanediol, 2,4,4-trimethyl- | |
| 2,3-pentanediol, 3,4,4-trimethyl- | |
| ETHYLMETHYLPENTANEDIOL ISOMERS | |
| Operable Isomers | |
| 1,3-pentanediol, 2-ethyl-2-methyl- | Method C |
| 1,3-pentanediol, 2-ethyl-3-methyl- | Method D |
| 1,3-pentanediol, 2-ethyl-4-methyl- | 148904-97-6 |
| 1,3-pentanediol, 3-ethyl-2-methyl- | 55661-05-7 |
| 1,4-pentanediol, 2-ethyl-2-methyl- | Method H |
| 1,4-pentanediol, 2-ethyl-3-methyl- | Method F |
| 1,4-pentanediol, 2-ethyl-4-methyl- | Method G |
| 1,4-pentanediol, 3-ethyl-2-methyl- | Method F |
| 1,4-pentanediol, 3-ethyl-3-methyl- | Method F |
| 1,5-pentanediol, 2-ethyl-2-methyl- | Method F |
| 1,5-pentanediol, 2-ethyl-3-methyl- | 54886-83-8 |
| 1,5-pentanediol, 2-ethyl-4-methyl- | Method F |
| 1,5-pentanediol, 3-ethyl-3-methyl- | 57740-12-2 |
| 2,4-pentanediol, 3-ethyl-2-methyl- | Method G |
| More Preferred Isomers | |
| 1,3-pentanediol, 2-ethyl-2-methyl- | Method C |
| 1,3-pentanediol, 2-ethyl-3-methyl- | Method D |
| 1,3-pentanediol, 2-ethyl-4-methyl- | 148904-97-6 |
| 1,3-pentanediol, 3-ethyl-2-methyl- | 55661-05-7 |
| 1,4-pentanediol, 2-ethyl-2-methyl- | Method H |
| 1,4-pentanediol, 2-ethyl-3-methyl- | Method F |
| 1,4-pentanediol, 2-ethyl-4-methyl- | Method G |
| 1,5-pentanediol, 3-ethyl-3-methyl- | 57740-12-2 |
| 2,4-pentanediol, 3-ethyl-2-methyl- | Method G |
| Inoperable Isomers | |
| 1,2-pentanediol, 2-ethyl-3-methyl- | |
| 1,2-pentanediol, 2-ethyl-4-methyl- | |
| 1,2-pentanediol, 3-ethyl-2-methyl- | |

TABLE IV-continued

| Chemical Name | CAS No. |
|---|---|
| 1,2-pentanediol, 3-ethyl-3-methyl- | |
| 1,2-pentanediol, 3-ethyl-4-methyl- | |
| 1,3-pentanediol, 3-ethyl-4-methyl- | |
| 1,4-pentanediol, 3-ethyl-4-methyl- | |
| 1,5-pentanediol, 3-ethyl-2-methyl- | |
| 2,3-pentanediol, 3-ethyl-2-methyl- | |
| 2,3-pentanediol, 3-ethyl-4-methyl- | |
| 2,4-pentanediol, 3-ethyl-3-methyl- | |
| PROPYLPENTANEDIOL ISOMERS | |
| Operable Isomers | |
| 1,3-pentanediol, 2-isopropyl- | Method D |
| 1,3-pentanediol, 2-propyl- | Method C |
| 1,4-pentanediol, 2-isopropyl- | Method H |
| 1,4-pentanediol, 2-propyl- | Method H |
| 1,4-pentanediol, 3-isopropyl- | Method H |
| 1,5-pentanediol, 2-isopropyl- | 90951-89-6 |
| 2,4-pentanediol, 3-propyl- | Method C |
| More Preferred Isomers | |
| 1,3-pentanediol, 2-isopropyl- | Method D |
| 1,3-pentanediol, 2-propyl- | Method C |
| 1,4-pentanediol, 2-isopropyl- | Method H |
| 1,4-pentanediol, 2-propyl- | Method H |
| 1,4-pentanediol, 3-isopropyl- | Method H |
| 2,4-pentanediol, 3-propyl- | Method C |
| Inoperable Isomers | |
| 1,2-pentanediol, 2-propyl- | |
| 1,2-pentanediol, 2-isopropyl- | |
| 1,4-pentanediol, 3-propyl- | |
| 1,5-pentanediol, 2-propyl- | |
| 2,4-pentanediol, 3-isopropyl- | |
| DIMETHYLHEXANEDIOL ISOMERS | |
| Operable Isomers | |
| 1,3-hexanediol, 2,2-dimethyl- | 22006-96-8 |
| 1,3-hexanediol, 2,3-dimethyl- | Method D |
| 1,3-hexanediol, 2,4-dimethyl- | 78122-99-3 |
| 1,3-hexanediol, 2,5-dimethyl- | Method C |
| 1,3-hexanediol, 3,4-dimethyl- | Method D |
| 1,3-hexanediol, 3,5-dimethyl- | Method D |
| 1,3-hexanediol, 4,4-dimethyl- | Method C |
| 1,3-hexanediol, 4,5-dimethyl- | Method C |
| 1,4-hexanediol, 2,2-dimethyl- | Method F |
| 1,4-hexanediol, 2,3-dimethyl- | Method F |
| 1,4-hexanediol, 2,4-dimethyl- | Method G |
| 1,4-hexanediol, 2,5-dimethyl- | 22417-60-3 |
| 1,4-hexanediol, 3,3-dimethyl- | Method F |
| 1,4-hexanediol, 3,4-dimethyl- | Method E |
| 1,4-hexanediol, 3,5-dimethyl- | Method H |
| 1,4-hexanediol, 4,5-dimethyl- | Method E |
| 1,4-hexanediol, 5,5-dimethyl- | 38624-38-3 |
| 1,5-hexanediol, 2,2-dimethyl- | Method A |
| 1,5-hexanediol, 2,3-dimethyl- | 62718-05-2 |
| 1,5-hexanediol, 2,4-dimethyl- | 73455-82-0 |
| 1,5-hexanediol, 2,5-dimethyl- | 58510-28-4 |
| 1,5-hexanediol, 3,3-dimethyl- | 41736-99-6 |
| 1,5-hexanediol, 3,4-dimethyl- | Method A |
| 1,5-hexanediol, 3,5-dimethyl- | Method G |
| 1,5-hexanediol, 4,5-dimethyl- | Method F |
| 1,6-hexanediol, 2,2-dimethyl- | 13622-91-8 |
| 1,6-hexanediol, 2,3-dimethyl- | Method F |
| 1,6-hexanediol, 2,4-dimethyl- | Method F |
| 1,6-hexanediol, 2,5-dimethyl- | 49623-11-2 |
| 1,6-hexanediol, 3,3-dimethyl- | Method F |
| 1,6-hexanediol, 3,4-dimethyl- | 65363-45-3 |
| 2,4-hexanediol, 2,3-dimethyl- | 26344-17-2 |
| 2,4-hexanediol, 2,4-dimethyl- | 29649-22-7 |
| 2,4-hexanediol, 2,5-dimethyl- | 3899-89-6 |
| 2,4-hexanediol, 3,3-dimethyl- | 42412-51-1 |
| 2,4-hexanediol, 3,4-dimethyl- | 90951-83-0 |
| 2,4-hexanediol, 3,5-dimethyl- | 159300-34-2 |
| 2,4-hexanediol, 4,5-dimethyl- | Method D |
| 2,4-hexanediol, 5,5-dimethyl- | 108505-10-8 |

TABLE IV-continued

| Chemical Name | CAS No. |
|---|---|
| 2,5-hexanediol, 2,3-dimethyl- | Method G |
| 2,5-hexanediol, 2,4-dimethyl- | Method G |
| 2,5-hexanediol, 2,5-dimethyl- | 110-03-2 |
| 2,5-hexanediol, 3,3-dimethyl- | Method H |
| 2,5-hexanediol, 3,4-dimethyl- | 99799-30-1 |
| 2,6-hexanediol, 3,3-dimethyl- | Method A |
| More Preferred Isomers | |
| 1,3-hexanediol, 2,2-dimethyl- | 22006-96-8 |
| 1,3-hexanediol, 2,3-dimethyl- | Method D |
| 1,3-hexanediol, 2,4-dimethyl- | 78122-99-3 |
| 1,3-hexanediol, 2,5-dimethyl- | Method C |
| 1,3-hexanediol, 3,4-dimethyl- | Method D |
| 1,3-hexanediol, 3,5-dimethyl- | Method D |
| 1,3-hexanediol, 4,4-dimethyl- | Method C |
| 1,3-hexanediol, 4,5-dimethyl- | Method C |
| 1,4-hexanediol, 2,2-dimethyl- | Method H |
| 1,4-hexanediol, 2,3-dimethyl- | Method F |
| 1,4-hexanediol, 2,4-dimethyl- | Method G |
| 1,4-hexanediol, 2,5-dimethyl- | 22417-60-3 |
| 1,4-hexanediol, 3,3-dimethyl- | Method F |
| 1,4-hexanediol, 3,4-dimethyl- | Method E |
| 1,4-hexanediol, 3,5-dimethyl- | Method H |
| 1,4-hexanediol, 4,5-dimethyl- | Method E |
| 1,4-hexanediol, 5,5-dimethyl- | 38624-38-3 |
| 1,5-hexanediol, 2,2-dimethyl- | Method A |
| 1,5-hexanediol, 2,3-dimethyl- | 62718-05-2 |
| 1,5-hexanediol, 2,4-dimethyl- | 73455-82-0 |
| 1,5-hexanediol, 2,5-dimethyl- | 58510-28-4 |
| 1,5-hexanediol, 3,3-dimethyl- | 41736-99-6 |
| 1,5-hexanediol, 3,4-dimethyl- | Method A |
| 1,5-hexanediol, 3,5-dimethyl- | Method G |
| 1,5-hexanediol, 4,5-dimethyl- | Method F |
| 2,6-hexanediol, 3,3-dimethyl- | Method A |
| Inoperable Isomers | |
| 1,2-hexanediol, 2,3-dimethyl- | |
| 1,2-hexanediol, 2,4-dimethyl- | |
| 1,2-hexanediol, 2,5-dimethyl- | |
| 1,2-hexanediol, 3,3-dimethyl- | |
| 1,2-hexanediol, 3,4-dimethyl- | |
| 1,2-hexanediol, 3,5-dimethyl- | |
| 1,2-hexanediol, 4,4-dimethyl- | |
| 1,2-hexanediol, 4,5-dimethyl- | |
| 1,2-hexanediol, 5,5-dimethyl- | |
| 2,3-hexanediol, 2,3-dimethyl- | |
| 2,3-hexanediol, 2,4-dimethyl- | |
| 2,3-hexanediol, 2,5-dimethyl- | |
| 2,3-hexanediol, 3,4-dimethyl- | |
| 2,3-hexanediol, 3,5-dimethyl- | |
| 2,3-hexanediol, 4,4-dimethyl- | |
| 2,3-hexanediol, 4,5-dimethyl- | |
| 2,3-hexanediol, 5,5-dimethyl- | |
| 3,4-hexanediol, 2,2-dimethyl- | |
| 3,4-hexanediol, 2,3-dimethyl- | |
| 3,4-hexanediol, 2,4-dimethyl- | |
| 3,4-hexanediol, 2,5-dimethyl- | |
| 3,4-hexanediol, 3,4-dimethyl- | |
| ETHYLHEXANEDIOL ISOMERS | |
| More Preferred Isomers | |
| 1,3-hexanediol, 2-ethyl- | 94-96-2 |
| 1,3-hexanediol, 4-ethyl- | Method C |
| 1,4-hexanediol, 2-ethyl- | 148904-97-6 |
| 1,4-hexanediol, 4-ethyl- | 1113-00-4 |
| 1,5-hexanediol, 2-ethyl- | 58374-34-8 |
| 2,4-hexanediol, 3-ethyl- | Method C |
| 2,4-hexanediol, 4-ethyl- | 33683-47-5 |
| 2,5-hexanediol, 3-ethyl- | Method F |
| Inoperable Isomers | |
| 1,5-hexanediol, 4-ethyl- | |
| 1,6-hexanediol, 2-ethyl- | |
| 1,4-hexanediol, 3-ethyl- | |
| 1,5-hexanediol, 3-ethyl- | |
| 1,6-hexanediol, 3-ethyl- | |

TABLE IV-continued

| Chemical Name | CAS No. |
|---|---|
| 1,2-hexanediol, 2-ethyl- | |
| 1,2-hexanediol, 3-ethyl- | |
| 1,2-hexanediol, 4-ethyl- | |
| 2,3-hexanediol, 3-ethyl- | |
| 2,3-hexanediol, 4-ethyl- | |
| 3,4-hexanediol, 3-ethyl- | |
| 1,3-hexanediol, 3-ethyl- | |
| METHYLHEPTANEDIOL ISOMERS | |
| Operable Isomers | |
| 1,3-heptanediol, 2-methyl- | 109417-38-1 |
| 1,3-heptanediol, 3-methyl- | 165326-88-5 |
| 1,3-heptanediol, 4-methyl- | Method C |
| 1,3-heptanediol, 5-methyl- | Method D |
| 1,3-heptanediol, 6-methyl- | Method C |
| 1,4-heptanediol, 2-methyl- | 15966-03-7 |
| 1,4-heptanediol, 3-methyl- | 7748-38-1 |
| 1,4-heptanediol, 4-methyl- | 72473-94-0 |
| 1,4-heptanediol, 5-methyl- | 63003-04-3 |
| 1,4-heptanediol, 6-methyl- | 99799-25-4 |
| 1,5-heptanediol, 2-methyl- | 141605-00-7 |
| 1,5-heptanediol, 3-methyl- | Method A |
| 1,5-heptanediol, 4-methyl- | Method A |
| 1,5-heptanediol, 5-methyl- | 99799-26-5 |
| 1,5-heptanediol, 6-methyl- | 57740-00-8 |
| 1,6-heptanediol, 2-methyl- | 132148-22-2 |
| 1,6-heptanediol, 3-methyl- | Method G |
| 1,6-heptanediol, 4-methyl- | 156307-84-5 |
| 1,6-heptanediol, 5-methyl- | Method A |
| 1,6-heptanediol, 6-methyl- | 5392-57-4 |
| 2,4-heptanediol, 2-methyl- | 38836-26-9 |
| 2,4-heptanediol, 3-methyl- | 6964-04-1 |
| 2,4-heptanediol, 4-methyl- | 165326-87-4 |
| 2,4-heptanediol, 5-methyl- | Method C |
| 2,4-heptanediol, 6-methyl- | 79356-95-9 |
| 2,5-heptanediol, 2-methyl- | 141605-02-9 |
| 2,5-heptanediol, 3-methyl- | Method G |
| 2,5-heptanediol, 4-methyl- | 156407-38-4 |
| 2,5-heptanediol, 5-methyl- | 148843-72-5 |
| 2,5-heptanediol, 6-methyl- | 51916-46-2 |
| 2,6-heptanediol, 2-methyl- | 73304-48-0 |
| 2,6-heptanediol, 3-methyl- | 29915-96-6 |
| 2,6-heptanediol, 4-methyl- | 106257-69-6 |
| 3,4-heptanediol, 3-methyl- | 18938-50-6 |
| 3,5-heptanediol, 2-methyl- | Method C |
| 3,5-heptanediol, 3-methyl- | 99799-27-6 |
| 3,5-heptanediol, 4-methyl- | 156407-37-3 |
| More Preferred Isomers | |
| 1,3-heptanediol, 2-methyl- | 109417-38-1 |
| 1,3-heptanediol, 3-methyl- | 165326-88-5 |
| 1,3-heptanediol, 4-methyl- | Method C |
| 1,3-heptanediol, 5-methyl- | Method D |
| 1,3-heptanediol, 6-methyl- | Method C |
| 1,4-heptanediol, 2-methyl- | 15966-03-7 |
| 1,4-heptanediol, 3-methyl- | 7748-38-1 |
| 1,4-heptanediol, 4-methyl- | 72473-94-0 |
| 1,4-heptanediol, 5-methyl- | 63003-04-3 |
| 1,4-heptanediol, 6-methyl- | 99799-25-4 |
| 1,5-heptanediol, 2-methyl- | 141605-00-7 |
| 1,5-heptanediol, 3-methyl- | Method A |
| 1,5-heptanediol, 4-methyl- | Method A |
| 1,5-heptanediol, 5-methyl- | 99799-26-5 |
| 1,5-heptanediol, 6-methyl- | 57740-00-8 |
| 1,6-heptanediol, 2-methyl- | 132148-22-2 |
| 1,6-heptanediol, 3-methyl- | Method G |
| 1,6-heptanediol, 4-methyl- | 156307-84-5 |
| 1,6-heptanediol, 5-methyl- | Method A |
| 1,6-heptanediol, 6-methyl- | 5392-57-4 |
| 2,4-heptanediol, 2-methyl- | 38836-26-9 |
| 2,4-heptanediol, 3-methyl- | 6964-04-1 |
| 2,4-heptanediol, 4-methyl- | 165326-84-4 |
| 2,4-heptanediol, 5-methyl- | Method C |
| 2,4-heptanediol, 6-methyl- | 79356-95-9 |
| 2,5-heptanediol, 2-methyl- | 141605-02-9 |
| 2,5-heptanediol, 3-methyl- | Method H |

TABLE IV-continued

| Chemical Name | CAS No. |
|---|---|
| 2,5-heptanediol, 4-methyl- | 156407-38-4 |
| 2,5-heptanediol, 5-methyl- | 148843-72-5 |
| 2,5-heptanediol, 6-methyl- | 51916-46-2 |
| 2,6-heptanediol, 2-methyl- | 73304-48-0 |
| 2,6-heptanediol, 3-methyl- | 29915-96-6 |
| 2,6-heptanediol, 4-methyl- | 106257-69-6 |
| 3,4-heptanediol, 3-methyl- | 18938-50-6 |
| 3,5-heptanediol, 2-methyl- | Method C |
| 3,5-heptanediol, 4-methyl- | 156407-37-3 |
| Inoperable Isomers | |
| 1,7-heptanediol, 2-methyl- | |
| 1,7-heptanediol, 3-methyl- | |
| 1,7-heptanediol, 4-methyl- | |
| 2,3-heptanediol, 2-methyl- | |
| 2,3-heptanediol, 3-methyl- | |
| 2,3-heptanediol, 4-methyl- | |
| 2,3-heptanediol, 5-methyl- | |
| 2,3-heptanediol, 6-methyl- | |
| 3,4-heptanediol, 2-methyl- | |
| 3,4-heptanediol, 4-methyl- | |
| 3,4-heptanediol, 5-methyl- | |
| 3,4-heptanediol, 6-methyl- | |
| 1,2-heptanediol, 2-methyl- | |
| 1,2-heptanediol, 3-methyl- | |
| 1,2-heptanediol, 4-methyl- | |
| 1,2-heptanediol, 5-methyl- | |
| 1,2-heptanediol, 6-methyl- | |
| OCTANEDIOL ISOMERS | |
| More Preferred Isomers | |
| 2,4-octanediol | 90162-24-6 |
| 2,5-octanediol | 4527-78-0 |
| 2,6-octanediol | Method A |
| 2,7-octanediol | 19686-96-5 |
| 3,5-octanediol | 24892-55-5 |
| 3,6-octanediol | 24434-09-1 |
| Inoperable Isomers | |
| 1,2-octanediol | 1117-86-8 |
| 1,3-octanediol | 23433-05-8 |
| 1,4-octanediol | 51916-47-3 |
| 1,5-octanediol | 2736-67-6 |
| 1,6-octanediol | 4060-76-6 |
| 1,7-octanediol | 13175-32-1 |
| 1,8-octanediol | 629-41-4 |
| 2,3-octanediol | e.g., 98464-24-5 |
| 3,4-octanediol | e.g., 99799-31-2 |
| 3,5-octanediol | e.g., 129025-63-4 |

TABLE V

| NONANEDIOL ISOMERS | |
|---|---|
| Chemical Name | CAS No. |
| Preferred Isomers | |
| 2,4-pentanediol, 2,3,3,4-tetramethyl- | 19424-43-2 |
| Operable Isomers | |
| 2,4-pentanediol, 3-tertiarybutyl- | 142205-14-9 |
| 2,4-hexanediol, 2,5,5-trimethyl- | 97460-08-7 |
| 2,4-hexanediol, 3,3,4-trimethyl- | Method D |
| 2,4-hexanediol, 3,3,5-trimethyl- | 27122-58-3 |
| 2,4-hexanediol, 3,5,5-trimethyl- | Method D |
| 2,4-hexanediol, 4,5,5-trimethyl- | Method D |
| 2,5-hexanediol, 3,3,4-trimethyl- | Method H |
| 2,5-hexanediol, 3,3,5-trimethyl- | Method G |
| Inoperable Isomers | |
| There are over 500 inoperable isomers including the following: | |
| 2,4-hexanediol, 2,4,5-trimethyl- | 36587-81-2 |

TABLE V-continued

| NONANEDIOL ISOMERS | |
|---|---|
| Chemical Name | CAS No. |
| 2,4-hexanediol, 2,3,5-trimethyl-, erythro- | 26344-20-7 |
| 2,4-hexanediol, 2,3,5-trimethyl-, threo- | 26343-49-7 |
| 1,3-propanediol, 2-butyl-2-ethyl- | 115-84-4 |
| 2,4-hexanediol, 2,3,5-trimethyl-, threo- | 26343-49-7 |

TABLE VI

| | CAS No. |
|---|---|
| ALKYL GLYCERYL ETHERS, DI(HYDROXYALKYL)ETHERS, AND ARYL GLYCERYL ETHERS | |
| Preferred Monoglycerol Ethers and Derivatives | |
| 1,2-propanediol, 3-(butyloxy)-, triethoxylated | |
| 1,2-propanediol, 3-(butyloxy)-, tetraethoxylated | |
| More Preferred Monoglycerol Ethers and Derivatives | |
| 1,2-propanediol, 3-(n-pentyloxy)- | 22636-32-4 |
| 1,2-propanediol, 3-(2-pentyloxy)- | |
| 1,2-propanediol, 3-(3-pentyloxy)- | |
| 1,2-propanediol, 3-(2-methyl-1-butyloxy)- | |
| 1,2-propanediol, 3-(iso-amyloxy)- | |
| 1,2-propanediol, 3-(3-methyl-2-butyloxy)- | |
| 1,2-propanediol, 3-(cyclohexyloxy)- | |
| 1,2-propanediol, 3-(cyclohexyloxy)-1-enyloxy)- | |
| 1,3-propanediol, 2-(pentyloxy)- | |
| 1,3-propanediol, 2-(2-pentyloxy)- | |
| 1,3-propanediol, 2-(3-pentyloxy)- | |
| 1,3-propanediol, 2-(2-methyl-1-butyloxy)- | |
| 1,3-propanediol, 2-(iso-amyloxy)- | |
| 1,3-propanediol, 2-(3-methyl-2-butyloxy)- | |
| 1,3-propanediol, 2-(cyclohexyloxy)- | |
| 1,3-propanediol, 2-(1-cyclohex-1-enyloxy)- | |
| 1,2-propanediol, 3-(butyloxy)-, pentaethoxylated | |
| 1,2-propanediol, 3-(butyloxy)-, hexaethoxylated | |
| 1,2-propanediol, 3-(butyloxy)-, heptaethoxylated | |
| 1,2-propanediol, 3-(butyloxy)-, octaethoxylated | |
| 1,2-propanediol, 3-(butyloxy)-, nonaethoxylated | |
| 1,2-propanediol, 3-(butyloxy)-, monopropoxylated | |
| 1,2-propanediol, 3-(butyloxy)-, dibutyleneoxylated | |
| 1,2-propanediol, 3-(butyloxy)-, tributyleneoxylated | |
| More Preferred Di(hydroxyalkyl)Ethers | |
| bis(2-hydroxybutyl)ether | |
| bis(2-hydroxycyclopentyl)ether | |
| Inoperable Monoglycerol Ethers | |
| 1,2-propanediol, 3-ethyloxy- | |
| 1,2-propanediol, 3-propyloxy- | |
| 1,2-propanediol, 3-isopropyoxy- | |
| 1,2-propanediol, 3-butyloxy- | |
| 1,2-propanediol, 3-isobutyloxy- | |
| 1,2-propanediol, 3-tert-butyloxy- | |
| 1,2-propanediol, 3-octyloxy- | |
| 1,2-propanediol, 3-(2-ethylhexyloxy)- | |
| 1,2-propanediol, 3-(cyclopentyloxy)- | |
| 1,2-propanediol, 3-(1-cyclohex-2-enyloxy)- | |
| 1,3-propanediol, 2-(1-cyclohex-2-enyloxy)- | |
| AROMATIC GLYCERYL ETHERS | |
| Operable Aromatic Glyceryl Ethers | |
| 1,2-propanediol, 3-phenyloxy- | |
| 1,2-propanediol, 3-benzyloxy- | |
| 1,2-propanediol, 3-(2-phenylethyloxy)- | |
| 1,2-propanediol, 3-(1-phenyl-2-propanyloxy)- | |
| 1,3-propanediol, 2-phenyloxy- | |
| 1,3-propanediol, 2-(m-cresyloxy)- | |
| 1,3-propanediol, 2-(p-cresyloxy)- | |
| 1,3-propanediol, 2-benzyloxy- | |

TABLE VI-continued

| | CAS No. |
|---|---|
| 1,3-propanediol, 2-(2-phenylethyloxy)- | |
| 1,3-propanediol, 2-(1-phenylethyloxy)- | |
| Preferred Aromatic Glyceryl Ethers | |
| 1,2-propanediol, 3-phenyloxy- | |
| 1,2-propanediol, 3-benzyloxy- | |
| 1,2-propanediol, 3-(2-phenylethyloxy)- | |
| 1,3-propanediol, 3-(m-cresyloxy)- | |
| 1,3-propanediol, 2-(p-cresyloxy)- | |
| 1,3-propanediol, 2-benzyloxy- | |
| 1,3-propanediol, 2-(2-phenylethyloxy)- | |
| Preferred Aromatic Glyceryl Ethers | |
| 1,2-propanediol, 3-phenyloxy- | |
| 1,2-propanediol, 3-benzyloxy- | |
| 1,2-propanediol, 3-(2-phenylethyloxy)- | |
| 1,3-propanediol, 2-(m-cresyloxy)- | |
| 1,3-propanediol, 2-(p-cresyloxy)- | |
| 1,3-propanediol, 2-(2-phenylethyloxy)- | |

TABLE VII

ALICYCLIC DIOLS AND DERIVATIVES

| Chemical Name | CAS No. |
|---|---|
| Preferred Cylic Diols and Derivatives | |
| 1-isopropyl-1,2-cyclobutanediol | 59895-32-8 |
| 3-ethyl-4-methyl-1,2-cyclobutanediol | |
| 3-propyl-1,2-cyclobutanediol | |
| 3-isopropyl-1,2-cyclobutanediol | 42113-90-6 |
| 1-ethyl-1,2-cyclopentanediol | 67396-17-2 |
| 1,2-dimethyl-1,2-cyclopentanediol | 33046-20-7 |
| 1,4-dimethyl-1,2-cyclopentanediol | 89794-56-9 |
| 2,4,5-trimethyl-1,3-cyclopentanediol | |
| 3,3-dimethyl-1,2-cyclopentanediol | 89794-57-0 |
| 3,4-dimethyl-1,2-cyclopentanediol | 70051-69-3 |
| 3,5-dimethyl-1,2-cyclopentanediol | 89794-58-1 |
| 3-ethyl-1,2-cyclopentanediol | |
| 4,4-dimethyl-1,2-cyclopentanediol | 70197-54-5 |
| 4-ethyl-1,2-cyclopentanediol | |
| 1,1-bis(hydroxymethyl)cyclohexane | 2658-60-8 |
| 1,2-bis(hydroxymethyl)cyclohexane | 76155-27-6 |
| 1,2-dimethyl-1,3-cyclohexanediol | 53023-07-7 |
| 1,3-bis(hydroxymethyl)cyclohexane | 13022-98-5 |
| 1,3-dimethyl-1,3-cyclohexanediol | 128749-93-9 |
| 1,6-dimethyl-1,3-cyclohexanediol | 164713-16-0 |
| 1-hydroxy-cyclohexaneethanol | 40894-17-5 |
| 1-hydroxy-cyclohexanemethanol | 15753-47-6 |
| 1-ethyl-1,3-cyclohexanediol | 10601-18-0 |
| 1-methyl-1,2-cyclohexanediol | 52718-65-7 |
| 2,2-dimethyl-1,3-cyclohexanediol | 114693-83-3 |
| 2,3-dimethyl-1,4-cyclohexanediol | 70156-82-0 |
| 2,4-dimethyl-1,3-cyclohexanediol | |
| 2,5-dimethyl-1,3-cyclohexanediol | |
| 2,6-dimethyl-1,4-cyclohexanediol | 34958-42-4 |
| 2-ethyl-1,3-cyclohexanediol | 155433-88-8 |
| 2-hydroxycyclohexaneethanol | 24682-42-6 |
| 2-hydroxyethyl-1-cyclohexanol | |
| 2-hydroxymethylcyclohexanol | 89794-52-5 |
| 3-hydroxyethyl-1-cyclohexanol | |
| 3-hydroxycyclohexaneethanol | 86576-87-6 |
| 3-hydroxymethylcyclohexanol | |
| 3-methyl-1,2-cyclohexanediol | 23477-91-0 |
| 4,4-dimethyl-1,3-cyclohexanediol | 14203-50-0 |
| 4,5-dimethyl-1-3-cyclohexanediol | |
| 4,6-dimethyl-1,3-cyclohexanediol | 16066-66-3 |
| 4-ethyl-1,3-cyclohexanediol | |
| 4-hydroxyethyl-1-cyclohexanol | |
| 4-hydroxymethylcyclohexanol | 33893-85-5 |
| 4-methyl-1,2-cyclohexanediol | 23832-27-1 |
| 5,5-dimethyl-1,3-cyclohexanediol | 51335-83-2 |
| 5-ethyl-1,3-cyclohexanediol | |

TABLE VII-continued

ALICYCLIC DIOLS AND DERIVATIVES

| Chemical Name | CAS No. |
|---|---|
| 1,2-cycloheptanediol | 108268-28-6 |
| 2-methyl-1,3-cycloheptanediol | 101375-80-8 |
| 2-methyl-1,4-cycloheptanediol | |
| 4-methyl-1,3-cycloheptanediol | |
| 5-methyl-1,3-cycloheptanediol | |
| 5-methyl-1,4-cycloheptanediol | 90201-00-6 |
| 6-methyl-1,4-cycloheptanediol | |
| 1,3-cyclooctanediol | 101935-36-8 |
| 1,4-cyclooctanediol | 73982-04-4 |
| 1,5-cyclooctanediol | 23418-82-8 |
| 1,2-cyclohexanediol, diethoxylate | |
| 1,2-cyclohexanediol, triethoxylate | |
| 1,2-cyclohexanediol, tetraethoxylate | |
| 1,2-cyclohexanediol, pentaethoxylate | |
| 1,2-cyclohexanediol, hexaethoxylate | |
| 1,2-cyclohexanediol, heptaethoxylate | |
| 1,2-cyclohexanediol, octaethoxylate | |
| 1,2-cyclohexanediol, nonaethoxylate | |
| 1,2-cyclohexanediol, monopropoxylate | |
| 1,2-cyclohexanediol, monobutylenoxylate | |
| 1,2-cyclohexanediol, dibutylenoxylate | |
| 1,2-cyclohexanediol, tributylenoxylate | |
| More Preferred Cylic Diols and Derivatives | |
| 1-isopropyl-1,2-cyclobutanediol | 59895-32-8 |
| 3-ethyl-4-methyl-1,2-cyclobutanediol | |
| 3-propyl-1,2-cyclobutanediol | |
| 3-isopropyl-1,2-cyclobutanediol | 42113-90-6 |
| 1-ethyl-1,2-cyclopentanediol | 67396-17-2 |
| 1,2-dimethyl-1,2-cyclopentanediol | 33046-20-7 |
| 1,4-dimethyl-1,2-cyclopentanediol | 89794-56-9 |
| 3,3-dimethyl-1,2-cyclopentanediol | 89794-57-0 |
| 3,4-dimethyl-1,2-cyclopentanediol | 70051-69-3 |
| 3,5-dimethyl-1,2-cyclopentanediol | 89794-58-1 |
| 3-ethyl-1,2-cyclopentanediol | |
| 4,4-dimethyl-1,2-cyclopentanediol | 79197-54-5 |
| 4-ethyl-1,2-cyclopentanediol | |
| 1,1-bis(hydroxymethyl)cyclohexane | 2658-60-8 |
| 1,2-bis(hydroxymethyl)cyclohexane | 76155-27-6 |
| 1,2-dimethyl-1,3-cyclohexanediol | 53023-07-7 |
| 1,3-bis(hydroxymethyl)cyclohexane | 13022-98-5 |
| 1-hydroxy-cyclohexanemethanol | 15753-47-6 |
| 1-methyl-1,2-cyclohexanediol | 52718-65-7 |
| 3-hydroxymethylcyclohexanol | |
| 3-methyl-1,2-cyclohexanediol | 23477-91-0 |
| 4,4-dimethyl-1,3-cyclohexanediol | 14203-50-0 |
| 4,5-dimethyl-1,3-cyclohexanediol | |
| 4,6-dimethyl-1,3-cyclohexanediol | 16066-66-3 |
| 4-ethyl-1,3-cyclohexanediol | |
| 4-hydroxyethyl-1-cyclohexanol | |
| 4-hydroxymethylcyclohexanol | 33893-85-5 |
| 4-methyl-1,2-cyclohexanediol | 23832-27-1 |
| 1,2-cycloheptanediol | 108268-28-6 |
| 1,2-cyclohexanediol, pentaethoxylate | |
| 1,2-cyclohexanediol, hexaethoxylate | |
| 1,2-cyclohexanediol, heptaethoxylate | |
| 1,2-cyclohexanediol, octaethoxylate | |
| 1,2-cyclohexanediol, nonaethoxylate | |
| 1,2-cyclohexanediol, monopropoxylate | |
| 1,2-cyclohexanediol, dibutylenoxylate | |
| The unsaturated alicyclic diols include the following known unsaturated alicyclic diols: | |
| Operable Unsaturated Alicyclic Diols | |
| 1,2-Cyclobutanediol, 1-ethenyl-2-ethyl- | 58016-14-1 |
| 3-Cyclobutene-1,2-diol, 1,2,3,4-tetramethyl- | 90112-64-4 |
| 3-Cyclobutene-1,2-diol, 3,4-diethyl- | 142543-60-0 |
| 3-Cyclobutene-1,2-diol, 3-(1,1-dimethylethyl)- | 142543-56-4 |
| 3-Cyclobutene-1,2-diol, 3-butyl- | 142543-55-3 |
| 1,2-Cyclopentanediol, 1,2-dimethyl-4-methylene- | 103150-02-3 |
| 1,2-Cyclopentanediol, 1-ethyl-3-methylene- | 90314-52-6 |
| 1,2-Cyclopentanediol, 4-(1-propenyl) | 128173-45-5 |
| 3-Cyclopentene-1,2-diol, 1-ethyl-3-methyl- | 90314-43-5 |
| 1,2-Cyclohexanediol, 1-ethenyl- | 134134-16-0 |
| 1,2-Cyclohexanediol, 1-methyl-3-methylene- | 98204-78-5 |

TABLE VII-continued

| ALICYCLIC DIOLS AND DERIVATIVES | |
|---|---|
| Chemical Name | CAS No. |
| 1,2-Cyclohexanediol, 1-methyl-4-methylene- | 133358-53-9 |
| 1,2-Cyclohexanediol, 3-ethenyl- | 55310-51-5 |
| 1,2-Cyclohexanediol, 4-ethenyl- | 85905-16-4 |
| 3-Cyclohexene-1,2-diol, 2,6-dimethyl- | 81969-75-7 |
| 3-Cyclohexene-1,2-diol, 6,6-dimethyl- | 61875-93-2 |
| 4-Cyclohexene-1,2-diol, 3,6-dimethyl- | 156808-73-0 |
| 4-Cyclohexene-1,2-diol, 4,5-dimethyl- | 154351-54-9 |
| 3-Cyclooctene-1,2-diol | 170211-27-5 |
| 4-Cyclooctene-1,2-diol | 124791-61-3 |
| 5-Cyclooctene-1,2-diol | 117468-07-2 |
| Inoperable Unsaturated Cyclic Diols | |
| 1,2-Cyclopentanediol, 1-(1-methylethenyl)- | 61447-83-4 |
| 1,2-Propanediol, 1-cyclopentyl- | 55383-20-5 |
| 1,3-Cyclopentanediol, 2-(1-methylethylidene)- | 65651-46-9 |
| 1,3-Propanediol, 2-(1-cyclopenten-1-yl)- | 77192-43-9 |
| 1,3-Propanediol, 2-(2-cyclopenten-1-yl)- | 25462-31-1 |
| 1,2-Ethanediol, 1-(1-cyclohexen-1-yl)- | 151674-61-2 |
| 1,2-Ethanediol, 1-(3-cyclohexen-1-yl) | 64011-53-6 |
| 2-Cyclohexene-1,4-diol, 5,5-dimethyl- | 147274-55-3 |
| 4-Cyclohexene-1,3-diol, 3,6-dimethyl- | 127716-90-9 |
| 1,3-Cycloheptanediol, 2-methylene- | 132292-67-2 |
| 5-Cycloheptene-1,3-diol, 1-methyl- | 160813-33-2 |
| 5-Cycloheptene-1,3-diol, 5-methyl- | 160813-32-1 |
| 2-Cyclooctene-1,4-diol | 37996-40-0 |

TABLE VIII $C_3H_7$DIOL ALKOXYLATED DERIVATIVES

In the following tables, "EO" means polyethoxylates, i.e., —$(CH_2CH_2O)_nH$; Me—$E_n$ means methyl-capped polyethoxylates —$(CH_2CH_2O)_nCH_3$;
"2(Me—En)" means 2 Me—En groups needed;
"PO" means polypropoxylates, —$(CH(CH_3)CH_2O)_nH$;
"BO" means polybutyleneoxy groups, $(CH(CH_2CH_3)CH_2O)_nH$;
and "n-BO" means poly(n-butyleneoxy) or poly(tetramethylene)oxy groups —$(CH_2CH_2CH_2CH_2O)_nH$. The indicated alkoxylated derivatives are all operable and those that are preferred are in bold type and listed on the second line. Non-limiting, typical synthesis methods to prepare the alkoxylated derivatives are given hereinafter.

TABLE VIIIA

| Base Material[a] | Base Material CAS No. | EO's (b) | 1(Me—En) (c) | 2(Me—En) (d) | PO's (e) | n-BO's (f) | BO's (g) |
|---|---|---|---|---|---|---|---|
| 1,2-propanediol (C3) | 57-55-6 | | | 1–4 | | | |
| | | | | **3–4** | **4** | | |
| 1,2-propanediol, | 558-43-0 | | 4–10 | | | | 1 |
| 2-methyl-(C4) | | | **8–10** | **1** | **3** | | |
| 1,3-propanediol (C3) | 504-63-2 | | | 6–8 | 5–6 | | |
| | | | | **8** | **6** | | |
| 1,3-propanediol, | 115-76-4 | 1–7 | | | | 1–2 | |
| 2,2-diethyl-(C7) | | **4–7** | | | **1** | **2** | |
| 1,3-propanediol, | 126-30-7 | | | | 3–4 | | |
| 2,2-dimethyl-(C5) | | | | **1–2** | **4** | | |
| 1,3-propanediol, 2- | 33673-01-7 | 1–7 | | | | 1–2 | |
| (1-methylpropyl)-(C7) | | **4–7** | | | **1** | **2** | |
| 1,3-propanediol, 2- | 26462-20-8 | 1–7 | | | | 1–2 | |
| (2-methylpropyl)-(C7) | | **4–7** | | | **1** | **2** | |
| 1,3-propanediol, | 2612-29-5 | | 6–10 | | | | |
| 2-ethyl-(C5) | | | **9–10** | **1** | **3** | | |
| 1,3-propanediol, 2- | 77-84-9 | | 1–6 | | | | |
| ethyl-2-methyl-(C6) | | | **3–6** | | **2** | | **1** |
| 1,3-propanediol, | 2612-27-3 | | 1–6 | | | | |
| 2-isopropyl-(C6) | | | **3–6** | | **2** | | 1 |
| 1,3-propanediol, | 2163-42-0 | | | 2–5 | 4–5 | | |
| 2-methyl-(C4) | | | | **4–5** | **5** | | **2** |
| 1,3-propanediol, 2- | 2109-23-1 | 2–9 | | | | 1–3 | |
| methyl-2-isopropyl- | | **6–9** | | | **1** | **2–3** | |
| (C7) | | | | | | | |
| 1,3-propanediol, 2- | 78-26-2 | 1–7 | | | | 1–2 | |
| methyl-2-propyl-(C7) | | **4–7** | | | **1** | **2** | |

TABLE VIIIA-continued

| Base Material[a] | Base Material CAS No. | EO's (b) | 1(Me—En) (c) | 2(Me—En) (d) | PO's (e) | n-BO's (f) | BO's (g) |
|---|---|---|---|---|---|---|---|
| 1,3-propanediol, | 2612-28-4 | | | | | | 1 |
| 2-propyl-(C6) | | | **1–4** | | **2** | | |

[a]The number of indicated alkoxylated groups in this and following Tables VIII are all operable, the generic limits being listed on the first line, and those that are preferred are in bold type and listed on the second line.
(b) The numbers in this column are average numbers of ($CH_2CH_2O$) groups in the polyethoxylated derivative.
(c) The numbers in this column are average numbers of ($CH_2CH_2O$) groups in the one methyl-capped polyethoxylate substituant in each derivative.
(d) The numbers in this column are average numbers of ($CH_2CH_2O$) groups in each of the two methyl-capped polyethoxylate substituants in each derivative.
(e) The numbers in this column are average numbers of ($CH(CH_3)CH_2O$) groups in the polypropoxylated derivative.
(f) The numbers in this column are average numbers of ($CH_2CH_2CH_2CH_2O$) groups in the polytetramethyleneoxylated derivative.
(g) The numbers in this column are average numbers of ($CH(CH_2CH_3)CH_2O$) groups in the polybutoxylated derivative.

TABLE VIIIB

| Base Material[a] | Base Material CAS No. | EO's (b) | 1(Me—En) (c) | 2(Me—En) (d) | PO's (e) | n-BO's (f) | BO's (g) |
|---|---|---|---|---|---|---|---|
| 1,2-butanediol (C4) | 584-03-2 | | 2–8 | | | | |
| | | | **6–8** | | **2–3** | | **1** |
| 1,2-butanediol, | 66553-15-9 | 1–6 | | | | 1–2 | |
| 2,3-dimethyl-(C6) | | **2–5** | | | | **1** | |
| 1,2-butanediol, | 66553-16-0 | | | | | | |
| 2-ethyl-(C6) | | **1–3** | | | | **1** | |
| 1,2-butanediol, | 41051-72-3 | | | | | | |
| 2-methyl-(C5) | | | **1–2** | | **1** | | |
| 1,2-butanediol, | 59562-82-2 | 1–6 | | | | 1–2 | |
| 3,3-dimethyl-(C6) | | **2–5** | | | | **1** | |
| 1,2-butanediol, | 50468-22-9 | | | | | | |
| 3-methyl-(C5) | | | **1–2** | | **1** | | |
| 1,3-butanediol (C4) | 107-88-0 | | | 3–6 | 5 | | |
| | | | | **5–6** | | | **2** |
| 1,3-butanediol, | 16343-75-2 | | | | 1–2 | | |
| 2,2,3-trimethyl-(C7) | | | **1–3** | | **2** | | |
| 1,3-butanediol, | 76-35-7 | | 3–8 | | | | |
| 2,2-dimethyl-(C6) | | | **6–8** | | 3 | | |
| 1,3-butanediol, | 24893-35-4 | | 3–8 | | | | |
| 2,3-dimethyl-(C6) | | | **6–8** | | 3 | | |
| 1,3-butanediol, | 66553-17-1 | | 1–6 | | | | |
| 2-ethyl-(C6) | | | **4–6** | | **2 to 3** | | **1** |
| 1,3-butanediol, 2- | Method C | | | | | 2–4 | |
| ethyl-2-methyl-(C7) | | | **1** | | **1** | **3** | |
| 1,3-butanediol, 2- | 68799-03-1 | | | | | 2–4 | |
| ethyl-3-methyl-(C7) | | | **1** | | **1** | **3** | |
| 1,3-butanediol, | 66567-04-2 | | | | | 2–4 | |
| 2-isopropyl-(C7) | | | **1** | | **1** | **3** | |
| 1,3-butanediol, | 684-84-4 | | | 1–3 | | | |
| 2-methyl-(C5) | | | | **2–3** | 4 | | |
| 1,3-butanediol, | 66567-03-1 | 2–9 | | | | 1–3 | |
| 2-propyl-(C7) | | **6–8** | | | **1** | **2–3** | |
| 1,3-butanediol, | 2568-33-4 | | | 1–3 | | | |
| 3-methyl-(C5) | | | | **2–3** | 4 | | |
| 1,4-butanediol (C4) | 110-63-4 | | | 2–4 | 4–5 | 2 | |
| | | | | **3–4** | **4–5** | | |
| 1,4-butanediol, 2, | 162108-60-3 | 2–9 | | | | 1–3 | |
| 2,3-trimethyl-(C7) | | **6–9** | | | **1** | **2–3** | |
| 1,4-butanediol, | 32812-23-0 | | 1–6 | | | | |
| 2,2-dimethyl-(C6) | | | **3–6** | | **2** | | **1** |
| 1,4-butanediol, | 57716-80-0 | | 1–6 | | | | |
| 2-3-dimethyl-(C6) | | | **3–6** | | **2** | | **1** |
| 1,4-butanediol, | 57716-79-7 | | | | | | 1 |
| 2-ethyl-(C6) | | | **1–4** | | **2** | | |
| 1,4-butanediol, 2- | 76651-98-4 | 1–7 | | | | 1–2 | |
| ethyl-2-methyl-(C7) | | **4–7** | | | **1** | **2** | |
| 1,4-butanediol, 2- | 66225-34-1 | 1–7 | | | | 1–2 | |
| ethyl-3-methyl-(C7) | | **4–7** | | | **1** | **2** | |
| 1,4-butanediol, | 39497-66-0 | 1–7 | | | | 1–2 | |

TABLE VIIIB-continued

| Base Material[a] | Base Material CAS No. | EO's (b) | 1(Me—En) (c) | 2(Me—En) (d) | PO's (e) | n-BO's (f) | BO's (g) |
|---|---|---|---|---|---|---|---|
| 2-isopropyl-(C7) | | **4–7** | | | **1** | **2** | |
| 1,4-butanediol, | 2938-98-9 | | 6–10 | | | | |
| 2-methyl-(C5) | | | **9–10** | **1** | **3** | | |
| 1,4-butanediol, | 62946-68-3 | 1–5 | | | | 1–2 | |
| 2-propyl-(C7) | | **2–5** | | | | **1** | |
| 1,4-butanediol, 3- | Method F | 2–9 | | | | 1–3 | |
| ethyl-1-methyl-(C7) | | **6–8** | | | **1** | **2–3** | |
| 2,3-butanediol (C4) | 513-85-9 | | 6–10 | | | | 1 |
| | | | **9–10** | **1** | **3–4** | | |
| 2,3-butanediol, | 76-09-5 | 3–9 | | | | 1–3 | |
| 2,3-dimethyl-(C6) | | **7–9** | | | **1** | **2–3** | |
| 2,3-butanediol, | 5396-58-7 | | 1–5 | | | | |
| 2-methyl-(C5) | | | **2–5** | | **2** | | **1** |

[a]The number of indicated alkoxylated groups in this Table are all operable, the generic limits being listed on the first line, and those that are preferred are in bold type and listed on the second line.
(b) The numbers in this column are average numbers of ($CH_2CH_2O$) groups in the polyethoxylated derivative.
(c) The numbers in this column are average numbers of ($CH_2CH_2O$) groups in the one methyl-capped polyethoxylate substituant in each derivative.
(d) The numbers in this column are average numbers of ($CH_2CH_2O$) groups in each of the two methyl-capped polyethoxylate substituants in each derivative.
(e) The numbers in this column are average numbers of ($CH(CH_3)CH_2O$) groups in the polypropoxylated derivative.
(f) The numbers in this column are average numbers of ($CH_2CH_2CH_2CH_2O$) groups in the polytetramethyleneoxylated derivative.
(g) The numbers in this column are average numbers of ($CH(CH_2CH_3)CH_2O$) groups in the polybutoxylated derivative.

TABLE VIIIC

| Base Material[a] | Base Material CAS No. | EO's (b) | 1(Me—En) (c) | 2(Me—En) (d) | PO's (e) | n-BO's (f) | BO's (g) |
|---|---|---|---|---|---|---|---|
| 1,2-pentanediol | 5343-92-0 | 3–10 | | | | 2–3 | |
| (C5) | | **7–10** | | | **1** | **3** | |
| 1,2-pentanediol, | 20667-05-4 | | | | | | |
| 2-methyl-(C6) | | **1–3** | | | | **1** | |
| 1,2-pentanediol, | 159623-53-7 | | | | | | |
| 3-methyl-(C6) | | **1–3** | | | | **1** | |
| 1,2-pentanediol, | 72110-08-8 | | | | | | |
| 4-methyl-(C6) | | **1–3** | | | | **1** | |
| 1,3-pentanediol | 3174-67-2 | | | | | | |
| (C5) | | | | **1–2** | **3–4** | | |
| 1,3-pentanediol, | 2157-31-5 | 2–4 | | | | 2–4 | |
| 2,2-dimethyl-(C7) | | | **1** | | **1** | **3** | |
| 1,3-pentanediol, | 66225-52-3 | | | | | 2–4 | |
| 2,3-dimethyl-(C7) | | | **1** | | **1** | **3** | |
| 1,3-pentanediol, | 60712-38-1 | | | | | 2–4 | |
| 2,4-dimethyl-(C7) | | | **1** | | **1** | **3** | |
| 1,3-pentanediol, | 29887-11-4 | 2–9 | | | | | 1–3 |
| 2-ethyl-(C7) | | **6–8** | | | **1** | **2–3** | |
| 1,3-pentanediol, | 149-31-5 | | 1–6 | | | | 1 |
| 2-methyl-(C6) | | | **4–6** | | **2–3** | | |
| 1,3-pentanediol, | 129851-50-9 | | | | | 2–4 | |
| 3,4-dimethyl-(C7) | | | **1** | | **1** | **3** | |
| 1,3-pentanediol, | 33879-72-0 | | 1–6 | | | | 1 |
| 3-methyl-(C6) | | | **4–6** | | **2–3** | | |
| 1,3-pentanediol, | 30458-16-3 | | | | | 2–4 | |
| 4,4-dimethyl-(C7) | | | **1** | | **1** | **3** | |
| 1,3-pentanediol, | 54876-99-2 | | 1–6 | | | | 1 |
| 4-methyl-(C6) | | | **4–6** | | **2–3** | | |
| 1,4-pentanediol | 626-95-9 | | | | | | |
| (C5) | | | | **1–2** | **3–4** | | |
| 1,4-pentanediol, | Method F | | | | | 2–4 | |
| 2,2-dimethyl-(C7) | | | **1** | | **1** | **3** | |
| 1,4-pentanediol, | Method F | | | | | 2–4 | |
| 2,3-dimethyl-(C7) | | | **1** | | **1** | **3** | |
| 1,4-pentanediol, | Method F | | | | | 2–4 | |
| 2,4-dimethyl-(C7) | | | 1 | | **1** | **3** | |
| 1,4-pentanediol, | 6287-17-8 | | 1–6 | | | | 1 |
| 2-methyl-(C6) | | | **4–6** | | **2–3** | | |
| 1,4-pentanediol, | 81887-62-9 | | | | | 2–4 | |

TABLE VIIIC-continued

| Base Material[a] | Base Material CAS No. | EO's (b) | 1(Me—En) (c) | 2(Me—En) (d) | PO's (e) | n-BO's (f) | BO's (g) |
|---|---|---|---|---|---|---|---|
| 3,3-dimethyl-(C7) | | | **1** | | **1** | **3** | |
| 1,4-pentanediol, | 63521-36-8 | | | | | 2–4 | |
| 3,4-dimethyl-(C7) | | | **1** | | **1** | **3** | |
| 1,4-pentanediol, | 26787-63-3 | | 1–6 | | | | 1 |
| 3-methyl-(C6) | | | **4–6** | | **2–3** | | |
| 1,4-pentanediol, | 1462-10-8 | | 1–6 | | | | 1 |
| 4-methyl-(C6) | | | **4–6** | | **2–3** | | |
| 1,5-pentanediol | 111-29-5 | | 4–10 | | | | |
| (C5) | | | **8–10** | **1** | **3** | | |
| 1,5-pentanediol, | 3121-82-2 | 1–7 | | | | 1–2 | |
| 2,2-dimethyl-(C7) | | **4–7** | | | **1** | **2** | |
| 1,5-pentanediol, | 81554-20-3 | 1–7 | | | | 1–2 | |
| 2,3-dimethyl-(C7) | | **4–7** | | | **1** | **2** | |
| 1,5-pentanediol, | 2121-69-9 | 1–7 | | | | 1–2 | |
| 2,4-dimethyl-(C7) | | **4–7** | | | **1** | **2** | |
| 1,5-pentanediol, | 14189-13-0 | 1–5 | | | | 1–2 | |
| 2-ethyl-(C7) | | **2–5** | | | | **1** | |
| 1,5-pentanediol, | 42856-62-2 | | | | | | |
| 2-methyl-(C6) | | | **1–4** | | **2** | | |
| 1,5-pentanediol, | 53120-74-4 | 1–7 | | | | 1–2 | |
| 3,3-dimethyl-(C7) | | **4–7** | | | **1** | **2** | |
| 1,5-pentanediol, | 4457-71-0 | | | | | | |
| 3-methyl-(C6) | | | **1–4** | | **2** | | |
| 2,3-pentanediol | 42027-23-6 | | | | | | |
| (C5) | | | **1–3** | | **2** | | |
| 2,3-pentanediol, | 7795-80-4 | 1–7 | | | | 1–2 | |
| 2-methyl-(C6) | | **4–7** | | | **1** | **2** | |
| 2,3-pentanediol, | 63521-37-9 | 1–7 | | | | 1–2 | |
| 3-methyl-(C6) | | **4–7** | | | **1** | **2** | |
| 2,3-pentanediol, | 7795-79-1 | 1–7 | | | | 1–2 | |
| 4-methyl-(C6) | | **4–7** | | | **1** | **2** | |
| 2,4-pentanediol | 625-69-4 | | | 1–4 | | | |
| (C5) | | | | **2–4** | **4** | | |
| 2,4-pentanediol, | 24893-39-8 | | 1–4 | | | | |
| 2,3-dimethyl-(C7) | | | **2–4** | **2** | | | |
| 2,4-pentanediol, | 24892-49-7 | | 1–4 | | | | |
| 2,4-dimethyl-(C7) | | | **2–4** | | **2** | | |
| 2,4-pentanediol, | 107-41-5 | | 5–10 | | | | |
| 2-methyl-(C6) | | | **8–10** | | **3** | | |
| 2,4-pentanediol, | 24892-50-0 | | 1–4 | | | | |
| 3,3-dimethyl-(C7) | | | **2–4** | | **2** | | |
| 2,4-pentanediol, | Method H | | 5–10 | | | | |
| 3-methyl-(C6) | | | **8–10** | | **3** | | |

[a]The number of indicated alkoxylated groups in this Table are all operable, the generic limits being listed on the first line, and those that are preferred are in bold type and listed on the second line.
(b) The numbers in this column are average numbers of ($CH_2CH_2O$) groups in the polyethoxylated derivative.
(c) The numbers in this column are average numbers of ($CH_2CH_2O$) groups in the one methyl-capped polyethoxylate substituant in each derivative.
(d) The numbers in this column are average numbers of ($CH_2CH_2O$) groups in each of the two methyl-capped polyethoxylate substituants in each derivative.
(e) The numbers in this column are average numbers of ($CH(CH_3)CH_2O$) groups in the polypropoxylated derivative.
(f) The numbers in this column are average numbers of ($CH_2CH_2CH_2CH_2O$) groups in the polytetramethyleneoxylated derivative.
(g) The numbers in this column are average numbers of ($CH(CH_2CH_3)CH_2O$) groups in the polybutoxylated derivative.

TABLE VIIID

| Base Material[a] | Base Material CAS No. | EO's (b) | 1(Me—En) (c) | PO's (e) | n-BO's (f) (g) | BO's |
|---|---|---|---|---|---|---|
| 1,3-hexanediol (C6) | 21531-91-9 | | 1–5 | | | |
| | | | **2–5** | **2** | | **1** |
| 1,3-hexanediol, 2-methyl- | 66072-21-7 | 2–9 | | | 1–3 | 1 |
| (C7) | | **6–8** | | **1** | **2–3** | |
| 1,3-hexanediol, 3-methyl- | Method D | 2–9 | | | 1–3 | |
| (C7) | | **6–8** | | **1** | **2–3** | |
| 1,3-hexanediol, 4-methyl- | Method C | 2–9 | | | 1–3 | |
| (C7) | | **6–8** | | **1** | **2–3** | |
| 1,3-hexanediol, 5-methyl- | 109863-14-1 | 2–9 | | | 1–3 | |

TABLE VIIID-continued

| Base Material[a] | Base Material CAS No. | EO's (b) | 1(Me—En) (c) | PO's (e) | n-BO's (f) (g) | BO's |
|---|---|---|---|---|---|---|
| (C7) | | **6–8** | | 1 | **2–3** | |
| 1,4-hexanediol (C6) | 16432-53-4 | | 1–5 | | | |
| | | | **2–5** | 2 | | 1 |
| 1,4-hexanediol, 2-methyl- | Method F | 2–9 | | | 1–3 | |
| (C7) | | **6–8** | | 1 | **2–3** | |
| 1,4-hexanediol, 3-methyl- | 66225-36-3 | 2–9 | | | 1–3 | |
| (C7) | | **6–8** | | 1 | **2–3** | |
| 1,4-hexanediol, 4-methyl- | 40646-08-0 | 2–9 | | | 1–3 | |
| (C7) | | **6–8** | | 1 | **2–3** | |
| 1,4-hexanediol, 5-methyl- | 38624-36-1 | 2–9 | | | 1–3 | |
| (C7) | | **6–8** | | 1 | **2–3** | |
| 1,5-hexanediol (C6) | 928-40-5 | | 1–5 | | | |
| | | | **2–5** | 2 | | 1 |
| 1,5-hexanediol, 2-methyl- | Method F | 2–9 | | | 1–3 | |
| (C7) | | **6–8** | | 1 | **2–3** | |
| 1,5-hexanediol, 3-methyl- | Method F | 2–9 | | | 1–3 | |
| (C7) | | **6–8** | | 1 | **2–3** | |
| 1,5-hexanediol, 4-methyl- | 66225-37-4 | 2–9 | | | 1–3 | |
| (C7) | | **6–8** | | 1 | **2–3** | |
| 1,5-hexanediol, 5-methyl- | 1462-11-9 | 2–9 | | | 1–3 | |
| (C7) | | **6–8** | | 1 | **2–3** | |
| 1,6-hexanediol (C6) | 629-11-8 | | | | | |
| | | | **1–2** | **1–2** | **4** | |
| 1,6-hexanediol, 2-methyl- | 25258-92-8 | 1–5 | | | 1–2 | |
| (C7) | | **2–5** | | | **1** | |
| 1,6-hexanediol, 3-methyl- | 4089-71-8 | 1–5 | | | 1–2 | |
| (C7) | | **2–5** | | | **1** | |
| 2,3-hexanediol (C6) | 617-30-1 | 1–5 | | | 1–2 | |
| | | **2–5** | | | 1 | |
| 2,4-hexanediol (C6) | 19780-90-6 | | 3–8 | | | |
| | | | **5–8** | 3 | | |
| 2,4-hexanediol, 2-methyl- | 66225-35-2 | | | | | |
| (C7) | | | **1–2** | **1–2** | | |
| 2,4-hexanediol, 3-methyl- | 116530-79-1 | | | | | |
| (C7) | | | **1–2** | **1–2** | | |
| 2,4-hexanediol, 4-methyl- | 38836-25-8 | | | | | |
| (C7) | | | **1–2** | **1–2** | | |
| 2,4-hexanediol, 5-methyl- | 54877-00-8 | | | | | |
| (C7) | | | **1–2** | **1–2** | | |
| 2,5-hexanediol (C6) | 2935-44-6 | | 3–8 | | | |
| | | | **5–8** | 3 | | |
| 2,5-hexanediol, 2-methyl- | 29044-06-2 | | | | | |
| (C7) | | | **1–2** | **1–2** | | |
| 2,5-hexanediol, 3-methyl- | Method H | | | | | |
| (C7) | | | **1–2** | **1–2** | | |
| 3,4-hexanediol (C6) | 922-17-8 | 1–5 | | | | |
| | | **2–5** | | | **1** | |

[a]The number of indicated alkoxylated groups in this Table are all operable, the generic limits being listed on the first line, and those that are preferred are in bold type and listed on the second line.
(b) The numbers in this column are average numbers of ($CH_2CH_2O$) groups in the polyethoxylated derivative.
(c) The numbers in this column are average numbers of ($CH_2CH_2O$) groups in the one methyl-capped polyethoxylate substituant in each derivative.
(e) The numbers in this column are average numbers of ($CH(CH_3)CH_2O$) groups in the polypropoxylated derivative.
(f) The numbers in this column are average numbers of ($CH_2CH_2CH_2CH_2O$) groups in the polytetramethyleneoxylated derivative.
(g) The numbers in this column are average numbers of ($CH(CH_2CH_3)CH_2O$) groups in the polybutoxylated derivative.

TABLE VIIIE

| Base Material[a] | Base Material CAS No. | EO's (b) | 1(Me—En) (c) | PO's (e) | n-BO's (f) |
|---|---|---|---|---|---|
| 1,3-heptanediol (C7) | 23433-04-7 | 1–7 | | | 1–2 |
| | | **3–6** | | **1** | **2** |
| 1,4-heptanediol (C7) | 40646-07-9 | 1–7 | | | 1–2 |
| | | **3–6** | | **1** | **2** |
| 1,5-heptanediol (C7) | 60096-09-5 | 1–7 | | | 1–2 |
| | | **3–6** | | **1** | **2** |
| 1,6-heptanediol (C7) | 13175-27-4 | 1–7 | | | 1–2 |

TABLE VIIIE-continued

| Base Material[a] | Base Material CAS No. | EO's (b) | 1(Me—En) (c) | PO's (e) | n-BO's (f) |
|---|---|---|---|---|---|
| | | **3–6** | | **1** | **2** |
| 1,7-heptanediol (C7) | 629-30-1 | | | | |
| | | **1–2** | | | **1** |
| 2,4-heptanediol (C7) | 20748-86-1 | 3–10 | | | |
| | | **7–10** | **1** | **1** | **3** |
| 2,5-heptanediol (C7) | 70444-25-6 | 3–10 | | | |
| | | **7–10** | **1** | **1** | **3** |

TABLE VIIIE-continued

| Base Material[a] | Base Material CAS No. | EO's (b) | 1(Me—En) (c) | PO's (e) | n-BO's (f) |
|---|---|---|---|---|---|
| 2,6-heptanediol (C7) | 5969-12-0 | 3–10 | | | |
| | | **7–10** | **1** | **1** | **3** |
| 3,5-heptanediol (C7) | 86632-40-8 | 3–10 | | | |
| | | **7–10** | **1** | **1** | **3** |

[a]The number of indicated alkoxylated groups in this Table are all operable, the generic limits being listed on the first line, and those that are preferred are in bold type and listed on the second line.
(b) The numbers in this column are average numbers of ($CH_2CH_2O$) groups in the polyethoxylated derivative.
(c) The numbers in this column are average numbers of ($CH_2CH_2O$) groups in the one methyl-capped polyethoxylate substituant in each derivative.
(e) The numbers in this column are average numbers of ($CH(CH_3)CH_2O$) groups in the polypropoxylated derivative.
(f) The numbers in this column are average numbers of ($CH_2CH_2CH_2CH_2O$) groups in the polytetramethyleneoxylated derivative.

TABLE IX

AROMATIC DIOLS

Suitable aromatic diols include:

| Chemical Name | CAS No. |
|---|---|
| Operable Aromatic Diols | |
| 1-phenyl-1,2-ethanediol | 93-56-1 |
| 1-phenyl-1,2-propanediol | 1855-09-0 |
| 2-phenyl-1,2-propanediol | 87760-50-7 |
| 3-phenyl-1,2-propanediol | 17131-14-5 |
| 1-(3-methylphenyl)-1,3-propanediol | 51699-43-5 |
| 1-(4-methylphenyl)-1,3-propanediol | 159266-06-5 |
| 2-methyl-1-phenyl-1,3-propanediol | 139068-60-3 |
| 1-phenyl-1,3-butanediol | 118100-60-0 |
| 3-phenyl-1,3-butanediol | 68330-54-1 |
| 1-phenyl-1,4-butanediol | 136173-88-1 |
| 2-phenyl-1,4-butanediol | 95840-73-6 |
| 1-phenyl-2,3-butanediol | 169437-68-7 |
| Preferred Aromatic Diols | |
| 1-phenyl-1,2-ethanediol | 93-56-1 |
| 1-phenyl-1,2-propanediol | 1855-09-0 |
| 2-phenyl-1,2-propanediol | 87760-50-7 |
| 3-phenyl-1,2-propanediol | 17131-14-5 |
| 1-(3-methylphenyl)-1,3-propanediol | 51699-43-5 |
| 1-(4-methylphenyl)-1,3-propanediol | 159266-06-5 |
| 2-methyl-1-phenyl-1,3-propanediol | 139068-60-3 |
| 1-phenyl-1,3-butanediol | 118100-60-0 |
| 3-phenyl-1,3-butanediol | 68330-54-1 |
| 1-phenyl-1,4-butanediol | 136173-88-1 |
| More Preferred Aromatic Diols | |
| 1-phenyl-1,2-propanediol | 1855-09-0 |
| 2-phenyl-1,2-propanediol | 87760-50-7 |
| 3-phenyl-1,2-propanediol | 17131-14-5 |
| 1-(3-methylphenyl)-1,3-propanediol | 51699-43-5 |
| 1-(4-methylphenyl)-1,3-propanediol | 159266-06-5 |
| 2-methyl-1-phenyl-1,3-propanediol | 139068-60-3 |
| 3-phenyl-1,3-butanediol | 68330-54-1 |
| 1-phenyl-1,4-butanediol | 136173-88-1 |
| Inoperable Aromatic Diols | |
| 1-phenyl-1,3-propanediol | |
| 2-phenyl-1,3-propanediol | |
| 1-phenyl-1,2-butanediol | 154902-08-6 |
| 2-phenyl-1,2-butanediol | 157008-55-4 |
| 3-phenyl-1,2-butanediol | 141505-72-8 |
| 4-phenyl-1,2-butanediol | 143615-31-0 |
| 2-phenyl-1,3-butanediol | 103941-94-2 |
| 4-phenyl-1,3-butanediol | 81096-91-5 |
| 2-phenyl-2,3-butanediol | 138432-94-7 |

X. principal solvents which are homologs, or analogs, of the above structures where the total number of hydrogen atoms is increased by the addition of one, or more additional $CH_2$ groups, the total number of hydrogen atoms being kept at the same number by introducing double bonds, are also useful with examples including the following known compounds:

TABLE X

EXAMPLES OF UNSATURATED COMPOUNDS

| Operable Unsaturated Diols | |
|---|---|
| 1,3-Propanediol, 2,2-di-2-propenyl- | 55038-13-6 |
| 1,3-Propanediol, 2-(1-pentenyl)- | 138436-18-7 |
| 1,3-Propanediol, 2-(2-methyl-2-propenyl)-2-(2-propenyl) | 121887-76-1 |
| 1,3-Propanediol, 2-(3-methyl-1-butenyl)- | 138436-17-6 |
| 1,3-Propanediol, 2-(4-pentenyl)- | 73012-46-1 |
| 1,3-Propanediol, 2-ethyl-2-(2-methyl-2-propenyl)- | 91367-61-2 |
| 1,3-Propanediol, 2-ethyl-2-(2-propenyl)- | 27606-26-4 |
| 1,3-Propanediol, 2-methyl-2-(3-methyl-3-butenyl)- | 132130-95-1 |
| 1,3-Butanediol, 2,2-diallyl- | 103985-49-5 |
| 1,3-Butanediol, 2-(1-ethyl-1-propenyl)- | 116103-35-6 |
| 1,3-Butanediol, 2-(2-butenyl)-2-methyl)- | 92207-83-5 |
| 1,3-Butanediol, 2-(3-methyl-2-butenyl)- | 98955-19-2 |
| 1,3-Butanediol, 2-ethyl-2-(2-propenyl)- | 122761-93-7 |
| 1,3-Butanediol, 2-methyl-2-(1-methyl-2-propenyl)- | 141585-58-2 |
| 1,4-Butanediol, 2,3-bis(1-methylethylidene)- | 52127-63-6 |
| 1,4-Butanediol, 2-(3-methyl-2-butenyl)-3-methylene- | 115895-78-8 |
| 2-Butene-1,4-diol, 2-(1,1-dimethylpropyl)- | 91154-01-7 |
| 2-Butene-1,4-diol, 2-(1-methylpropyl)- | 91154-00-6 |
| 2-Butene-1,4-diol, 2-butyl- | 153943-66-9 |
| 1,3-Pentanediol, 2-ethenyl-3-ethyl- | 104683-37-6 |
| 1,3-Pentanediol, 2-ethenyl-4,4-dimethyl- | 143447-08-9 |
| 1,4-Pentanediol, 3-methyl-2-(2-propenyl)- | 139301-86-3 |
| 1,5-Pentanediol, 2-(1-propenyl)- | 84143-44-2 |
| 1,5-Pentanediol, 2-(2-propenyl)- | 134757-01-0 |
| 1,5-Pentanediol, 2-ethylidene-3-methyl- | 42178-93-8 |
| 1,5-Pentanediol, 2-propylidene- | 58203-50-2 |
| 2,4-Pentanediol, 3-ethylidene-2,4-dimethyl- | 88610-19-9 |
| 4-Pentene-1,3-diol, 2-(1,1-dimethylethyl)- | 109788-04-7 |
| 4-Pentene-1,3-diol, 2-ethyl-2,3-dimethyl- | 90676-97-4 |
| 1,4-Hexanediol, 4-ethyl-2-methylene- | 66950-87-6 |
| 1,5-Hexadiene-3,4-diol, 2,3,5-trimethyl- | 18984-03-7 |
| 1,5-Hexadiene-3,4-diol, 5-ethyl-3-methyl- | 18927-12-3 |
| 1,5-Hexanediol, 2-(1-methylethenyl)- | 96802-18-5 |
| 1,6-Hexanediol, 2-ethenyl- | 66747-31-7 |
| 1-Hexene-3,4-diol, 5,5-dimethyl- | 169736-29-2 |
| 1-Hexene-3,4-diol, 5,5-dimethyl- | 120191-04-0 |
| 2-Hexene-1,5-diol, 4-ethenyl-2,5-dimethyl- | 70101-76-7 |
| 3-Hexene-1,6-diol, 2-ethenyl-2,5-dimethyl- | 112763-52-7 |
| 3-Hexene-1,6-diol, 2-ethyl- | 84143-45-3 |
| 3-Hexene-1,6-diol, 3,4-dimethyl- | 125032-66-8 |
| 4-Hexene-2,3-diol, 2,5-dimethyl- | 13295-61-9 |
| 4-Hexene-2,3-diol, 3,4-dimethyl- | 135367-17-8 |
| 5-Hexene-1,3-diol, 3-(2-propenyl)- | 74693-24-6 |
| 5-Hexene-2,3-diol, 2,3-dimethyl- | 154386-00-2 |
| 5-Hexene-2,3-diol, 3,4-dimethyl- | 135096-13-8 |
| 5-Hexene-2,3-diol, 3,5-dimethyl- | 134626-63-4 |
| 5-Hexene-2,4-diol, 3-ethenyl-2,5-dimethyl- | 155751-24-9 |
| 1,4-Heptanediol, 6-methyl-5-methylene- | 100590-29-2 |
| 1,5-Heptadiene-3,4-diol, 2,3-dimethyl- | 18927-06-5 |
| 1,5-Heptadiene-3,4-diol, 2,5-dimethyl- | 22607-16-5 |
| 1,5-Heptadiene-3,4-diol, 3,5-dimethyl- | 18938-51-7 |
| 1,7-Heptanediol, 2,6-bis(methylene)- | 139618-24-9 |
| 1,7-Heptanediol, 4-methylene- | 71370-08-6 |
| 1-Heptene-3,5-diol, 2,4-dimethyl- | 155932-77-7 |
| 1-Heptene-3,5-diol, 2,6-dimethyl- | 132157-35-8 |
| 1-Heptene-3,5-diol, 3-ethenyl-5-methyl | 61841-10-9 |
| 1-Heptene-3,5-diol, 6,6-dimethyl- | 109788-01-4 |
| 2,4-Heptadiene-2,6-diol, 4,6-dimethyl- | 102605-95-8 |
| 2,5-Heptadiene-1,7-diol, 4,4-dimethyl- | 162816-19-5 |
| 2,6-Heptadiene-1,4-diol, 2,5,5-trimethyl- | 115346-30-0 |
| 2-Heptene-1,4-diol, 5,6-dimethyl- | 103867-76-1 |
| 2-Heptene-1,5-diol, 5-ethyl- | 104683-39-8 |
| 2-Heptene-1,7-diol, 2-methyl- | 74868-68-1 |
| 3-Heptene-1,5-diol, 4,6-dimethyl- | 147028-45-3 |
| 3-Heptene-1,7-diol, 3-methyl-6-methylene- | 109750-55-2 |
| 3-Heptene-2,5-diol, 2,4-dimethyl- | 98955-40-9 |
| 3-Heptene-2,5-diol, 2,5-dimethyl- | 24459-23-2 |

TABLE X-continued

| EXAMPLES OF UNSATURATED COMPOUNDS | |
|---|---|
| 3-Heptene-2,6-diol, 2,6-dimethyl- | 160524-66-3 |
| 3-Heptene-2,6-diol, 4,6-dimethyl- | 59502-66-8 |
| 5-Heptene-1,3-diol, 2,4-dimethyl- | 123363-69-9 |
| 5-Heptene-1,3-diol, 3,6-dimethyl- | 96924-52-6 |
| 5-Heptene-1,4-diol, 2,6-dimethyl- | 106777-98-4 |
| 5-Heptene-1,4-diol, 3,6-dimethyl- | 106777-99-5 |
| 5-Heptene-2,4-diol, 2,3-dimethyl- | 104651-56-1 |
| 6-Heptene-1,3-diol, 2,2-dimethyl- | 140192-39-8 |
| 6-Heptene-1,4-diol, 4-(2-propenyl)- | 1727-87-3 |
| 6-Heptene-1,4-diol, 5,6-dimethyl- | 152344-16-6 |
| 6-Heptene-1,5-diol, 2,4-dimethyl- | 74231-27-9 |
| 6-Heptene-1,5-diol, 2-ethylidene-6-methyl- | 91139-73-0 |
| 6-Heptene-2,4-diol, 4-(2-propenyl)- | 101536-75-8 |
| 6-Heptene-2,4-diol, 5,5-dimethyl- | 98753-77-6 |
| 6-Heptene-2,5-diol, 4,6-dimethyl- | 134876-94-1 |
| 6-Heptene-2,5-diol, 5-ethenyl-4-methyl- | 65757-31-5 |
| 1,3-Octanediol, 2-methylene- | 108086-78-8 |
| 1,6-Octadiene-3,5-diol, 2,6-dimethyl- | 91140-06-6 |
| 1,6-Octadiene-3,5-diol, 3,7-dimethyl- | 75654-19-2 |
| 1,7-Octadiene-3,6-diol, 2,6-dimethyl- | 51276-33-6 |
| 1,7-Octadiene-3,6-diol, 2,7-dimethyl- | 26947-10-4 |
| 1,7-Octadiene-3,6-diol, 3,6-dimethyl- | 31354-73-1 |
| 1-Octene-3,6-diol, 3-ethenyl- | 65757-34-8 |
| 2,4,6-Octatriene-1,8-diol, 2,7-dimethyl- | 162648-63-7 |
| 2,4-Octadiene-1,7-diol, 3,7-dimethyl- | 136054-24-5 |
| 2,5-Octadiene-1,7-diol, 2,6-dimethyl- | 91140-07-7 |
| 2,5-Octadiene-1,7-diol, 3,7-dimethyl- | 117935-59-8 |
| 2,6-Octadiene-1,4-diol, 3,7-dimethyl-(Rosiridol) | 101391-01-9 |
| 2,6-Octadiene-1,8-diol, 2-methyl- | 149112-02-7 |
| 2,7-Octadiene-1,4-diol, 3,7-dimethyl- | 91140-08-8 |
| 2,7-Octadiene-1,5-diol, 2,6-dimethyl- | 91140-09-9 |
| 2,7-Octadiene-1,6-diol, 2,6-dimethyl-(8-Hydroxylinalool) | 103619-06-3 |
| 2,7-Octadiene-1,6-diol, 2,7-dimethyl- | 60250-14-8 |
| 2-Octene-1,4-diol | 40735-15-7 |
| 2-Octene-1,7-diol | 73842-95-2 |
| 2-Octene-1,7-diol, 2-methyl-6-methylene- | 91140-16-8 |
| 3,5-Octadiene-1,7-diol, 3,7-dimethyl- | 62875-09-6 |
| 3,5-Octadiene-2,7-diol, 2,7-dimethyl- | 7177-18-6 |
| 3,5-Octanediol, 4-methylene- | 143233-15-2 |
| 3,7-Octadiene-1,6-diol, 2,6-dimethyl- | 127446-29-1 |
| 3,7-Octadiene-2,5-diol, 2,7-dimethyl- | 171436-39-8 |
| 3,7-Octadiene-2,6-diol, 2,6-dimethyl- | 150283-67-3 |
| 3-Octene-1,5-diol, 4-methyl- | 147028-43-1 |
| 3-Octene-1,5-diol, 5-methyl- | 19764-77-3 |
| 4,6-Octadiene-1,3-diol, 2,2-dimethyl-. | 39824-01-6 |
| 4,7-Octadiene-2,3-diol, 2,6-dimethyl- | 51117-38-5 |
| 4,7-Octadiene-2,6-diol, 2,6-dimethyl- | 59076-71-0 |
| 4-Octene-1,6-diol, 7-methyl- | 84538-24-9 |
| 4-Octene-1,8-diol, 2,7-bis(methylene)- | 109750-56-3 |
| 4-Octene-1,8-diol, 2-methylene- | 109750-58-5 |
| 5,7-Octadiene-1,4-diol, 2,7-dimethyl- | 105676-78-6 |
| 5,7-Octadiene-1,4-diol, 7-methyl- | 105676-80-0 |
| 5-Octene-1,3-diol | 130272-38-7 |
| 6-Octene-1,3-diol, 7-methyl- | 110971-19-2 |
| 6-Octene-1,4-diol, 7-methyl- | 152715-87-2 |
| 6-Octene-1,5-diol | 145623-79-6 |
| 6-Octene-1,5-diol, 7-methyl- | 116214-61-0 |
| 6-Octene-3,5-diol, 2-methyl- | 65534-66-9 |
| 6-Octene-3,5-diol, 4-methyl- | 156414-25-4 |
| 7-Octene-1,3-diol, 2-methyl- | 155295-38-8 |
| 7-Octene-1,3-diol, 4-methyl- | 142459-25-4 |
| 7-Octene-1,3-diol, 7-methyl- | 132130-96-2 |
| 7-Octene-1,5-diol | 7310-51-2 |
| 7-Octene-1,6-diol | 159099-43-1 |
| 7-Octene-1,6-diol, 5-methyl- | 144880-56-8 |
| 7-Octene-2,4-diol, 2-methyl-6-methylene- | 72446-81-2 |
| 7-Octene-2,5-diol, 7-methyl- | 152344-12-2 |
| 7-Octene-3,5-diol, 2-methyl- | 98753-85-6 |
| 1-Nonene-3,5-diol | 119554-56-2 |
| 1-Nonene-3,7-diol | 23866-97-9 |
| 3-Nonene-2,5-diol | 165746-84-9 |
| 4,6-Nonadiene-1,3-diol, 8-methyl- | 124099-52-1 |
| 4-Nonene-2,8-diol | 154600-80-3 |
| 6,8-Nonadiene-1,5-diol | 108586-03-4 |
| 7-Nonene-2,4-diol | 30625-41-3 |
| 8-Nonene-2,4-diol | 119785-59-0 |
| 8-Nonene-2,5-diol | 132381-58-9 |

TABLE X-continued

| EXAMPLES OF UNSATURATED COMPOUNDS | |
|---|---|
| 1,9-Decadiene-3,8-diol | 103984-04-9 |
| 1,9-Decadiene-4,6-diol | 138835-67-3 |
| Preferred Unsaturated Diols | |
| 1,3-Butanediol, 2,2-diallyl- | 103985-49-5 |
| 1,3-Butanediol, 2-(1-ethyl-1-propenyl)- | 116103-35-6 |
| 1,3-Butanediol, 2-(2-butenyl)-2-methyl- | 92207-83-5 |
| 1,3-Butanediol, 2-(3-methyl-2-butenyl)- | 98955-19-2 |
| 1,3-Butanediol, 2-ethyl-2-(2-propenyl)- | 122761-93-7 |
| 1,3-Butanediol, 2-methyl-2-(1-methyl-2-propenyl)- | 141585-58-2 |
| 1,4-Butanediol, 2,3-bis(1-methylethylidene)- | 52127-63-6 |
| 1,3-Pentanediol, 2-ethenyl-3-ethyl- | 104683-37-6 |
| 1,3-Pentanediol, 2-ethenyl-4,4-dimethyl- | 143447-08-9 |
| 1,4-Pentanediol, 3-methyl-2-(2-propenyl)- | 139301-86-3 |
| 4-Pentene-1,3-diol, 2-(1,1-dimethylethyl)- | 109788-04-7 |
| 4-Pentene-1,3-diol, 2-ethyl-2,3-dimethyl- | 90676-97-4 |
| 1,4-Hexanediol, 4-ethyl-2-methylene- | 66950-87-6 |
| 1,5-Hexadiene-3,4-diol, 2,3,5-trimethyl- | 18984-03-7 |
| 1,5-Hexanediol, 2-(1-methylethenyl)- | 96802-18-5 |
| 2-Hexene-1,5-diol, 4-ethenyl-2,5-dimethyl- | 70101-76-7 |
| 1,4-Heptanediol, 6-methyl-5-methylene- | 100590-29-2 |
| 2,4-Heptadiene-2,6-diol, 4,6-dimethyl- | 102605-95-8 |
| 2,6-Heptadiene-1,4-diol, 2,5,5-trimethyl- | 115346-30-0 |
| 2-Heptene-1,4-diol, 5,6-dimethyl- | 103867-76-1 |
| 3-Heptene-1,5-diol, 4,6-dimethyl- | 147028-45-3 |
| 5-Heptene-1,3-diol, 2,4-dimethyl- | 123363-69-9 |
| 5-Heptene-1,3-diol, 3,6-dimethyl- | 96924-52-6 |
| 5-Heptene-1,4-diol, 2,6-dimethyl- | 106777-98-4 |
| 5-Heptene-1,4-diol, 3,6-dimethyl- | 106777-99-5 |
| 6-Heptene-1,3-diol, 2,2-dimethyl- | 140192-39-8 |
| 6-Heptene-1,4-diol, 5,6-dimethyl- | 152344-16-6 |
| 6-Heptene-1,5-diol, 2,4-dimethyl- | 74231-27-9 |
| 6-Heptene-1,5-diol, 2-ethylidene-6-methyl- | 91139-73-0 |
| 6-Heptene-2,4-diol, 4-(2-propenyl)- | 101536-75-8 |
| 1-Octene-3,6-diol, 3-ethenyl- | 65757-34-8 |
| 2,4,6-Octatriene-1,8-diol, 2,7-dimethyl- | 162648-63-7 |
| 2,5-Octadiene-1,7-diol, 2,6-dimethyl- | 91140-07-7 |
| 2,5-Octadiene-1,7-diol, 3,7-dimethyl- | 117935-59-8 |
| 2,6-Octadiene-1,4-diol, 3,7-dimethyl-(Rosiridol) | 101391-01-9 |
| 2,6-Octadiene-1,8-diol, 2-methyl- | 149112-02-7 |
| 2,7-Octadiene-1,4-diol, 3,7-dimethyl- | 91140-08-8 |
| 2,7-Octadiene-1,5-diol, 2,6-dimethyl- | 91140-09-9 |
| 2,7-Octadiene-1,6-diol, 2,6-dimethyl-(8-Hydroxylinalool) | 103619-06-3 |
| 2,7-Octadiene-1,6-diol, 2,7-dimethyl- | 60250-14-8 |
| 2-Octene-1,7-diol, 2-methyl-6-methylene- | 91140-16-8 |
| 3,5-Octadiene-2,7-diol, 2,7-dimethyl- | 7177-18-6 |
| 3,5-Octanediol, 4-methylene- | 143233-15-2 |
| 3,7-Octadiene-1,6-diol, 2,6-dimethyl- | 127446-29-1 |
| 4-Octene-1,8-diol, 2-methylene- | 109750-58-5 |
| 6-Octene-3,5-diol, 2-methyl- | 65534-66-9 |
| 6-Octene-3,5-diol, 4-methyl- | 156414-25-4 |
| 7-Octene-2,4-diol, 2-methyl-6-methylene- | 72446-81-2 |
| 7-Octene-2,5-diol, 7-methyl- | 152344-12-2 |
| 7-Octene-3,5-diol, 2-methyl- | 98753-85-6 |
| 1-Nonene-3,5-diol | 119554-56-2 |
| 1-Nonene-3,7-diol | 23866-97-9 |
| 3-Nonene-2,5-diol | 165746-84-9 |
| 4-Nonene-2,8-diol | 154600-80-3 |
| 6,8-Nonadiene-1,5-diol | 108586-03-4 |
| 7-Nonene-2,4-diol | 30625-41-3 |
| 8-Nonene-2,4-diol | 119785-59-0 |
| 8-Nonene-2,5-diol | 132381-58-9 |
| 1,9-Decadiene-3,8-diol | 103984-04-9 |
| 1,9-Decadiene-4,6-diol | 138835-67-3 |

; and

XI. mixtures thereof.

There are no $C_{1-2}$ mono-ols that provide a clear concentrated fabric softener compositions in the context of this invention. There is only one $C_3$ mono-ol, n-propanol, that provides acceptable performance in terms of forming a clear product and either keeping it clear to a temperature of about 20° C., or allowing it to recover upon rewarming to room temperature, although its boiling point is undesirably low. Of the $C_4$ mono-ols, only 2-butanol and 2-methyl-2-propanol provide very good performance, but 2-methyl-2-propanol has a boiling point that is undesirably low. There are no $C_{5-6}$ mono-ols that provide clear products except for unsaturated monols as described above and hereinafter.

It is found that some principal solvents which have two hydroxyl groups in their chemical formulas are suitable for use in the formulation of the liquid concentrated, clear fabric softener compositions of this invention. It is discovered that the suitability of each principal solvent is surprisingly very selective, dependent on the number of carbon atoms, the isomeric configuration of the molecules having the same number of carbon atoms, the degree of unsaturation, etc. Principal solvents with similar solubility characteristics to the principal solvents above and possessing at least some asymmetry will provide the same benefit. It is discovered that the suitable principal solvents have a ClogP of from about 0.15 to about 0.64, preferably from about 0.25 to about 0.62, and more preferably from about 0.40 to about 0.60.

For example, for the 1,2-alkanediol principal solvent series having the general formula HO—$CH_2$—CHOH—$(CH_2)_n$—H, with n being from 1 to 8, only 1,2-hexanediol (n=4), which has a ClogP value of about 0.53, which is within the effective ClogP range of from about 0.15 to about 0.64, is a good principal solvent, and is within the claim of this invention, while the others, e.g., 1,2-propanediol, 1,2-butanediol, 1,2-pentanediol, 1,2-octanediol, 1,2-decanediol, having ClogP values outside the effective 0.15–0.64 range, are not. Furthermore, of the hexanediol isomers, again, the 1,2-hexanediol is a good principal solvent, while many other isomers such as 1,3-hexanediol, 1,4-hexanediol, 1,5-hexanediol, 1,6-hexanediol, 2,4-hexanediol, and 2,5-hexanediol, having ClogP values outside the effective 0.15–0.64 range, are not. These are illustrated by the Examples and Comparative Examples I-A and I-B (vide infra).

There are no $C_3$–$C_5$ diols that provide a clear concentrated composition in the context of this invention.

Although there are many $C_6$ diols that are possible isomers, only the ones listed above are suitable for making clear products and only: 1,2-butanediol, 2,3-dimethyl-; 1,2-butanediol, 3,3-dimethyl-; 2,3-pentanediol, 2-methyl-; 2,3-pentanediol, 3-methyl-; 2,3-pentanediol, 4-methyl-; 2,3-hexanediol; 3,4-hexanediol; 1,2-butanediol, 2-ethyl-; 1,2-pentanediol, 2-methyl-; 1,2-pentanediol, 3-methyl-; 1,2-pentanediol, 4-methyl-; and 1,2-hexanediol are preferred, of which the most preferred are: 1,2-butanediol, 2-ethyl-; 1,2-pentanediol, 2-methyl-; 1,2-pentanediol, 3-methyl-; 1,2-pentanediol, 4-methyl-; and 1,2-hexanediol.

There are more possible $C_7$ diol isomers, but only the listed ones provide clear products and the preferred ones are: 1,3-butanediol, 2-butyl-; 1,4-butanediol, 2-propyl-; 1,5-pentanediol, 2-ethyl-; 2,3-pentanediol, 2,3-dimethyl-; 2,3-pentanediol, 2,4-dimethyl-; 2,3-pentanediol, 4,4-dimethyl-; 3,4-pentanediol, 2,3-dimethyl-; 1,6-hexanediol, 2-methyl-; 1,6-hexanediol, 3-methyl-; 1,3-heptanediol; 1,4-heptanediol; 1,5-heptanediol; 1,6-heptanediol; of which the most preferred are: 2,3-pentanediol, 2,3-dimethyl-; 2,3-pentanediol, 2,4-dimethyl-; 2,3-pentanediol, 3,4-dimethyl-; 2,3-pentanediol, 4,4-dimethyl-; and 3,4-pentanediol, 2,3-dimethyl-.

Similarly, there are even more $C_8$ diol isomers, but only the listed ones provide clear products and the preferred ones are: 1,3-propanediol, 2-(1,1-dimethylpropyl)-; 1,3-propanediol, 2-(1,2-dimethylpropyl)-; 1,3-propanediol, 2-(1-ethylpropyl)-; 1,3-propanediol, 2-(2,2-dimethylpropyl)-; 1,3-propanediol, 2-ethyl-2-isopropyl-; 1,3-propanediol, 2-methyl-2-(1-methylpropyl)-; 1,3-propanediol, 2-methyl-2-(2-methylpropyl)-; 1,3-propanediol, 2-tertiary-butyl-2-methyl-; 1,3-butanediol, 2,2-diethyl; 1,3-butanediol, 2-(1-methylpropyl)-; 1,3-butanediol, 2-butyl-; 1,3-butanediol, 2-ethyl-2,3-dimethyl-; 1,3-butanediol, 2-(1,1-dimethylethyl)-; 1,3-butanediol, 2-(2-methylpropyl)-; 1,3-butanediol, 2-methyl-2-propyl-; 1,3-butanediol, 2-methyl-2-isopropyl-; 1,3-butanediol, 3-methyl-2-propyl-; 1,4-butanediol, 2,2-diethyl-; 1,4-butanediol, 2-ethyl-2,3-dimethyl-; 1,4-butanediol, 2-ethyl-3,3-dimethyl-; 1,4-butanediol, 2-(1,1-dimethylethyl)-; 1,4-butanediol, 3-methyl-2-isopropyl-; 1,3-pentanediol, 2,2,3-trimethyl-; 1,3-pentanediol, 2,2,4-trimethyl-; 1,3-pentanediol, 2,3,4-trimethyl-; 1,3-pentanediol, 2,4,4-trimethyl-; 1,3-pentanediol, 3,4,4-trimethyl-; 1,4-pentanediol, 2,2,3-trimethyl-; 1,4-pentanediol, 2,2,4-trimethyl-; 1,4-pentanediol, 2,3,3-trimethyl-; 1,4-pentanediol, 2,3,4-trimethyl-; 1,4-pentanediol, 3,3,4-trimethyl-; 1,5-pentanediol, 2,2,3-trimethyl-; 1,5-pentanediol, 2,2,4-trimethyl-; 1,5-pentanediol, 2,3,3-trimethyl-; 2,4-pentanediol, 2,3,4-trimethyl-; 1,3-pentanediol, 2-ethyl-2-methyl-; 1,3-pentanediol, 2-ethyl-3-methyl-; 1,3-pentanediol, 2-ethyl-4-methyl-; 1,3-pentanediol, 3-ethyl-2-methyl-; 1,4-pentanediol, 2-ethyl-2-methyl-; 1,4-pentanediol, 2-ethyl-3-methyl-; 1,4-pentanediol, 2-ethyl-4-methyl-; 1,5-pentanediol, 3-ethyl-3-methyl-; 2,4-pentanediol, 3-ethyl-2-methyl-; 1,3-pentanediol, 2-isopropyl-; 1,3-pentanediol, 2-propyl-; 1,4-pentanediol, 2-isopropyl-; 1,4-pentanediol, 2-propyl-; 1,4-pentanediol, 3-isopropyl-; 2,4-pentanediol, 3-propyl-; 1,3-hexanediol, 2,2-dimethyl-; 1,3-hexanediol, 2,3-dimethyl-; 1,3-hexanediol, 2,4-dimethyl-; 1,3-hexanediol, 2,5-dimethyl-; 1,3-hexanediol, 3,4-dimethyl-; 1,3-hexanediol, 3,5-dimethyl-; 1,3-hexanediol, 4,4-dimethyl-; 1,3-hexanediol, 4,5-dimethyl-; 1,4-hexanediol, 2,2-dimethyl-; 1,4-hexanediol, 2,3-dimethyl-; 1,4-hexanediol, 2,4-dimethyl-; 1,4-hexanediol, 2,5-dimethyl-; 1,4-hexanediol, 3,3-dimethyl-; 1,4-hexanediol, 3,4-dimethyl-; 1,4-hexanediol, 3,5-dimethyl-; 1,4-hexanediol, 4,5-dimethyl-; 1,4-hexanediol, 5,5-dimethyl-; 1,5-hexanediol, 2,2-dimethyl-; 1,5-hexanediol, 2,3-dimethyl-; 1,5-hexanediol, 2,4-dimethyl-; 1,5-hexanediol, 2,5-dimethyl-; 1,5-hexanediol, 3,3-dimethyl-; 1,5-hexanediol, 3,4-dimethyl-; 1,5-hexanediol, 3,5-dimethyl-; 1,5-hexanediol, 4,5-dimethyl-; 2,6-hexanediol, 3,3-dimethyl-; 1,3-hexanediol, 2-ethyl-; 1,3-hexanediol, 4-ethyl-; 1,4-hexanediol, 2-ethyl-; 1,4-hexanediol, 4-ethyl-; 1,5-hexanediol, 2-ethyl-; 2,4-hexanediol, 3-ethyl-; 2,4-hexanediol, 4-ethyl-; 2,5-hexanediol, 3-ethyl-; 1,3-heptanediol, 2-methyl-; 1,3-heptanediol, 3-methyl-; 1,3-heptanediol, 4-methyl-; 1,3-heptanediol, 5-methyl-; 1,3-heptanediol, 6-methyl-; 1,4-heptanediol, 2-methyl-; 1,4-heptanediol, 3-methyl-; 1,4-heptanediol, 4-methyl-; 1,4-heptanediol, 5-methyl-; 1,4-heptanediol, 6-methyl-; 1,5-heptanediol, 2-methyl-; 1,5-heptanediol, 3-methyl-; 1,5-heptanediol, 4-methyl-; 1,5-heptanediol, 5-methyl-; 1,5-heptanediol, 6-methyl-; 1,6-heptanediol, 2-methyl-; 1,6-heptanediol, 3-methyl-; 1,6-heptanediol, 4-methyl-; 1,6-heptanediol, 5-methyl-; 1,6-heptanediol, 6-methyl-; 2,4-heptanediol, 2-methyl-; 2,4-heptanediol, 3-methyl-; 2,4-heptanediol, 4-methyl-; 2,4-heptanediol, 5-methyl-; 2,4-heptanediol, 6-methyl-; 2,5-heptanediol, 2-methyl-; 2,5-heptanediol, 3-methyl-; 2,5-heptanediol, 4-methyl-; 2,5-heptanediol, 5-methyl-; 2,5-heptanediol, 6-methyl-; 2,6-heptanediol, 2-methyl-; 2,6-heptanediol, 3-methyl-; 2,6-heptanediol, 4-methyl-; 3,4-heptanediol, 3-methyl-; 3,5-heptanediol, 2-methyl-; 3,5-heptanediol, 4-methyl-; 2,4-octanediol; 2,5-octanediol; 2,6-octanediol; 2,7-octanediol; 3,5-octanediol; and/or 3,6-octanediol of which the following are the most preferred: 1,3-propanediol, 2-(1,1-dimethylpropyl)-; 1,3-propanediol, 2-(1,2-dimethylpropyl)-; 1,3-propanediol, 2-(1-ethylpropyl)-; 1,3-propanediol, 2-(2,2-dimethylpropyl)-; 1,3-propanediol, 2-ethyl-2-isopropyl-; 1,3-propanediol, 2-methyl-2-(1-methylpropyl)-; 1,3-propanediol, 2-methyl-2-(2-methylpropyl)-; 1,3-propanediol, 2-tertiary-butyl-2-methyl-; 1,3-butanediol, 2-(1-methylpropyl)-; 1,3-butanediol, 2-(2-methylpropyl)-; 1,3-butanediol, 2-butyl-; 1,3-butanediol, 2-methyl-2-propyl-; 1,3-butanediol, 3-methyl-2-propyl-; 1,4-butanediol, 2,2-diethyl-; 1,4-butanediol, 2-ethyl-2,3-dimethyl-; 1,4-butanediol, 2-ethyl-3,3-dimethyl-; 1,4-butanediol, 2-(1,1-dimethylethyl)-; 1,3-pentanediol, 2,3,4-trimethyl-; 1,5-pentanediol, 2,2,3-trimethyl-; 1,5-pentanediol, 2,2,4-trimethyl-; 1,5-pentanediol, 2,3,3-trimethyl-; 1,3-pentanediol, 2-ethyl-2-methyl-; 1,3-pentanediol, 2-ethyl-3-methyl-; 1,3-pentanediol, 2-ethyl-4-methyl-; 1,3-pentanediol, 3-ethyl-2-methyl-; 1,4-pentanediol, 2-ethyl-2-methyl-; 1,4-pentanediol, 2-ethyl-3-methyl-; 1,4-pentanediol, 2-ethyl-4-methyl-; 1,5-pentanediol, 3-ethyl-3-methyl-; 2,4-pentanediol, 3-ethyl-2-methyl-; 1,3-pentanediol, 2-isopropyl-; 1,3-pentanediol, 2-propyl-; 1,4-pentanediol, 2-isopropyl-; 1,4-pentanediol, 2-propyl-; 1,4-pentanediol, 3-isopropyl-; 2,4-pentanediol, 3-propyl-; 1,3-hexanediol, 2,2-dimethyl-; 1,3-hexanediol, 2,3-dimethyl-; 1,3-hexanediol, 2,4-dimethyl-; 1,3-hexanediol, 2,5-dimethyl-; 1,3-hexanediol, 3,4-dimethyl-; 1,3-hexanediol, 3,5-dimethyl-; 1,3-hexanediol, 4,4-dimethyl-; 1,3-hexanediol, 4,5-dimethyl-; 1,4-hexanediol, 2,2-dimethyl-; 1,4-hexanediol, 2,3-dimethyl-; 1,4-hexanediol, 2,4-dimethyl-; 1,4-hexanediol, 2,5-dimethyl-; 1,4-hexanediol, 3,3-dimethyl-; 1,4-hexanediol, 3,4-dimethyl-; 1,4-hexanediol, 3,5-dimethyl-; 1,4-hexanediol, 4,5-dimethyl-; 1,4-hexanediol, 5,5-dimethyl-; 1,5-hexanediol, 2,2-dimethyl-; 1,5-hexanediol, 2,3-dimethyl-; 1,5-hexanediol, 2,4-dimethyl-; 1,5-hexanediol, 2,5-dimethyl-; 1,5-hexanediol, 3,3-dimethyl-; 1,5-hexanediol, 3,4-dimethyl-; 1,5-hexanediol, 3,5-dimethyl-; 1,5-hexanediol, 4,5-dimethyl-; 2,6-hexanediol, 3,3-dimethyl-; 1,3-hexanediol, 2-ethyl-; 1,3-hexanediol, 4-ethyl-; 1,4-hexanediol, 2-ethyl-; 1,4-hexanediol, 4-ethyl-; 1,5-hexanediol, 2-ethyl-; 2,4-hexanediol, 3-ethyl-; 2,4-hexanediol, 4-ethyl-; 2,5-hexanediol, 3-ethyl-; 1,3-heptanediol, 2-methyl-; 1,3-heptanediol, 3-methyl-; 1,3-heptanediol, 4-methyl-; 1,3-heptanediol, 5-methyl-; 1,3-heptanediol, 6-methyl-; 1,4-heptanediol, 2-methyl-; 1,4-heptanediol, 3-methyl-; 1,4-heptanediol, 4-methyl-; 1,4-heptanediol, 5-methyl-; 1,4-heptanediol, 6-methyl-; 1,5-heptanediol, 2-methyl-; 1,5-heptanediol, 3-methyl-; 1,5-heptanediol, 4-methyl-; 1,5-heptanediol, 5-methyl-; 1,5-heptanediol, 6-methyl-; 1,6-heptanediol, 2-methyl-; 1,6-heptanediol, 3-methyl-; 1,6-heptanediol, 4-methyl-; 1,6-heptanediol, 5-methyl-; 1,6-heptanediol, 6-methyl-; 2,4-heptanediol, 2-methyl-; 2,4-heptanediol, 3-methyl-; 2,4-heptanediol, 4-methyl-; 2,4-heptanediol, 5-methyl-; 2,4-heptanediol, 6-methyl-; 2,5-heptanediol, 2-methyl-; 2,5-heptanediol, 3-methyl-; 2,5-heptanediol, 4-methyl-; 2,5-heptanediol, 5-methyl-; 2,5-heptanediol, 6-methyl-; 2,6-heptanediol, 2-methyl-; 2,6-heptanediol, 3-methyl-; 2,6-heptanediol, 4-methyl-; 3,4-heptanediol, 3-methyl-; 3,5-heptanediol, 2-methyl-; 3,5-heptanediol, 4-methyl-; 2,4-octanediol; 2,5-octanediol; 2,6-octanediol; 2,7-octanediol; 3,5-octanediol; and/or 3,6-octanediol.

Preferred mixtures of eight-carbon-atom-1,3 diols can be formed by the condensation of mixtures of butyraldehyde, isobutyraldehyde and/or methyl ethyl ketone (2-butanone), so long as there are at least two of these reactants in the reaction mixture, in the presence of highly alkaline catalyst followed by conversion by hydrogenation to form a mixture of eight-carbon-1,3-diols, i.e., a mixture of 8-carbon-1,3-diols primarily consisting of: 2,2,4-trimethyl-1,3-pentanediol; 2-ethyl-1,3-hexanediol; 2,2-dimethyl-1,3-hexanediol; 2-ethyl-4-methyl-1,3-pentanediol; 2-ethyl-3-methyl-1,3-pentanediol; 3,5-octanediol; 2,2-dimethyl-2,4-hexanediol; 2-methyl-3,5-heptanediol; and/or 3-methyl-3,5-heptanediol, the level of 2,2,4-trimethyl-1,3-pentanediol being less than half of any mixture, possibly along with other minor isomers resulting from condensation on the methylene group of 2-butanone, when it is present, instead of on the methyl group.

The formulatability, and other properties, such as odor, fluidity, melting point lowering, etc., of some $C_{6-8}$ diols listed above in Tables II–IV which are not preferred, can be improved by polyalkoxylation. Also, some of the $C_{3-5}$ diols which are alkoxylated are preferred. Preferred alkoxylated derivatives of the above $C_{3-8}$ diols [In the following disclosure, "EO" means polyethoxylates, "En" means $—(CH_2CH_2O)_nH$; Me-$E_n$ means methyl-capped polyethoxylates $—(CH_2CH_2O)_nCH_3$; "2(Me-En)" means 2 Me-En groups needed; "PO" means polypropoxylates, $—(CH(CH_3)CH_2O)_nH$; "BO" means polybutyleneoxy groups, $(CH(CH_2CH_3)CH_2O)_nH$; and "n-BO" means poly (n-butyleneoxy) groups $—(CH_2CH_2CH_2CH_2O)_nH$.] include:

1. 1,2-propanediol (C3) 2(Me-$E_{3-4}$); 1,2-propanediol (C3) $PO_4$; 1,2-propanediol, 2-methyl- (C4) (Me-$E_{8-10}$); 1,2-propanediol, 2-methyl- (C4) 2(Me-$E_1$); 1,2-propanediol, 2-methyl- (C4) $PO_3$; 1,3-propanediol (C3) 2(Me-$E_8$); 1,3-propanediol (C3) $PO_6$; 1,3-propanediol, 2,2-diethyl- (C7) $E_{4-7}$; 1,3-propanediol, 2,2-diethyl- (C7) $PO_1$; 1,3-propanediol, 2,2-diethyl- (C7) N-$BO_2$; 1,3-propanediol, 2,2-dimethyl- (C5) 2(Me $E_{1-2}$); 1,3-propanediol, 2,2-dimethyl- (C5) $PO_4$; 1,3-propanediol, 2-(1-methylpropyl)- (C7) $E_{4-7}$; 1,3-propanediol, 2-(1-methylpropyl)- (C7) $PO_1$; 1,3-propanediol, 2-(1-methylpropyl)- (C7) n-$BO_2$; 1,3-propanediol, 2-(2-methylpropyl)-(C7) $E_{4-7}$; 1,3-propanediol, 2-(2-methylpropyl)- (C7) $PO_1$; 1,3-propanediol, 2-(2-methylpropyl)- (C7) n-$BO_2$; 1,3-propanediol, 2-ethyl- (C5) (Me $E_{9-10}$); 1,3-propanediol, 2-ethyl- (C5) 2(Me $E_1$); 1,3-propanediol, 2-ethyl- (C5) $PO_3$; 1,3-propanediol, 2-ethyl-2-methyl- (C6) (Me $E_{3-6}$); 1,3-propanediol, 2-ethyl-2-methyl- (C6) $PO_2$; 1,3-propanediol, 2-ethyl-2-methyl- (C6) $BO_1$; 1,3-propanediol, 2-isopropyl- (C6) (Me $E_{3-6}$); 1,3-propanediol, 2-isopropyl- (C6) $PO_2$; 1,3-propanediol, 2-isopropyl- (C6) $BO_1$; 1,3-propanediol, 2-methyl- (C4) 2(Me $E_{4-5}$); 1,3-propanediol, 2-methyl- (C4) $PO_5$; 1,3-propanediol, 2-methyl- (C4) $BO_2$; 1,3-propanediol, 2-methyl-2-isopropyl- (C7) $E_{6-9}$; 1,3-propanediol, 2-methyl-2-isopropyl- (C7) $PO_1$; 1,3-propanediol, 2-methyl-2-isopropyl- (C7) n-$BO_{2-3}$; 1,3-propanediol, 2-methyl-2-propyl- (C7) $E_{4-7}$; 1,3-propanediol, 2-methyl-2-propyl-(C7) $PO_1$; 1,3-propanediol, 2-methyl-2-propyl- (C7) n-$BO_2$; 1,3-propanediol, 2-propyl- (C6) (Me $E_{1-4}$); 1,3-propanediol, 2-propyl- (C6) $PO_2$;
2. 1,2-butanediol (C4) (Me $E_{6-8}$); 1,2-butanediol (C4) $PO_{2-3}$; 1,2-butanediol (C4) $BO_1$; 1,2-butanediol, 2,3-dimethyl- (C6) $E_{2-5}$; 1,2-butanediol, 2,3-dimethyl-(C6) n-$BO_1$; 1,2-butanediol, 2-ethyl- (C6) $E_{1-3}$; 1,2-butanediol, 2-ethyl- (C6) n-$BO_1$; 1,2-butanediol, 2-methyl- (C5) (Me $E_{1-2}$); 1,2-butanediol, 2-methyl- (C5) $PO_1$; 1,2-butanediol, 3,3-dimethyl- (C6) $E_{2-5}$; 1,2-butanediol, 3,3-dimethyl- (C6) n-$BO_1$; 1,2-butanediol, 3-methyl- (C5) (Me $E_{1-2}$); 1,2-butanediol, 3-methyl- (C5) $PO_1$; 1,3-butanediol (C4) 2(Me $E_{5-6}$); 1,3-butanediol (C4) $BO_2$; 1,3-butanediol, 2,2,3-trimethyl- (C7) (Me $E_{1-3}$); 1,3-butanediol, 2,2,3-trimethyl- (C7) $PO_2$; 1,3-butanediol, 2,2-dimethyl- (C6) (Me $E_{6-8}$); 1,3-butanediol, 2,2-dimethyl- (C6) $PO_3$; 1,3-butanediol, 2,3-dimethyl- (C6) (Me $E_{6-8}$); 1,3-butanediol, 2,3-dimethyl- (C6) $PO_3$; 1,3-butanediol, 2-ethyl- (C6) (Me $E_{4-6}$); 1,3-butanediol, 2-ethyl- (C6) $PO_{2-3}$; 1,3-butanediol, 2-ethyl- (C6) $BO_1$; 1,3-butanediol, 2-ethyl-2-methyl- (C7) (Me $E_1$); 1,3-butanediol, 2-ethyl-2-methyl- (C7) $PO_1$; 1,3-butanediol, 2-ethyl-2-methyl- (C7) n-$BO_3$; 1,3-butanediol, 2-ethyl-3-methyl- (C7) (Me $E_1$); 1,3-butanediol, 2-ethyl-3-methyl- (C7) $PO_1$; 1,3-butanediol, 2-ethyl-3-methyl- (C7) n-$BO_3$; 1,3-butanediol, 2-isopropyl- (C7) (Me $E_1$); 1,3-butanediol, 2-isopropyl- (C7) $PO_1$; 1,3-butanediol, 2-isopropyl- (C7) n-$BO_3$; 1,3-butanediol, 2-methyl- (C5) 2(Me $E_{2-3}$); 1,3-butanediol, 2-methyl- (C5) $PO_4$; 1,3-butanediol, 2-propyl- (C7) $E_{6-8}$; 1,3-butanediol, 2-propyl-(C7) $PO_1$; 1,3-butanediol, 2-propyl- (C7) n-$BO_{2-3}$; 1,3-butanediol, 3-methyl- (C5) 2(Me $E_{2-3}$); 1,3-butanediol, 3-methyl- (C5) $PO_4$; 1,4-butanediol (C4) 2(Me $E_{3-4}$); 1,4-butanediol (C4) $P_{4-5}$; 1,4-butanediol, 2,2,3-trimethyl- (C7) $E_{6-9}$; 1,4-butanediol, 2,2,3-trimethyl- (C7) $PO_1$; 1,4-butanediol, 2,2,3-trimethyl- (C7) n-$BO_{2-3}$; 1,4-butanediol, 2,2-dimethyl- (C6) (Me $E_{3-6}$); 1,4-butanediol, 2,2-dimethyl- (C6) $PO_2$; 1,4-butanediol, 2,2-dimethyl- (C6) $BO_1$; 1,4-butanediol, 2,3-dimethyl- (C6) (Me $E_{3-6}$); 1,4-butanediol, 2,3-dimethyl- (C6) $PO_2$; 1,4-butanediol, 2,3-dimethyl- (C6) $BO_1$; 1,4-butanediol, 2-ethyl- (C6) (Me $E_{1-4}$); 1,4-butanediol, 2-ethyl- (C6) $PO_2$; 1,4-butanediol, 2-ethyl-2-methyl- (C7) $E_{4-7}$; 1,4-butanediol, 2-ethyl-2-methyl- (C7) $PO_1$; 1,4-butanediol, 2-ethyl-2-methyl- (C7) n-$BO_2$; 1,4-butanediol, 2-ethyl-3-methyl- (C7) $E_{4-7}$; 1,4-butanediol, 2-ethyl-3-methyl- (C7) $PO_1$; 1,4-butanediol, 2-ethyl-3-methyl- (C7) n-$BO_2$; 1,4-butanediol, 2-isopropyl- (C7) $E_{4-7}$; 1,4-butanediol, 2-isopropyl- (C7) $PO_1$; 1,4-butanediol, 2-isopropyl- (C7) n-$BO_2$; 1,4-butanediol, 2-methyl- (C5) (Me $E_{9-10}$); 1,4-butanediol, 2-methyl- (C5) 2(Me $E_1$); 1,4-butanediol, 2-methyl- (C5) $PO_3$; 1,4-butanediol, 2-propyl- (C7) $E_{2-5}$; 1,4-butanediol, 2-propyl- (C7) n-$BO_1$; 1,4-butanediol, 3-ethyl-1-methyl- (C7) $E_{6-8}$; 1,4-butanediol, 3-ethyl-1-methyl- (C7) $PO_1$; 1,4-butanediol, 3-ethyl-1-methyl- (C7) n-$BO_{2-3}$; 2,3-butanediol (C4) (Me $E_{9-10}$); 2,3-butanediol (C4) 2(Me $E_1$); 2,3-butanediol (C4) $PO_{3-4}$; 2,3-butanediol, 2,3-dimethyl- (C6) $E_{7-9}$; 2,3-butanediol, 2,3-dimethyl- (C6) $PO_1$; 2,3-butanediol, 2,3-dimethyl- (C6) $BO_{2-3}$; 2,3-butanediol, 2-methyl- (C5) (Me $E_{2-5}$); 2,3-butanediol, 2-methyl- (C5) $PO_2$; 2,3-butanediol, 2-methyl- (C5) $BO_1$;

3. 1,2-pentanediol (C5) $E_{7-10}$; 1,2-pentanediol, (C5) $PO_1$; 1,2-pentanediol, (C5) n-$BO_3$; 1,2-pentanediol, 2-methyl (C6) $E_{1-3}$; 1,2-pentanediol, 2-methyl (C6) n-$BO_1$; 1,2-pentanediol, 3-methyl (C6) $E_{1-3}$; 1,2-pentanediol, 3-methyl (C6) n-$BO_1$; 1,2-pentanediol, 4-methyl (C6) $E_{1-3}$; 1,2-pentanediol, 4-methyl (C6) n-$BO_1$; 1,3-pentanediol (C5) 2(Me-$E_{1-2}$); 1,3-pentanediol (C5) $PO_{3-4}$; 1,3-pentanediol, 2,2-dimethyl- (C7) (Me-$E_1$); 1,3-pentanediol, 2,2-dimethyl- (C7) $PO_1$; 1,3-pentanediol, 2,2-dimethyl- (C7) n-$BO_3$; 1,3-pentanediol, 2,3-dimethyl- (C7) (Me-$E_1$); 1,3-pentanediol, 2,3-dimethyl- (C7) $PO_1$; 1,3-pentanediol, 2,3-dimethyl-(C7) n-$BO_3$; 1,3-pentanediol, 2,4-dimethyl- (C7) (Me-$E_1$); 1,3-pentanediol, 2,4-dimethyl- (C7) $PO_1$; 1,3-pentanediol, 2,4-dimethyl-(C7) n-$BO_3$; 1,3-pentanediol, 2-ethyl- (C7) $E_{6-8}$; 1,3-pentanediol, 2-ethyl- (C7) $PO_1$; 1,3-pentanediol, 2-ethyl- (C7) n-$BO_{2-3}$; 1,3-pentanediol, 2-methyl- (C6) 2(Me-$E_{4-6}$); 1,3-pentanediol, 2-methyl- (C6) $PO_{2-3}$; 1,3-pentanediol, 3,4-dimethyl- (C7) (Me-$E_1$); 1,3-pentanediol, 3,4-dimethyl- (C7) $PO_1$; 1,3-pentanediol, 3,4-dimethyl- (C7) n-$BO_3$; 1,3-pentanediol, 3-methyl- (C6) 2(Me-$E_{4-6}$); 1,3-pentanediol, 3-methyl- (C6) $PO_{2-3}$; 1,3-pentanediol, 4,4-dimethyl- (C7) (Me-$E_1$); 1,3-pentanediol, 4,4-dimethyl- (C7) $PO_1$; 1,3-pentanediol, 4,4-dimethyl- (C7) n-$BO_3$; 1,3-pentanediol, 4-methyl- (C6) 2(Me-$E_{4-6}$); 1,3-pentanediol, 4-methyl- (C6) $PO_{2-3}$; 1,4-pentanediol, (C5) 2(Me-$E_{1-2}$); 1,4-pentanediol (C5) $PO_{3-4}$; 1,4-pentanediol, 2,2-dimethyl- (C7) (Me-$E_1$); 1,4-pentanediol, 2,2-dimethyl- (C7) $PO_1$; 1,4-pentanediol, 2,2-dimethyl- (C7) n-$BO_3$; 1,4-pentanediol, 2,3-dimethyl- (C7) (Me-$E_1$); 1,4-pentanediol, 2,3-dimethyl- (C7) $PO_1$; 1,4-pentanediol, 2,3-dimethyl- (C7) n-$BO_3$; 1,4-pentanediol, 2,4-dimethyl-(C7) (Me-$E_1$); 1,4-pentanediol, 2,4-dimethyl-(C7) $PO_1$; 1,4-pentanediol, 2,4-dimethyl- (C7) n-$BO_3$; 1,4-pentanediol, 2-methyl- (C6) (Me-$E_{4-6}$); 1,4-pentanediol, 2-methyl- (C6) $PO_{2-3}$; 1,4-pentanediol, 3,3-dimethyl- (C7) (Me-$E_1$); 1,4-pentanediol, 3,3-dimethyl- (C7) $PO_1$; 1,4-pentanediol, 3,3-dimethyl-(C7) n-$BO_3$; 1,4-pentanediol, 3,4-dimethyl- (C7) (Me-$E_1$); 1,4-pentanediol, 3,4-dimethyl- (C7) $PO_1$; 1,4-pentanediol, 3,4-dimethyl- (C7) n-$BO_3$; 1,4-pentanediol, 3-methyl- (C6) 2(Me-$E_{4-6}$); 1,4-pentanediol, 3-methyl- (C6) $PO_{2-3}$; 1,4-pentanediol, 4-methyl- (C6) 2(Me-$E_{4-6}$); 1,4-pentanediol, 4-methyl- (C6) $PO_{2-3}$; 1,5-pentanediol, (C5) (Me-$E_{8-10}$); 1,5-pentanediol (C5) 2(Me-$E_1$); 1,5-pentanediol (C5) $PO_3$; 1,5-pentanediol, 2,2-dimethyl- (C7) $E_{4-7}$; 1,5-pentanediol, 2,2-dimethyl- (C7) $PO_1$; 1,5-pentanediol, 2,2-dimethyl- (C7) n-$BO_2$; 1,5-pentanediol, 2,3-dimethyl- (C7) $E_{4-7}$; 1,5-pentanediol, 2,3-dimethyl- (C7) $PO_1$; 1,5-pentanediol, 2,3-dimethyl- (C7) n-$BO_2$; 1,5-pentanediol, 2,4-dimethyl- (C7) $E_{4-7}$; 1,5-pentanediol, 2,4-dimethyl- (C7) $PO_1$; 1,5-pentanediol, 2,4-dimethyl- (C7) n-$BO_2$; 1,5-pentanediol, 2-ethyl- (C7) $E_{2-5}$; 1,5-pentanediol, 2-ethyl- (C7) n-$BO_1$; 1,5-pentanediol, 2-methyl- (C6) (Me-$E_{1-4}$); 1,5-pentanediol, 2-methyl- (C6) $PO_2$; 1,5-pentanediol, 3,3-dimethyl- (C7) $E_{4-7}$; 1,5-pentanediol, 3,3-dimethyl- (C7) $PO_1$; 1,5-pentanediol, 3,3-dimethyl- (C7) n-$BO_2$; 1,5-pentanediol, 3-methyl- (C6) (Me-$E_{1-4}$); 1,5-pentanediol, 3-methyl- (C6) $PO_2$; 2,3-pentanediol, (C5) (Me-$E_{1-3}$); 2,3-pentanediol, (C5) $PO_2$; 2,3-pentanediol, 2-methyl- (C6) $E_{4-7}$; 2,3-pentanediol, 2-methyl- (C6) $PO_1$; 2,3-pentanediol, 2-methyl- (C6) n-$BO_2$; 2,3-pentanediol, 3-methyl- (C6) $E_{4-7}$; 2,3-pentanediol, 3-methyl- (C6) $PO_1$; 2,3-pentanediol, 3-methyl- (C6) n-$BO_2$; 2,3-pentanediol, 4-methyl- (C6) $E_{4-7}$; 2,3-pentanediol, 4-methyl- (C6) $PO_1$; 2,3-pentanediol, 4-methyl- (C6) n-$BO_2$; 2,4-pentanediol, (C5) 2(Me-$E_{2-4}$); 2,4-pentanediol (C5) $PO_4$; 2,4-pentanediol, 2,3-dimethyl- (C7) (Me-$E_{2-4}$); 2,4-pentanediol, 2,3-dimethyl- (C7) $PO_2$; 2,4-pentanediol, 2,4-dimethyl-(C7) (Me-$E_{2-4}$); 2,4-pentanediol, 2,4-dimethyl-(C7) $PO_2$; 2,4-pentanediol, 2-methyl- (C7) (Me-$E_{8-10}$); 2,4-pentanediol, 2-methyl- (C7) $PO_3$; 2,4-pentanediol, 3,3-dimethyl- (C7) (Me-$E_{2-4}$); 2,4-pentanediol, 3,3-dimethyl- (C7) $PO_2$; 2,4-pentanediol, 3-methyl- (C6) (Me-$E_{8-10}$); 2,4-pentanediol, 3-methyl- (C6) $PO_3$;

4. 1,3-hexanediol (C6) (Me-$E_{2-5}$); 1,3-hexanediol (C6) $PO_2$; 1,3-hexanediol (C6) $BO_1$; 1,3-hexanediol, 2-methyl- (C7) $E_{6-8}$; 1,3-hexanediol, 2-methyl- (C7) $PO_1$; 1,3-hexanediol, 2-methyl- (C7) n-$BO_{2-3}$; 1,3-hexanediol, 3-methyl- (C7) $E_{6-8}$; 1,3-hexanediol, 3-methyl- (C7) $PO_1$; 1,3-hexanediol, 3-methyl-(C7) n-$BO_{2-3}$; 1,3-hexanediol, 4-methyl- (C7) $E_{6-8}$; 1,3-hexanediol, 4-methyl- (C7) $PO_1$; 1,3-hexanediol, 4-methyl- (C7) n-$BO_{2-3}$; 1,3-hexanediol, 5-methyl- (C7) $E_{6-8}$; 1,3-hexanediol, 5-methyl- (C7) $PO_1$; 1,3-hexanediol, 5-methyl- (C7) n-$BO_{2-3}$; 1,4-hexanediol (C6) (Me-$E_{2-5}$); 1,4-hexanediol (C6) $PO_2$; 1,4-hexanediol (C6) $BO_1$; 1,4-hexanediol, 2-methyl- (C7) $E_{6-8}$; 1,4-hexanediol, 2-methyl- (C7) $PO_1$; 1,4-hexanediol, 2-methyl- (C7) n-$BO_{2-3}$; 1,4-hexanediol, 3-methyl- (C7) $E_{6-8}$; 1,4-hexanediol, 3-methyl- (C7) $PO_1$; 1,4-hexanediol, 3-methyl- (C7) n-$BO_{2-3}$; 1,4-hexanediol, 4-methyl- (C7) $E_{6-8}$; 1,4-hexanediol, 4-methyl- (C7) $PO_1$; 1,4-hexanediol, 4-methyl- (C7) n-$BO_{2-3}$; 1,4-hexanediol, 5-methyl- (C7) $E_{6-8}$; 1,4-hexanediol, 5-methyl- (C7) $PO_1$; 1,4-hexanediol, 5-methyl- (C7) n-$BO_{2-3}$; 1,5-hexanediol (C6) (Me-$E_{2-5}$); 1,5-hexanediol (C6) $PO_2$; 1,5-hexanediol (C6) $BO_1$; 1,5-hexanediol, 2-methyl- (C7) $E_{6-8}$; 1,5-hexanediol, 2-methyl- (C7) $PO_1$; 1,5-hexanediol, 2-methyl- (C7) n-$BO_{2-3}$; 1,5-hexanediol, 3-methyl- (C7) $E_{6-8}$; 1,5-hexanediol, 3-methyl- (C7) $PO_1$; 1,5-hexanediol, 3-methyl- (C7) n-$BO_{2-3}$; 1,5-hexanediol, 4-methyl- (C7) $E_{6-8}$; 1,5-hexanediol, 4-methyl- (C7) $PO_1$; 1,5-hexanediol, 4-methyl- (C7) n-$BO_{2-3}$; 1,5-hexanediol, 5-methyl- (C7) $E_{6-8}$; 1,5-hexanediol, 5-methyl- (C7) $PO_1$; 1,5-hexanediol, 5-methyl- (C7) n-$BO_{2-3}$; 1,6-hexanediol (C6) (Me-$E_{1-2}$); 1,6-hexanediol (C6) $PO_{1-2}$; 1,6-hexanediol (C6) n-$BO_4$; 1,6-hexanediol, 2-methyl- (C7) $E_{2-5}$; 1,6-hexanediol, 2-methyl- (C7) n-$BO_1$; 1,6-hexanediol, 3-methyl- (C7) $E_{2-5}$; 1,6-hexanediol, 3-methyl- (C7) n-$BO_1$; 2,3-hexanediol (C6) $E_{2-5}$; 2,3-hexanediol (C6) n-$BO_1$; 2,4-hexanediol (C6) (Me-$E_{5-8}$); 2,4-hexanediol (C6) $PO_3$; 2,4-hexanediol, 2-methyl- (C7) (Me-$E_{1-2}$); 2,4-hexanediol 2-methyl- (C7) $PO_{1-2}$; 2,4-hexanediol, 3-methyl- (C7) (Me-$E_{1-2}$); 2,4-hexanediol 3-methyl- (C7) $PO_{1-2}$; 2,4-hexanediol, 4-methyl- (C7) (Me-$E_{1-2}$); 2,4-hexanediol 4-methyl- (C7) $PO_{1-2}$; 2,4-hexanediol, 5-methyl- (C7) (Me-$E_{1-2}$); 2,4-hexanediol 5-methyl- (C7) $PO_{1-2}$; 2,5-hexanediol (C6) (Me-$E_{5-8}$); 2,5-hexanediol (C6) $PO_3$; 2,5-hexanediol, 2-methyl- (C7) (Me-$E_{1-2}$); 2,5-hexanediol 2-methyl- (C7) $PO_{1-2}$; 2,5-hexanediol, 3-methyl- (C7) (Me-$E_{1-2}$); 2,5-hexanediol 3-methyl- (C7) $PO_{1-2}$; 3,4-hexanediol (C6) $EO_{2-5}$; 3,4-hexanediol (C6) n-$BO_1$;

5. 1,3-heptanediol (C7) $E_{3-6}$; 1,3-heptanediol (C7) $PO_1$; 1,3-heptanediol (C7) n-$BO_2$; 1,4-heptanediol (C7) $E_{3-6}$; 1,4-heptanediol (C7) $PO_1$; 1,4-heptanediol (C7) n-$BO_2$; 1,5-heptanediol (C7) $E_{3-6}$; 1,5-heptanediol (C7) $PO_1$; 1,5-heptanediol (C7) n-$BO_2$; 1,6-heptanediol (C7) $E_{3-6}$; 1,6-heptanediol (C7) $PO_1$; 1,6-heptanediol (C7) n-$BO_2$; 1,7-heptanediol (C7) $E_{1-2}$; 1,7-heptanediol (C7) n-$BO_1$; 2,4-heptanediol (C7) $E_{7-10}$; 2,4-heptanediol (C7) (Me-$E_1$); 2,4-heptanediol (C7) $PO_1$; 2,4-heptanediol (C7) n-$BO_3$; 2,5-heptanediol (C7) $E_{7-10}$; 2,5-heptanediol (C7) (Me-$E_1$); 2,5-heptanediol (C7) $PO_1$; 2,5-heptanediol (C7) n-$BO_3$; 2,6-heptanediol (C7) $E_{7-10}$; 2,6-heptanediol (C7) (Me-$E_1$); 2,6-heptanediol (C7) $PO_1$; 2,6-heptanediol (C7) n-$BO_3$; 3,5-heptanediol (C7) $E_{7-10}$; 3,5-heptanediol (C7) (Me-$E_1$); 3,5-heptanediol (C7) $PO_1$; 3,5-heptanediol (C7) n-$BO_3$;

6. 1,3-butanediol, 3-methyl-2-isopropyl- (C8) $PO_1$; 2,4-pentanediol, 2,3,3-trimethyl- (C8) $PO_1$; 1,3-butanediol, 2,2-diethyl- (C8) $E_{2-5}$; 2,4-hexanediol, 2,3-dimethyl- (C8) $E_{2-5}$; 2,4-hexanediol, 2,4-dimethyl- (C8) $E_{2-5}$; 2,4-hexanediol, 2,5-dimethyl- (C8) $E_{2-5}$; 2,4-hexanediol, 3,3-dimethyl- (C8) $E_{2-5}$; 2,4-hexanediol, 3,4-dimethyl- (C8) $E_{2-5}$; 2,4-hexanediol, 3,5-dimethyl- (C8) $E_{2-5}$; 2,4-hexanediol, 4,5-dimethyl- (C8) $E_{2-5}$; 2,4-hexanediol, 5,5-dimethyl- (C8) $E_{2-5}$; 2,5-hexanediol, 2,3-dimethyl- (C8) $E_{2-5}$; 2,5-hexanediol, 2,4-dimethyl- (C8) $E_{2-5}$; 2,5-hexanediol, 2,5-dimethyl- (C8) $E_{2-5}$; 2,5-hexanediol, 3,3-dimethyl- (C8) $E_{2-5}$; 2,5-hexanediol, 3,4-dimethyl- (C8) $E_{2-5}$; 3,5-heptanediol, 3-methyl- (C8) $E_{2-5}$; 1,3-butanediol, 2,2-diethyl- (C8) n-$BO_{1-2}$; 2,4-hexanediol, 2,3-dimethyl- (C8) n-$BO_{1-2}$; 2,4-hexanediol, 2,4-dimethyl- (C8) n-$BO_{1-2}$; 2,4-hexanediol, 2,5-dimethyl- (C8) n-$BO_{1-2}$; 2,4-hexanediol, 3,3-dimethyl- (C8) n-$BO_{1-2}$; 2,4-hexanediol, 3,4-dimethyl- (C8) n-$BO_{1-2}$; 2,4-hexanediol, 3,5-dimethyl- (C8) n-$BO_{1-2}$; 2,4-hexanediol, 4,5-dimethyl- (C8) n-$BO_{1-2}$; 2,4-hexanediol, 5,5-dimethyl-, n-$BO_{1-2}$; 2,5-hexanediol, 2,3-dimethyl- (C8) n-$BO_{1-2}$; 2,5-hexanediol, 2,4-dimethyl- (C8) n-$BO_{1-2}$; 2,5-hexanediol, 2,5-dimethyl- (C8) n-$BO_{1-2}$; 2,5-hexanediol, 3,3-dimethyl- (C8) n-$BO_{1-2}$; 2,5-hexanediol, 3,4-dimethyl- (C8) n-$BO_{1-2}$; 3,5-heptanediol, 3-methyl- (C8) n-$BO_{1-2}$; 1,3-propanediol, 2-(1,2-dimethylpropyl)- (C8) n-$BO_1$; 1,3-butanediol, 2-ethyl-2,3-dimethyl- (C8) n-$BO_1$; 1,3-butanediol, 2-methyl-2-isopropyl- (C8) n-$BO_1$; 1,4-butanediol, 3-methyl-2-isopropyl- (C8) n-$BO_1$; 1,3-pentanediol, 2,2,3-trimethyl- (C8) n-$BO_1$; 1,3-pentanediol, 2,2,4-trimethyl- (C8) n-$BO_1$; 1,3-pentanediol, 2,4,4-trimethyl- (C8) n-$BO_1$; 1,3-pentanediol, 3,4,4-trimethyl- (C8) n-$BO_1$; 1,4-pentanediol, 2,2,3-trimethyl- (C8) n-$BO_1$; 1,4-pentanediol, 2,2,4-trimethyl- (C8) n-$BO_1$; 1,4-pentanediol, 2,3,3-trimethyl- (C8) n-$BO_1$; 1,4-pentanediol, 2,3,4-trimethyl- (C8) n-$BO_1$; 1,4-pentanediol, 3,3,4-trimethyl- (C8) n-$BO_1$; 2,4-pentanediol, 2,3,4-trimethyl- (C8) n-$BO_1$; 2,4-hexanediol, 4-ethyl- (C8) n-$BO_1$; 2,4-heptanediol, 2-methyl- (C8) n-$BO_1$; 2,4-heptanediol, 3-methyl- (C8) n-$BO_1$; 2,4-heptanediol, 4-methyl- (C8) n-$BO_1$; 2,4-heptanediol, 5-methyl- (C8) n-$BO_1$; 2,4-heptanediol, 6-methyl- (C8) n-$BO_1$; 2,5-heptanediol, 2-methyl- (C8) n-$BO_1$; 2,5-heptanediol, 3-methyl- (C8) n-$BO_1$; 2,5-heptanediol, 4-methyl- (C8) n-$BO_1$; 2,5-heptanediol, 5-methyl- (C8) n-$BO_1$; 2,5-heptanediol, 6-methyl- (C8) n-$BO_1$; 2,6-heptanediol, 2-methyl- (C8) n-$BO_1$; 2,6-heptanediol, 3-methyl- (C8) n-$BO_1$; 2,6-heptanediol, 4-methyl- (C8) n-$BO_1$; 3,5-heptanediol, 2-methyl- (C8) n-$BO_1$; 1,3-propanediol, 2-(1,2-dimethylpropyl)- (C8) $E_{1-3}$; 1,3-butanediol, 2-ethyl-2,3-dimethyl- (C8) $E_{1-3}$; 1,3-butanediol, 2-methyl-2-isopropyl- (C8) $E_{1-3}$; 1,4-butanediol, 3-methyl-2-isopropyl- (C8) $E_{1-3}$; 1,3-pentanediol, 2,2,3-trimethyl- (C8) $E_{1-3}$; 1,3-pentanediol, 2,2,4-trimethyl- (C8) $E_{1-3}$; 1,3-pentanediol, 2,4,4-trimethyl- (C8) $E_{1-3}$; 1,3-pentanediol, 3,4,4-trimethyl- (C8) $E_{1-3}$; 1,4-pentanediol, 2,2,3-trimethyl- (C8) $E_{1-3}$; 1,4-pentanediol, 2,2,4-trimethyl- (C8) $E_{1-3}$; 1,4-pentanediol, 2,3,3-trimethyl- (C8) $E_{1-3}$; 1,4-pentanediol, 2,3,4-trimethyl- (C8) $E_{1-3}$; 1,4-pentanediol, 3,3,4-trimethyl- (C8) $E_{1-3}$; 2,4-pentanediol, 2,3,4-trimethyl- (C8) $E_{1-3}$; 2,4-hexanediol, 4-ethyl- (C8) $E_{1-3}$; 2,4-heptanediol, 2-methyl- (C8) $E_{1-3}$; 2,4-heptanediol, 3-methyl- (C8) $E_{1-3}$; 2,4-heptanediol, 4-methyl- (C8) $E_{1-3}$; 2,4-heptanediol, 5-methyl- (C8) $E_{1-3}$; 2,4-heptanediol, 6-methyl- (C8) $E_{1-3}$; 2,5-heptanediol, 2-methyl- (C8) $E_{1-3}$; 2,5-heptanediol, 3-methyl- (C8) $E_{1-3}$; 2,5-heptanediol, 4-methyl- (C8) $E_{1-3}$; 2,5-heptanediol, 5-methyl- (C8) $E_{1-3}$; 2,5-heptanediol, 6-methyl- (C8) $E_{1-3}$; 2,6-heptanediol, 2-methyl- (C8) $E_{1-3}$; 2,6-heptanediol, 3-methyl- (C8) $E_{1-3}$; 2,6-heptanediol, 4-methyl- (C8) $E_{1-3}$; and/or 3,5-heptanediol, 2-methyl- (C8) $E_{1-3}$; and 7. mixtures thereof.

Of the nonane isomers, only 2,4-pentadiol, 2,3,3,4-tetramethyl- is highly preferred.

In addition to the aliphatic diol principal solvents, and some of their alkoxylated derivatives, discussed hereinbefore and hereinafter, some specific diol ethers are also found to be suitable principal solvents for the formulation of liquid concentrated, clear fabric softener compositions of the present invention. Similar to the aliphatic diol principal solvents, it is discovered that the suitability of each principal solvent is very selective, depending, e.g., on the number of carbon atoms in the specific diol ether molecules. For example, as given in Table VI. for the glyceryl ether series having the formula $HOCH_2—CHOH—CH_2—O—R$, wherein R is from C2 to C8 alkyl, only monopentyl ethers with the formula $HOCH_2—CHOH—CH_2—O—C_5H_{11}$ (3-pentyloxy-1,2-propanediol), wherein the $C_5H_{11}$ group comprises different pentyl isomers, have ClogP values within the preferred ClogP values of from about 0.25 to about 0.62 and are suitable for the formulation of liquid concentrated, clear fabric softeners of the present invention. These are illustrated by the Examples and Comparative Examples XXXIIA-7 to XXXIIA-7F. It is also found that the cyclohexyl derivative, but not the cyclopentyl derivative, is suitable. Similarly, selectivity is exhibited in the selection of aryl glyceryl ethers. Of the many possible aromatic groups, only a few phenol derivatives are suitable.

The same narrow selectivity is also found for the di(hydroxyalkyl) ethers. It is discovered that bis(2-hydroxybutyl) ether, but not bis(2-hydroxypentyl) ether, is suitable. For the di(cyclic hydroxyalkyl) analogs, the bis(2-hydroxycyclopentyl) ether is suitable, but not the bis(2-hydroxycyclohexyl) ether. Non-limiting examples of synthesis methods for the preparation of some preferred di(hydroxyalkyl) ethers are given hereinafter.

The butyl monoglycerol ether (also named 3-butyloxy-1,2-propanediol) is not well suited to form liquid concentrated, clear fabric softeners of the present invention. However, its polyethoxylated derivatives, preferably from about triethoxylated to about nonaethoxylated, more preferably from pentaethoxylated to octaethoxylated, are suitable principal solvents, as given in Table VI.

All of the preferred alkyl glyceryl ethers and/or di(hydroxyalkyl)ethers that have been identified are given in Table VI and the most preferred are: 1,2-propanediol, 3-(n-pentyloxy)-; 1,2-propanediol, 3-(2-pentyloxy)-; 1,2-propanediol, 3-(3-pentyloxy)-; 1,2-propanediol, 3-(2-methyl-1-butyloxy)-; 1,2-propanediol, 3-(iso-amyloxy)-; 1,2-propanediol, 3-(3-methyl-2-butyloxy)-; 1,2-propanediol, 3-(cyclohexyloxy)-; 1,2-propanediol, 3-(1-cyclohex-1-enyloxy)-; 1,3-propanediol, 2-(pentyloxy)-; 1,3-propanediol, 2-(2-pentyloxy)-; 1,3-propanediol, 2-(3-pentyloxy)-; 1,3-propanediol, 2-(2-methyl-1-butyloxy)-; 1,3-propanediol, 2-(iso-amyloxy)-; 1,3-propanediol, 2-(3-methyl-2-butyloxy)-; 1,3-propanediol, 2-(cyclohexyloxy)-; 1,3-propanediol, 2-(1-cyclohex-1-enyloxy)-; 1,2-propanediol, 3-(butyloxy)-, pentaethoxylated; 1,2-propanediol, 3-(butyloxy)-, hexaethoxylated; 1,2-propanediol, 3-(butyloxy)-, heptaethoxylated; 1,2-propanediol, 3-(butyloxy)-, octaethoxylated; 1,2-propanediol, 3-(butyloxy)-, nonaethoxylated; 1,2-propanediol, 3-(butyloxy)-, monopropoxylated; 1,2-propanediol, 3-(butyloxy)-, dibutyleneoxylated; and/or 1,2-propanediol, 3-(butyloxy)-, tributyleneoxylated. Preferred aromatic glyceryl ethers include: 1,2-propanediol, 3-phenyloxy-; 1,2-propanediol, 3-benzyloxy-; 1,2-propanediol, 3-(2-phenylethyloxy)-; 1,2-propanediol, 1,3-propanediol, 2-(m-cresyloxy)-; 1,3-propanediol, 2-(p-cresyloxy)-; 1,3-propanediol, 2-benzyloxy-; 1,3-propanediol, 2-(2-phenylethyloxy)-; and mixtures thereof. The more preferred aromatic glyceryl ethers include: 1,2-propanediol, 3-phenyloxy-; 1,2-propanediol, 3-benzyloxy-; 1,2-propanediol, 3-(2-phenylethyloxy)-; 1,2-propanediol, 1,3-propanediol, 2-(m-cresyloxy)-; 1,3-propanediol, 2-(p-cresyloxy)-; 1,3-propanediol, 2-(2-phenylethyloxy)-; and mixtures thereof. The most preferred di(hydroxyalkyl)ethers include: bis(2-hydroxybutyl)ether; and bis(2-hydroxycyclopentyl)ether;

An illustrative and non-limiting example of synthesis methods to prepare the preferred alkyl and aryl monoglyceryl ethers is given hereinafter.

The alicyclic diols and their derivatives that are preferred include: (1) the saturated diols and their derivatives including: 1-isopropyl-1,2-cyclobutanediol; 3-ethyl-4-methyl-1,2-cyclobutanediol; 3-propyl-1,2-cyclobutanediol; 3-isopropyl-1,2-cyclobutanediol; 1-ethyl-1,2-cyclopentanediol; 1,2-dimethyl-1,2-cyclopentanediol; 1,4-dimethyl-1,2-cyclopentanediol; 2,4,5-trimethyl-1,3-cyclopentanediol; 3,3-dimethyl-1,2-cyclopentanediol; 3,4-dimethyl-1,2-cyclopentanediol; 3,5-dimethyl-1,2-cyclopentanediol; 3-ethyl-1,2-cyclopentanediol; 4,4-dimethyl-1,2-cyclopentanediol; 4-ethyl-1,2-cyclopentanediol; 1,1-bis(hydroxymethyl)cyclohexane; 1,2-bis(hydroxymethyl)cyclohexane; 1,2-dimethyl-1,3-cyclohexanediol; 1,3-bis(hydroxymethyl)cyclohexane; 1,3-dimethyl-1,3-cyclohexanediol; 1,6-dimethyl-1,3-cyclohexanediol; 1-hydroxy-cyclohexaneethanol; 1-hydroxy-cyclohexanemethanol; 1-ethyl-1,3-cyclohexanediol; 1-methyl-1,2-cyclohexanediol; 2,2-dimethyl-1,3-cyclohexanediol; 2,3-dimethyl-1,4-cyclohexanediol; 2,4-dimethyl-1,3-cyclohexanediol; 2,5-dimethyl-1,3-cyclohexanediol; 2,6-dimethyl-1,4-cyclohexanediol; 2-ethyl-1,3-cyclohexanediol; 2-hydroxycyclohexaneethanol; 2-hydroxyethyl-1-cyclohexanol; 2-hydroxymethylcyclohexanol; 3-hydroxyethyl-1-cyclohexanol; 3-hydroxycyclohexaneethanol; 3-hydroxymethylcyclohexanol; 3-methyl-1,2-cyclohexanediol; 4,4-dimethyl-1,3-Cyclohexanediol; 4,5-dimethyl-1,3-cyclohexanediol; 4,6-dimethyl-1,3-cyclohexanediol; 4-ethyl-1,3-cyclohexanediol; 4-hydroxyethyl-1-cyclohexanol; 4-hydroxymethylcyclohexanol; 4-methyl-1,2-cyclohexanediol; 5,5-dimethyl-1,3-cyclohexanediol; 5-ethyl-1,3-cyclohexanediol; 1,2-cycloheptanediol; 2-methyl-1,3-cycloheptanediol; 2-methyl-1,4-cycloheptanediol; 4-methyl-1,3-cycloheptanediol; 5-methyl-1,3-cycloheptanediol; 5-methyl-1,4-cycloheptanediol; 6-methyl-1,4-cycloheptanediol; 1,3-cyclooctanediol; 1,4-cyclooctanediol; 1,5-cyclooctanediol;

1,2-cyclohexanediol, diethoxylate; 1,2-cyclohexanediol, triethoxylate; 1,2-cyclohexanediol, tetraethoxylate; 1,2-cyclohexanediol, pentaethoxylate; 1,2-cyclohexanediol, hexaethoxylate; 1,2-cyclohexanediol, heptaethoxylate; 1,2-cyclohexanediol, octaethoxylate; 1,2-cyclohexanediol, nonaethoxylate; 1,2-cyclohexanediol, monopropoxylate; 1,2-cyclohexanediol, monobutylenoxylate; 1,2-cyclohexanediol, dibutylenoxylate; and/or 1,2-cyclohexanediol, tributylenoxylate. The most preferred saturated alicyclic diols and their derivatives are: 1-isopropyl-1,2-cyclobutanediol; 3-ethyl-4-methyl-1,2-cyclobutanediol; 3-propyl-1,2-cyclobutanediol; 3-isopropyl-1,2-cyclobutanediol; 1-ethyl-1,2-cyclopentanediol; 1,2-dimethyl-1,2-cyclopentanediol; 1,4-dimethyl-1,2-cyclopentanediol; 3,3-dimethyl-1,2-cyclopentanediol; 3,4-dimethyl-1,2-cyclopentanediol; 3,5-dimethyl-1,2-cyclopentanediol; 3-ethyl-1,2-cyclopentanediol; 4,4-dimethyl-1,2-cyclopentanediol; 4-ethyl-1,2-cyclopentanediol; 1,1-bis(hydroxymethyl)cyclohexane; 1,2-bis(hydroxymethyl)cyclohexane; 1,2-dimethyl-1,3-cyclohexanediol; 1,3-bis(hydroxymethyl)cyclohexane; 1-hydroxycyclohexanemethanol; 1-methyl-1,2-cyclohexanediol; 3-hydroxymethylcyclohexanol; 3-methyl-1,2-cyclohexanediol; 4,4-dimethyl-1,3-cyclohexanediol; 4,5-dimethyl-1,3-cyclohexanediol; 4,6-dimethyl-1,3-cyclohexanediol; 4-ethyl-1,3-cyclohexanediol; 4-hydroxyethyl-1-cyclohexanol; 4-hydroxymethylcyclohexanol; 4-methyl-1,2-cyclohexanediol; 1,2-cycloheptanediol; 1,2-cyclohexanediol, pentaethoxylate; 1,2-cyclohexanediol, hexaethoxylate; 1,2-cyclohexanediol, heptaethoxylate; 1,2-cyclohexanediol, octaethoxylate; 1,2-cyclohexanediol, nonaethoxylate; 1,2-cyclohexanediol, monopropoxylate; and/or 1,2-cyclohexanediol, dibutylenoxylate.

Preferred aromatic diols include: 1-phenyl-1,2-ethanediol; 1-phenyl-1,2-propanediol; 2-phenyl-1,2-propanediol; 3-phenyl-1,2-propanediol; 1-(3-methylphenyl)-1,3-propanediol; 1-(4-methylphenyl)-1,3-propanediol; 2-methyl-1-phenyl-1,3-propanediol; 1-phenyl-1,3-butanediol; 3-phenyl-1,3-butanediol; and/or 1-phenyl-1,4-butanediol, of which, 1-phenyl-1,2-propanediol; 2-phenyl-1,2-propanediol; 3-phenyl-1,2-propanediol; 1-(3-methylphenyl)-1,3-propanediol; 1-(4-methylphenyl)-1,3-propanediol; 2-methyl-1-phenyl-1,3-propanediol; and/or 1-phenyl-1,4-butanediol are the most preferred.

As discussed hereinbefore, all of the unsaturated materials that are related to the other preferred principal solvents herein by the same relationship, i.e., having one more $CH_2$ group than the corresponding saturated principal solvent will also be preferred. However, the specific preferred unsaturated diol principal solvents are: 1,3-butanediol, 2,2-diallyl-; 1,3-butanediol, 2-(1-ethyl-1-propenyl)-; 1,3-butanediol, 2-(2-butenyl)-2-methyl-; 1,3-butanediol, 2-(3-methyl-2-butenyl)-; 1,3-butanediol, 2-ethyl-2-(2-propenyl)-; 1,3-butanediol, 2-methyl-2-(1-methyl-2-propenyl)-; 1,4-butanediol, 2,3-bis(1-methylethylidene)-; 1,3-pentanediol, 2-ethenyl-3-ethyl-; 1,3-pentanediol, 2-ethenyl-4,4-dimethyl-; 1,4-pentanediol, 3-methyl-2-(2-propenyl)-; 4-pentene-1,3-diol, 2-(1,1-dimethylethyl)-; 4-pentene-1,3-diol, 2-ethyl-2,3-dimethyl-; 1,4-hexanediol, 4-ethyl-2-methylene-; 1,5-hexadiene-3,4-diol, 2,3,5-trimethyl-; 1,5-hexanediol, 2-(1-methylethenyl)-; 2-hexene-1,5-diol, 4-ethenyl-2,5-dimethyl-; 1,4-heptanediol, 6-methyl-5-methylene-; 2,4-heptadiene-2,6-diol, 4,6-dimethyl-; 2,6-heptadiene-1,4-diol, 2,5,5-trimethyl-; 2-heptene-1,4-diol, 5,6-dimethyl-; 3-heptene-1,5-diol, 4,6-dimethyl-; 5-heptene-1,3-diol, 2,4-dimethyl-; 5-heptene-1,3-diol, 3,6-dimethyl-; 5-heptene-1,4-diol, 2,6-dimethyl-; 5-heptene-1,4-diol, 3,6-dimethyl-; 6-heptene-1,3-diol, 2,2-dimethyl-; 6-heptene-1,4-diol, 5,6-dimethyl-; 6-heptene-1,5-diol, 2,4-dimethyl-; 6-heptene-1,5-diol, 2-ethylidene-6-methyl-; 6-heptene-2,4-diol, 4-(2-propenyl)-; 1-octene-3,6-diol, 3-ethenyl-; 2,4,6-octadiene-1,8-diol, 2,7-dimethyl-; 2,5-octadiene-1,7-diol, 2,6-dimethyl-; 2,5-octadiene-1,7-diol, 3,7-dimethyl-; 2,6-octadiene-1,4-diol, 3,7-dimethyl-(Rosiridol); 2,6-octadiene-1,8-diol, 2-methyl-; 2,7-octadiene-1,4-diol, 3,7-dimethyl-; 2,7-octadiene-1,5-diol, 2,6-dimethyl-; 2,7-octadiene-1,6-diol, 2,6-dimethyl-(8-hydroxylinalool); 2,7-octadiene-1,6-diol, 2,7-dimethyl-; 2-octene-1,7-diol, 2-methyl-6-methylene-; 3,5-octadiene-2,7-diol, 2,7-dimethyl-; 3,5-octanediol, 4-methylene-; 3,7-octadiene-1,6-diol, 2,6-dimethyl-; 4-octene-1,8-diol, 2-methylene-; 6-octene-3,5-diol, 2-methyl-; 6-octene-3,5-diol, 4-methyl-; 7-octene-2,4-diol, 2-methyl-6-methylene-; 7-octene-2,5-diol, 7-methyl-; 7-octene-3,5-diol, 2-methyl-; 1-nonene-3,5-diol; 1-nonene-3,7-diol; 3-nonene-2,5-diol; 4-nonene-2,8-diol; 6,8-nonadiene-1,5-diol; 7-nonene-2,4-diol; 8-nonene-2,4-diol; 8-nonene-2,5-diol; 1,9-decadiene-3,8-diol; and/or 1,9-decadiene-4,6-diol.

Said principal alcohol solvent can also preferably be selected from the group consisting of: 2,5-dimethyl-2,5-hexanediol; 2-ethyl-1,3-hexanediol; 2-methyl-2-propyl-1,3-propanediol; 1,2-hexanediol; and mixtures thereof. More preferably said principal alcohol solvent is selected from the group consisting of 2-ethyl-1,3-hexanediol; 2-methyl-2-propyl-1,3-propanediol; 1,2-hexanediol; and mixtures thereof. Even more preferably, said principal alcohol solvent is selected from the groups consisting of 2-ethyl-1,3-hexanediol; 1,2-hexanediol; and mixtures thereof.

When several derivatives of the same diol with different alkyleneoxy groups can be used, e.g., 2-methyl-2,3-butanediol having 3 to 5 ethyleneoxy groups, or 2 propyleneoxy groups, or 1 butyleneoxy group, it is preferred to use the derivative with the lowest number of groups, i.e., in this case, the derivative with one butyleneoxy group. However, when only about one to about four ethyleneoxy groups are needed to provide good formulatability, such derivatives are also preferred.

UNSATURATED DIOLS

It is found surprisingly that there is a clear similarity between the acceptability (formulatability) of a saturated diol and its unsaturated homologs, or analogs, having higher molecular weights. The unsaturated homologs/analogs have the same formulatability as the parent saturated principal solvent with the condition that the unsaturated principal solvents have one additional methylene (viz., $CH_2$) group for each double bond in the chemical formula. In other words, there is an apparent "addition rule" in that for each good saturated principal solvent of this invention, which is suitable for the formulation of clear, concentrated fabric softener compositions, there are suitable unsaturated principal solvents where one, or more, $CH_2$ groups are added while, for each $CH_2$ group added, two hydrogen atoms are removed from adjacent carbon atoms in the molecule to form one carbon-carbon double bond, thus holding the number of hydrogen atoms in the molecule constant with respect to the chemical formula of the "parent" saturated principal solvent. This is due to a surprising fact that adding a —$CH_2$— group to a solvent chemical formula has an effect of increasing its ClogP value by about 0.53, while removing two adjacent hydrogen atoms to form a double bond has an effect of decreasing its ClogP value by about a similar amount, viz., about 0.48, thus about compensating for the —$CH_2$— addition. Therefore one goes from a preferred saturated principal solvent to the preferred higher molecular weight unsaturated analogs/homologs containing at least one more carbon atom by inserting one double bond for each additional $CH_2$ group, and thus the total number of hydrogen atoms is kept the same as in the parent saturated principal solvent, as long as the ClogP value of the new solvent remains within the effective 0.15–0.64 range. The following are some illustrative examples:

2,2-Dimethyl-6-heptene-1,3-diol (CAS No. 140192-39-8) is a preferred C9-diol principal solvent and can be considered to be derived by appropriately adding a $CH_2$ group and a double bond to either of the following preferred C8-diol principal solvents: 2-methyl-1,3-heptanediol or 2,2-dimethyl-1,3-hexanediol.

2,4-Dimethyl-5-heptene-1,3-diol (CAS No. 123363-69-9) is a preferred C9-diol principal solvent and can be considered to be derived by appropriately adding a $CH_2$ group and a double bond to either of the following preferred C8-diol principal solvents: 2-methyl-1,3-heptanediol or 2,4-dimethyl-1,3-hexanediol.

2-(1-Ethyl-1-propenyl)-1,3-butanediol (CAS No. 116103-35-6) is a preferred C9-diol principal solvent and can be considered to be derived by appropriately adding a $CH_2$ group and a double bond to either of the following preferred C8-diol principal solvents: 2-(1-ethylpropyl)-1,3-propanediol or 2-(1-methylpropyl)-1,3-butanediol.

2-Ethenyl-3-ethyl-1,3-pentanediol (CAS No. 104683-37-6) is a preferred C9-diol principal solvent and can be considered to be derived by appropriately adding a $CH_2$ group and a double bond to either of the following preferred C8-diol principal solvents: 3-ethyl-2-methyl-1,3-pentanediol or 2-ethyl-3-methyl-1,3-pentanediol.

3,6-Dimethyl-5-heptene-1,4-diol (e.g., CAS No. 106777-99-5) is a preferred C9-diol principal solvent and can be considered to be derived by appropriately adding a $CH_2$ group and a double bond to any of the following preferred C8-diol principal solvents: 3-methyl-1,4-heptanediol; 6-methyl-1,4-heptanediol; or 3,5-dimethyl-1,4-hexanediol.

5,6-Dimethyl-6-heptene-1,4-diol (e.g., CAS No. 152344-16-6) is a preferred C9-diol principal solvent and can be considered to be derived by appropriately adding a $CH_2$ group and a double bond to any of the following preferred C8-diol principal solvents: 5-methyl-1,4-heptanediol; 6-methyl-1,4-heptanediol; or 4,5-dimethyl-1,3-hexanediol.

4-Methyl-6-octene-3,5-diol (CAS No. 156414-25-4) is a preferred C9-diol principal solvent and can be considered to be derived by appropriately adding a $CH_2$ group and a double bond to any of the following preferred C8-diol principal solvents: 3,5-octanediol, 3-methyl-2,4-heptanediol or 4-methyl-3,5-heptanediol.

Rosiridol (CAS No. 101391-01-9) and isorosiridol (CAS No. 149252-15-3) are two isomers of 3,7-dimethyl-2,6-octadiene-1,4-diol, and are preferred C10-diol principal solvents. They can be considered to be derived by appropriately adding two $CH_2$ groups and two double bonds to any of the following preferred C8-diol principal solvents: 2-methyl-1,3-heptanediol; 6-methyl-1,3-heptanediol; 3-methyl-1,4-heptanediol; 6-methyl-1,4-heptanediol; 2,5-dimethyl-1,3-hexanediol; or 3,5-dimethyl-1,4-hexanediol.

8-Hydroxylinalool (CAS No. 103619-06-3, 2,6-dimethyl-2,7-octadiene-1,6-diol) is a preferred C10-diol principal solvent and can be considered to be derived by appropriately adding two $CH_2$ groups and two double bonds to any of the following preferred C8-diol principal solvents: 2-methyl-1,5-heptanediol; 5-methyl-1,5-heptanediol; 2-methyl-1,6-heptanediol; 6-methyl-1,6-heptanediol; or 2,4-dimethyl-1,4-hexanediol.

2,7-Dimethyl-3,7-octadiene-2,5-diol (CAS No. 171436-39-8) is a preferred C10-diol principal solvent and can be considered to be derived by appropriately adding two $CH_2$ group and two double bond to any of the following preferred C8-diol principal solvents: 2,5-octanediol; 6-methyl-1,4-heptanediol; 2-methyl-2,4-heptanediol; 6-methyl-2,4-heptanediol; 2-methyl-2,5-heptanediol; 6-methyl-2,5-heptanediol; and 2,5-dimethyl-2,4-hexanediol.

4-Butyl-2-butene-1,4-diol (CAS No. 153943-66-9) is a preferred C8-diol principal solvent and can be considered to be derived by appropriately adding a $CH_2$ group and a double bond to any of the following preferred C7-diol principal solvents: 2-propyl-1,4-butanediol or 2-butyl-1,3-propanediol.

By the same token, there are cases where a higher molecular weight unsaturated homolog which is derived from a poor, inoperable saturated solvent is itself a poor solvent. For example, 3,5-dimethyl-5-hexene-2,4-diol (e.g., CAS No. 160429-40-3) is a poor unsaturated C8 solvent, and can be considered to be derived from the following poor saturated C7 solvents: 3-methyl-2,4-hexanediol; 5-methyl-2,4-hexanediol; or 2,4-dimethyl-1,3-pentanediol; and 2,6-dimethyl-5-heptene-1,2-diol (e.g., CAS No. 141505-71-7) is a poor unsaturated C9 solvent, and can be considered to be derived from the following poor saturated C8 solvents: 2-methyl-1,2-heptanediol; 6-methyl-1,2-heptanediol; or 2,5-dimethyl-1,2-hexanediol.

It is also found, surprisingly, that there is an exception to the above addition rule, in which saturated principal solvents always have unsaturated analogs/homologs with the same degree of acceptability. The exception relates to saturated diol principal solvents having the two hydroxyl groups situated on two adjacent carbon atoms. In some cases, but not always, inserting one, or more, $CH_2$ groups between the two adjacent hydroxyl groups of a poor solvent results in a higher molecular weight unsaturated homolog which is more suitable for the clear, concentrated fabric softener formulation. For example, the preferred unsaturated 6,6-dimethyl-1-heptene-3,5-diol (CAS No. 109788-01-4) having no adjacent hydroxyl groups can be considered to be derived from the inoperable 2,2-dimethyl-3,4-hexanediol which has adjacent hydroxyl groups. In this case, it is more reliable to consider that the 6,6-dimethyl-1-heptene-3,5-diol is derived from either 2-methyl-3,5-heptanediol or 5,5-dimethyl-2,4-hexanediol which are both preferred principal solvents and do not have adjacent hydroxyl groups. Conversely, inserting $CH_2$ groups between the adjacent hydroxyl groups of a preferred principal solvent can result in an inoperable higher molecular weight unsaturated diol solvent. For example, the inoperable unsaturated 2,4-dimethyl-5-hexene-2,4-diol (CAS No. 87604-24-8) having no adjacent hydroxyl groups can be considered to be derived from the preferred 2,3-dimethyl-2,3-pentanediol which has adjacent hydroxyl groups. In this case, it is more reliably to derive the inoperable unsaturated 2,4-dimethyl-5-hexene-2,4-diol from either 2-methyl-2,4-hexanediol or 4-methyl-2,4-hexanediol which are both inoperable solvents and do not have adjacent hydroxyl groups. There are also cases where an inoperable unsaturated solvent having no adjacent hydroxyl groups can be considered to be derived from an inoperable solvent which has adjacent hydroxyl groups, such as the pair 4,5-dimethyl-6-hexene-1,3-diol and 3,4-dimethyl-1,2-pentanediol. Therefore, in order to deduce the formulatability of an unsaturated solvent having no adjacent hydroxyl groups, one should start from a low molecular weight saturated homolog also not having adjacent hydroxyl groups. I.e., in general, the relationship is more reliable when the distance/relationship of the two hydroxy groups is maintained. I.e., it is reliable to start from a saturated solvent with adjacent hydroxyl groups to deduce the formulatability of the higher molecular weight unsaturated homologs also having adjacent hydroxyl groups.

It has been discovered that the use of these specific principal alcohol solvents can produce clear, low viscosity, stable fabric softener compositions at surprisingly low principal solvent levels, i.e., less than about 40%, by weight of the composition. It has also been discovered that the use of the principal alcohol solvents can produce highly concentrated fabric softener compositions, that are stable and can be diluted, e.g. from about 2:1 to about 10:1, to produce compositions with lower levels of fabric softener that are still stable.

As previously discussed, the principal solvents are desirably kept to the lowest levels that are feasible in the present compositions for obtaining translucency or clarity. The presence of water exerts an important effect on the need for the principal solvents to achieve clarity of these compositions. The higher the water content, the higher the principal solvent level (relative to the softener level) is needed to attain product clarity. Inversely, the less the water content, the less principal solvent (relative to the softener) is needed. Thus, at low water levels of from about 5% to about 15%, the softener active-to-principal solvent weight ratio is preferably from about 55:45 to about 85:15, more preferably from about 60:40 to about 80:20. At water levels of from about 15% to about 70%, the softener active-to-principal solvent weight ratio is preferably from about 45:55 to about 70:30, more preferably from about 55:45 to about 70:30. But at high water levels of from about 70% to about 80%, the softener active-to-principal solvent weight ratio is preferably from about 30:70 to about 55:45, more preferably from about 35:65 to about 45:55. At even higher water levels, the softener to principal solvent ratios should also be even higher.

Mixtures of the above principal solvents are particularly preferred, since one of the problems associated with large amounts of solvents is safety. Mixtures decrease the amount of any one material that is present. Odor and flammability can also be mimimized by use of mixtures, especially when one of the principal solvents is volatile and/or has an odor, which is more likely for low molecular weight materials. Suitable solvents that can be used at levels that would not be sufficient to produce a clear product are 2,2,4-trimethyl-1,3-pentane diol; the ethoxylate, diethoxylate, or triethoxylate derivatives of 2,2,4-trimethyl-1,3-pentane diol; and/or 2-ethyl-1,3-hexanediol. For the purposes of this invention, these solvents should only be used at levels that will not provide a stable, or clear product. Preferred mixtures are those where the majority of the solvent is one, or more, that have been identified hereinbefore as most preferred. The use of mixtures of solvents is also preferred, especially when one, or more, of the preferred principal solvents are solid at room temperature. In this case, the mixtures are fluid, or have lower melting points, thus improving processability of the softener compositions.

It is also discovered that it is possible to substitute for part of a principal solvent or a mixture of principal solvents of this invention with a secondary solvent, or a mixture of secondary solvents, which by themselves are not operable as a principal solvent of this invention, as long as an effective amount of the operable principal solvent(s) of this invention is still present in the liquid concentrated, clear fabric softener composition. An effective amount of the principal solvent(s) of this invention is at least greater than about 5%, preferably more than about 7%, more preferably more than about 10% of the composition, when at least about 15% of the softener active is also present. The substitute solvent(s) can be used at any level, but preferably about equal to, or less than, the amount of operable principal solvent, as defined hereinbefore, that is present in the fabric softener composition.

For example, even though 1,2-pentanediol, 1,3-octanediol, and hydroxy pivalyl hydroxy pivalate (hereinafter, HPHP) having the following formula:

$$HO—CH_2—C(CH_3)_2—CH_2—O—CO—C(CH_3)_2—CH_2—OH$$
(CAS #1115-20-4)

are inoperable solvents according to this invention, mixtures of these solvents with the principal solvent, e.g., with the preferred 1,2-hexanediol principal solvent, wherein the 1,2-hexanediol principal solvent is present at effective levels, also provide liquid concentrated, clear fabric softener compositions.

Some of the secondary solvents that can be used are those listed as inoperable hereinbefore and hereinafter, as well as some parent, non-alkoxylated solvents disclosed in Tables VIIIA–VIIIE.

The principal solvent can be used to either make a composition translucent or clear, or can be used to reduce the temperature at which the composition is translucent or clear. Thus the invention also comprises the method of adding the principal solvent, at the previously indicated levels, to a composition that is not translucent, or clear, or which has a temperature where instability occurs that is too high, to make the composition translucent or clear, or, when the composition is clear, e.g., at ambient temperature, or down to a specific temperature, to reduce the temperature at which instability occurs, preferably by at least about 5° C., more preferably by at least about 10° C. The principal advantage of the principal solvent is that it provides the maximum advantage for a given weight of solvent. It is understood that "solvent", as used herein, refers to the effect of the principal solvent and not to its physical form at a given temperature, since some of the principal solvents are solids at ambient temperature.

Alkyl Lactates

Some alkyl lactate esters, e.g., ethyl lactate and isopropyl lactate have ClogP values within the effective range of from about 0.15 to about 0.64, and can form liquid concentrated, clear fabric softener compositions with the fabric softener actives of this invention, but need to be used at a slightly higher level than the more effective diol solvents like 1,2-hexanediol. They can also be used to substitute for part of other principal solvents of this invention to form liquid concentrated, clear fabric softener compositions. This is illustrated in Example I-C.

These principal solvents all provide the unobvious benefit described hereinbefore.

III. OPTIONAL INGREDIENTS (A) Low molecular weight water soluble solvents can also be used at levels of of from 0% to about 12%, preferably from about 1% to about 10%, more preferably from about 2% to about 8%. The water soluble solvents cannot provide a clear product at the same low levels of the principal solvents described hereinbefore but can provide clear product when the principal solvent is not sufficient to provide completely clear product. The presence of these water soluble solvents is therefore highly desirable. Such solvents include: ethanol; isopropanol; 1,2-propanediol; 1,3-propanediol; propylene carbonate; etc. but do not include any of the principal solvents (B). These water soluble solvents have a greater affinity for water in the presence of hydrophobic materials like the softener active than the principal solvents.

(B) Brighteners

The compositions herein can also optionally contain from about 0.005% to 5% by weight of certain types of hydrophilic optical brighteners which also provide a dye transfer inhibition action. If used, the compositions herein will preferably comprise from about 0.001% to 1% by weight of such optical brighteners.

The hydrophilic optical brighteners useful in the present invention are those having the structural formula:

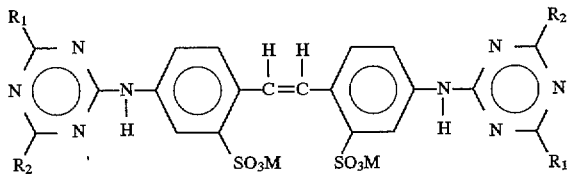

wherein $R_1$ is selected from anilino, N-2-bis-hydroxyethyl and NH-2-hydroxyethyl; $R_2$ is selected from N-2-bis-hydroxyethyl, N-2-hydroxyethyl-N-methylamino, morphilino, chloro and amino; and M is a salt-forming cation such as sodium or potassium.

When in the above formula, $R_1$ is anilino, $R_2$ is N-2-bis-hydroxyethyl and M is a cation such as sodium, the brightener is 4,4',-bis[(4-anilino-6-(N-2-bis-hydroxyethyl)-s-triazine-2-yl)amino]-2,2'-stilbenedisulfonic acid and disodium salt. This particular brightener species is commercially marketed under the tradename Tinopal-UNPA-GX® by Ciba-Geigy Corporation. Tinopal-UNPA-GX is the preferred hydrophilic optical brightener useful in the rinse added compositions herein.

When in the above formula, $R_1$ is anilino, $R_2$ is N-2-hydroxyethyl-N-2-methylamino and M is a cation such as sodium, the brightener is 4,4'-bis[(4-anilino-6-(N-2-hydroxyethyl-N-methylamino)-s-triazine-2-yl)amino]2,2'-stilbenedisulfonic acid disodium salt. This particular brightener species is commercially marketed under the tradename Tinopal 5BM-GX® by Ciba-Geigy Corporation.

When in the above formula, $R_1$ is anilino, $R_2$ is morphilino and M is a cation such as sodium, the brightener is 4,4'-bis[(4-anilino-6-morphilino-s-triazine-2-yl)amino]2,2'-stilbenedisulfonic acid, sodium salt. This particular brightener species is commercially marketed under the tradename Tinopal AMS-GX® by Ciba Geigy Corporation.

(C) Dispersibility Aids (J) Optional Viscosity/Dispersibility Modifiers

Relatively concentrated compositions containing both saturated and unsaturated diester quaternary ammonium compounds can be prepared that are stable without the addition of concentration aids. However, the compositions of the present invention may require organic and/or inorganic concentration aids to go to even higher concentrations and/or to meet higher stability standards depending on the other ingredients. These concentration aids which typically can be viscosity modifiers may be needed, or preferred, for ensuring stability under extreme conditions when particular softener active levels are used. The surfactant concentration aids are typically selected from the group consisting of (1) single long chain alkyl cationic surfactants; (2) nonionic surfactants; (3) amine oxides; (4) fatty acids; and (5) mixtures thereof. These aids are described in P&G Copending Application Ser. No. 08/461,207, filed Jun. 5, 1995, Wahl et al., specifically on page 14, line 12 to page 20, line 12, which is herein incorporated by reference.

When said dispersibility aids are present , the total level is from about 2% to about 25%, preferably from about 3% to about 17%, more preferably from about 4% to about 15%, and even more preferably from 5% to about 13% by weight of the composition. These materials can either be added as part of the active softener raw material, (I), e.g., the mono-long chain alkyl cationic surfactant and/or the fatty acid which are reactants used to form the biodegradable fabric softener active as discussed hereinbefore, or added as a separate component. The total level of dispersibility aid includes any amount that may be present as part of component (I).

(1) Mono-Alkyl Cationic Quaternary Ammonium Compound

When the mono-alkyl cationic quaternary ammonium compound is present, it is typically present at a level of from about 2% to about 25%, preferably from about 3% to about 17%, more preferably from about 4% to about 15%, and even more preferably from 5% to about 13% by weight of the composition, the total mono-alkyl cationic quaternary ammonium compound being at least at an effective level.

Such mono-alkyl cationic quaternary ammonium compounds useful in the present invention are, preferably, quaternary ammonium salts of the general formula:

$$[R^4N^+(R^5)_3]X^-$$

wherein $R^4$ is $C_8$–$C_{22}$ alkyl or alkenyl group, preferably $C_{10}$–$C_{18}$ alkyl or alkenyl group; more preferably $C_{10}$–$C_{14}$ or $C_{16}$–$C_{18}$ alkyl or alkenyl group;

each $R^5$ is a $C_1$–$C_6$ alkyl or substituted alkyl group (e.g., hydroxy alkyl), preferably $C_1$–$C_3$ alkyl group, e.g., methyl (most preferred), ethyl, propyl, and the like, a benzyl group, hydrogen, a polyethoxylated chain with from about 2 to about 20 oxyethylene units, preferably from about 2.5 to about 13 oxyethylene units, more preferably from about 3 to about 10 oxyethylene units, and mixtures thereof; and $X^-$ is as defined hereinbefore for (Formula (I)).

Especially preferred dispersibility aids are monolauryl trimethyl ammonium chloride and monotallow trimethyl ammonium chloride available from Witco under the trade name Varisoft® 471 and monooleyl trimethyl ammonium chloride available from Witco under the tradename Varisoft®417.

The $R^4$ group can also be attached to the cationic nitrogen atom through a group containing one, or more, ester, amide, ether, amine, etc., linking groups which can be desirable for increased concentratability of component (I), etc. Such linking groups are preferably within from about one to about three carbon atoms of the nitrogen atom.

Mono-alkyl cationic quaternary ammonium compounds also include $C_8$–$C_{22}$ alkyl choline esters. The preferred dispersibility aids of this type have the formula:

$$R^1C(O)—O—CH_2CH_2N^+(R)_3X^-$$

wherein $R^1$, R and $X^-$ are as defined previously.

Highly preferred dispersibility aids include $C_{12}$–$C_{14}$ coco choline ester and $C_{16}$–$C_{18}$ tallow choline ester.

Suitable biodegradable single-long-chain alkyl dispersibility aids containing an ester linkage in the long chains are described in U.S. Pat. No. 4,840,738, Hardy and Walley, issued Jun. 20, 1989, said patent being incorporated herein by reference.

When the dispersibility aid comprises alkyl choline esters, preferably the compositions also contain a small amount, preferably from about 2% to about 5% by weight of the composition, of organic acid. Organic acids are described in European Patent Application No. 404,471, Machin et al., published on Dec. 27, 1990, supra, which is herein incorporated by reference. Preferably the organic acid is selected from the group consisting of glycolic acid, acetic acid, citric acid, and mixtures thereof.

Ethoxylated quaternary ammonium compounds which can serve as the dispersibility aid include ethylbis (polyethoxy ethanol)alkylammonium ethyl-sulfate with 17 moles of ethylene oxide, available under the trade name Variquat® 66 from Sherex Chemical Company; polyethylene glycol (15) oleammonium chloride, available under the trade name Ethoquad® 0/25 from Akzo; and polyethylene glycol (15) cocomonium chloride, available under the trade name Ethoquad® C/25 from Akzo.

Although the main function of the dispersibility aid is to increase the dispersibility of the ester softener, preferably the dispersibility aids of the present invention also have some softening properties to boost softening performance of the composition. Therefore, preferably the compositions of the present invention are essentially free of non-nitrogenous ethoxylated nonionic dispersibility aids which will decrease the overall softening performance of the compositions.

Also, quaternary compounds having only a single long alkyl chain, can protect the cationic softener from interacting with anionic surfactants and/or detergent builders that are carried over into the rinse from the wash solution.

(2) Amine Oxides

Suitable amine oxides include those with one alkyl or hydroxyalkyl moiety of about 8 to about 22 carbon atoms, preferably from about 10 to about 18 carbon atoms, more preferably from about 8 to about 14 carbon atoms, and two alkyl moieties selected from the group consisting of alkyl groups and hydroxyalkyl groups with about 1 to about 3 carbon atoms.

Examples include dimethyloctylamine oxide, diethyldecylamine oxide, bis-(2-hydroxyethyl)dodecyl-amine oxide, dimethyldodecylamine oxide, dipropyltetradecylamine oxide, methylethylhexadecylamine oxide, dimethyl-2-hydroxyoctadecylamine oxide, and coconut fatty alkyl dimethylamine oxide.

(D) Stabilizers

Stabilizers can be present in the compositions of the present invention. The term "stabilizer," as used herein, includes antioxidants and reductive agents. These agents are present at a level of from 0% to about 2%, preferably from about 0.01% to about 0.2%, more preferably from about 0.035% to about 0.1% for antioxidants, and more preferably from about 0.01% to about 0.2% for reductive agents. These assure good odor stability under long term storage conditions. Antioxidants and reductive agent stabilizers are especially critical for unscented or low scent products (no or low perfume).

Examples of antioxidants that can be added to the compositions of this invention include a mixture of ascorbic acid, ascorbic palmitate, propyl gallate, available from Eastman Chemical Products, Inc., under the trade names Tenox® PG and Tenox® S-1; a mixture of BHT (butylated hydroxytoluene), BHA (butylated hydroxyanisole), propyl gallate, and citric acid, available from Eastman Chemical Products, Inc., under the trade name Tenox®-6; butylated hydroxytoluene, available from UOP Process Division under the trade name Sustane® BHT; tertiary butylhydroquinone, Eastman Chemical Products, Inc., as Tenox® TBHQ; natural tocopherols, Eastman Chemical Products, Inc., as Tenox® GT-1/GT-2; and butylated hydroxyanisole, Eastman Chemical Products, Inc., as BHA; long chain esters ($C_8$–$C_{22}$) of gallic acid, e.g., dodecyl gallate; Irganox® 1010; Irganox® 1035; Irganox® B 1171; Irganox® 1425; Irganox® 3114; Irganox® 3125; and mixtures thereof; preferably Irganox® 3125, Irganox® 1425, Irganox® 3114, and mixtures thereof; more preferably Irganox® 3125 alone or mixed with citric acid and/or other chelators such as isopropyl citrate, Dequest® 2010, available from Monsanto with a chemical name of 1-hydroxyethylidene-1,1-diphosphonic acid (etidronic acid), and Tiron®, available from Kodak with a chemical name of 4,5-dihydroxy-m-benzenesulfonic acid/sodium salt, and DTPA®, available from Aldrich with a chemical name of diethylenetriaminepentaacetic acid.

The chemical names and CAS numbers for some of the above stabilizers which can be used in the compositions of the present invention are listed in Table I below.

(E) Soil Release Agent

In the present invention, an optional soil release agent can be added. The addition of the soil release agent can occur in combination with the premix, in combination with the acid/water seat, before or after electrolyte addition, or after the final composition is made. The softening composition prepared by the process of the present invention herein can contain from 0% to about 10%, preferably from 0.2% to about 5%, of a soil release agent. Preferably, such a soil release agent is a polymer. Polymeric soil release agents useful in the present invention include copolymeric blocks of terephthalate and polyethylene oxide or polypropylene oxide, and the like.

A preferred soil release agent is a copolymer having blocks of terephthalate and polyethylene oxide. More specifically, these polymers are comprised of repeating units of ethylene terephthalate and polyethylene oxide terephthalate at a molar ratio of ethylene terephthalate units to polyethylene oxide terephthalate units of from 25:75 to about 35:65, said polyethylene oxide terephthalate containing polyethylene oxide blocks having molecular weights of from about 300 to about 2000. The molecular weight of this polymeric soil release agent is in the range of from about 5,000 to about 55,000.

Another preferred polymeric soil release agent is a crystallizable polyester with repeat units of ethylene terephthalate units containing from about 10% to about 15% by weight of ethylene terephthalate units together with from about 10% to about 50% by weight of polyoxyethylene terephthalate units, derived from a polyoxyethylene glycol of average molecular weight of from about 300 to about 6,000, and the molar ratio of ethylene terephthalate units to polyoxyethylene terephthalate units in the crystallizable polymeric compound is between 2:1 and 6:1. Examples of this polymer include the commercially available materials Zelcon 4780 ® (from Dupont) and Milease T® (from ICI).

Highly preferred soil release agents are polymers of the generic formula:

$$X-(OCH_2CH_2)_p(O-\overset{O}{\overset{\|}{C}}-R^{14}-\overset{O}{\overset{\|}{C}}-OR^{15})_u(O-\overset{O}{\overset{\|}{C}}-R^{14}-\overset{O}{\overset{\|}{OC}}-O)(CH_2CH_2O)_n-X$$

in which each X can be a suitable capping group, with each X typically being selected from the group consisting of H, and alkyl or acyl groups containing from about 1 to about 4 carbon atoms. p is selected for water solubility and generally is from about 6 to about 113, preferably from about 20 to about 50. u is critical to formulation in a liquid composition having a relatively high ionic strength. There should be very little material in which u is greater than 10. Furthermore, there should be at least 20%, preferably at least 40%, of material in which u ranges from about 3 to about 5.

The $R^{14}$ moieties are essentially 1,4-phenylene moieties. As used herein, the term "the $R^{14}$ moieties are essentially 1,4-phenylene moieties" refers to compounds where the $R^{14}$ moieties consist entirely of 1,4-phenylene moieties, or are partially substituted with other arylene or alkarylene moieties, alkylene moieties, alkenylene moieties, or mixtures thereof. Arylene and alkarylene moieties which can be partially substituted for 1,4-phenylene include 1,3-phenylene, 1,2-phenylene, 1,8-naphthylene, 1,4-naphthylene, 2,2-biphenylene, 4,4-biphenylene, and mixtures thereof. Alkylene and alkenylene moieties which can be partially substituted include 1,2-propylene, 1,4-butylene, 1,5-pentylene, 1,6-hexamethylene, 1,7-heptamethylene, 1,8-octamethylene, 1,4-cyclohexylene, and mixtures thereof.

For the $R^{14}$ moieties, the degree of partial substitution with moieties other than 1,4-phenylene should be such that the soil release properties of the compound are not adversely affected to any great extent. Generally the degree of partial substitution which can be tolerated will depend upon the backbone length of the compound, i.e., longer backbones can have greater partial substitution for 1,4-phenylene moieties. Usually, compounds where the $R^{14}$ comprise from about 50% to about 100% 1,4-phenylene moieties (from 0% to about 50% moieties other than 1,4-phenylene) have adequate soil release activity. For example, polyesters made according to the present invention with a 40:60 mole ratio of isophthalic (1,3-phenylene) to terephthalic (1,4-phenylene) acid have adequate soil release activity. However, because most polyesters used in fiber making comprise ethylene terephthalate units, it is usually desirable to minimize the degree of partial substitution with moieties other than 1,4-phenylene for best soil release activity. Preferably, the $R^{14}$ moieties consist entirely of (i.e., comprise 100%) 1,4-phenylene moieties, i.e., each $R^{14}$ moiety is 1,4-phenylene.

For the $R^{15}$ moieties, suitable ethylene or substituted ethylene moieties include ethylene, 1,2-propylene, 1,2-butylene, 1,2-hexylene, 3-methoxy-1,2-propylene, and mixtures thereof. Preferably, the $R^{15}$ moieties are essentially ethylene moieties, 1,2-propylene moieties, or mixtures thereof. Inclusion of a greater percentage of ethylene moieties tends to improve the soil release activity of compounds. Surprisingly, inclusion of a greater percentage of 1,2-propylene moieties tends to improve the water solubility of compounds.

Therefore, the use of 1,2-propylene moieties or a similar branched equivalent is desirable for incorporation of any substantial part of the soil release component in the liquid fabric softener compositions. Preferably, from about 75% to about 100%, are 1,2-propylene moieties.

The value for each p is at least about 6, and preferably is at least about 10. The value for each n usually ranges from about 12 to about 113. Typically the value for each p is in the range of from about 12 to about 43.

A more complete disclosure of soil release agents is contained in U.S. Pat. Nos.: 4,661,267, Decker, Konig, Straathof, and Gosselink, issued Apr. 28, 1987; U.S. Pat. No. 4,711,730, Gosselink and Diehl, issued Dec. 8, 1987; U.S. Pat. No. 4,749,596, Evans, Huntington, Stewart, Wolf, and Zimmerer, issued Jun. 7, 1988; U.S. Pat. No. 4,818,569, Trinh, Gosselink, and Rattinger, issued Apr. 4, 1989; U.S. Pat. No. 4,877,896, Maldonado, Trinh, and Gosselink, issued Oct. 31, 1989; U.S. Pat. No. 4,956,447, Gosselink et al., issues Sep. 11, 1990; and U.S. Pat. No. 4,976,879, Maldonado, Trinh, and Gosselink, issued Dec. 11, 1990, all of said patents being incorporated herein by reference.

These soil release agents can also act as scum dispersants.

(F) Scum Dispersant

In the present invention, the premix can be combined with an optional scum dispersant, other than the soil release agent, and heated to a temperature at or above the melting point(s) of the components.

The preferred scum dispersants herein are formed by highly ethoxylating hydrophobic materials. The hydrophobic material can be a fatty alcohol, fatty acid, fatty amine, fatty acid amide, amine oxide, quaternary ammonium compound, or the hydrophobic moieties used to form soil release polymers. The preferred scum dispersants are highly ethoxylated, e.g., more than about 17, preferably more than about 25, more preferably more than about 40, moles of ethylene oxide per molecule on the average, with the polyethylene oxide portion being from about 76% to about 97%, preferably from about 81% to about 94%, of the total molecular weight.

The level of scum dispersant is sufficient to keep the scum at an acceptable, preferably unnoticeable to the consumer, level under the conditions of use, but not enough to adversely affect softening. For some purposes it is desirable that the scum is nonexistent. Depending on the amount of anionic or nonionic detergent, etc., used in the wash cycle of a typical laundering process, the efficiency of the rinsing steps prior to the introduction of the compositions herein, and the water hardness, the amount of anionic or nonionic detergent surfactant and detergency builder (especially phosphates and zeolites) entrapped in the fabric (laundry) will vary. Normally, the minimum amount of scum dispersant should be used to avoid adversely affecting softening properties. Typically scum dispersion requires at least about 2%, preferably at least about 4% (at least 6% and preferably at least 10% for maximum scum avoidance) based upon the level of softener active. However, at levels of about 10% (relative to the softener material) or more, one risks loss of softening efficacy of the product especially when the fabrics contain high proportions of nonionic surfactant which has been absorbed during the washing operation.

Preferred scum dispersants are: Brij 700®; Varonic U-250®; Genapol T-500®; Genapol T-800®; Plurafac A-79®; and Neodol 25-50®.

(G) Bactericides

Examples of bactericides used in the compositions of this invention include glutaraldehyde, formaldehyde, 2-bromo-2-nitro-propane-1,3-diol sold by Inolex Chemicals, located in Philadelphia, Pa., under the trade name Bronopol®, and a mixture of 5-chloro-2-methyl-4-isothiazoline-3-one and 2-methyl-4-isothiazoline-3-one sold by Rohm and Haas Company under the trade name Kathon about 1 to about 1,000 ppm by weight of the agent.

(H) Perfume

The present invention can contain any softener compatible perfume. Suitable perfumes are disclosed in U.S. Pat. No. 5,500,138, Bacon et al., issued Mar. 19, 1996, said patent being incorporated herein by reference.

As used herein, perfume includes fragrant substance or mixture of substances including natural (i.e., obtained by extraction of flowers, herbs, leaves, roots, barks, wood, blossoms or plants), artificial (i.e., a mixture of different nature oils or oil constituents) and synthetic (i.e., synthetically produced) odoriferous substances. Such materials are often accompanied by auxiliary materials, such as fixatives, extenders, stabilizers and solvents.

These auxiliaries are also included within the meaning of "perfume", as used herein. Typically, perfumes are complex mixtures of a plurality of organic compounds.

Examples of perfume ingredients useful in the perfumes of the present invention compositions include, but are not limited to, hexyl cinnamic aldehyde; amyl cinnamic aldehyde; amyl salicylate; hexyl salicylate; terpineol; 3,7-dimethyl-cis-2,6-octadien-1-ol; 2,6-dimethyl-2-octanol; 2,6-dimethyl-7-octen-2-ol; 3,7-dimethyl-3-octanol; 3,7-dimethyl-trans-2,6-octadien-1-ol; 3,7-dimethyl-6-octen-1-ol; 3,7-dimethyl-1-octanol; 2-methyl-3-(para-tert-butylphenyl)-propionaldehyde; 4-(4-hydroxy-4-methylpentyl)-3-cyclohexene-1-carboxaldehyde; tricyclodecenyl propionate; tricyclodecenyl acetate; anisaldehyde; 2-methyl-2-(para-iso-propylphenyl)-propionaldehyde; ethyl-3-methyl-3-phenyl glycidate; 4-(para-hydroxyphenyl)-butan-2-one; 1-(2,6,6-trimethyl-2-cyclohexen-1-yl)-2-buten-1-one; para-methoxyacetophenone; para-methoxy-alpha-phenylpropene; methyl-2-n-hexyl-3-oxo-cyclopentane carboxylate; undecalactone gamma.

Additional examples of fragrance materials include, but are not limited to, orange oil; lemon oil; grapefruit oil; bergamot oil; clove oil; dodecalactone gamma; methyl-2-(2-pentyl-3-oxo-cyclopentyl) acetate; beta-naphthol methyl-ether; methyl-beta-naphthylketone; coumarin; decylaldehyde; benzaldehyde; 4-tert-butylcyclohexyl acetate; alpha, alpha-dimethylphenethyl acetate; methylphenylcarbinyl acetate; Schiff's base of 4-(4-hydroxy-4-methylpentyl)-3-cyclohexene-1-carboxaldehyde and methyl anthranilate; cyclic ethyleneglycol diester of tridecandioic acid; 3,7-dimethyl-2,6-octadiene-1-nitrile; ionone gamma methyl; ionone alpha; ionone beta; petitgrain; methyl cedrylone; 7-acetyl-1,2,3,4,5,6,7,8-octahydro-1,1,6,7-tetramethyl-naphthalene; ionone methyl; methyl-1,6,10-trimethyl-2,5,9-cyclododecatrien-1-yl ketone; 7-acetyl-1,1,3,4,4,6-hexamethyl tetralin; 4-acetyl-6-tert-butyl-1,1-dimethyl indane; benzophenone; 6-acetyl-1,1,2,3,3,5-hexamethyl indane; 5-acetyl-3-isopropyl-1,1,2,6-tetramethyl indane; 1-dodecanal; 7-hydroxy-3,7-dimethyl octanal; 10-undecen-1-al; iso-hexenyl cyclohexyl carboxaldehyde; formyl tricyclodecan; cyclopentadecanolide; 16-hydroxy-9-hexadecenoic acid lactone; 1,3,4,6,7,8-hexahydro-4,6,6,7,8,8-hexamethylcyclopenta-gamma-2-benzopyrane; ambroxane; dodecahydro-3a,6,6,9a-tetramethylnaphtho-[2,1b]furan; cedrol; 5-(2,2,3-trimethylcyclopent-3-enyl)-3-methylpentan-2-ol; 2-ethyl-4-(2,2,3-trimethyl-3-cyclopenten-1-yl)-2-buten-1-ol; caryophyllene alcohol; cedryl acetate; para-tert-butylcyclohexyl acetate; patchouli; olibanum resinoid; labdanum; vetivert; copaiba balsam; fir balsam; and condensation products of: hydroxycitronellal and methyl anthranilate; hydroxycitronellal and indol; phenyl acetaldehyde and indol; 4-(4-hydroxy-4-methyl pentyl)-3-cyclohexene-1-carboxaldehyde and methyl anthranilate.

More examples of perfume components are geraniol; geranyl acetate; linalool; linalyl acetate; tetrahydrolinalool; citronellol; citronellyl acetate; dihydromyrcenol; dihydromyrcenyl acetate; tetrahydromyrcenol; terpinyl acetate; nopol; nopyl acetate; 2-phenylethanol; 2-phenylethyl acetate; benzyl alcohol; benzyl acetate; benzyl salicylate; benzyl benzoate; styrallyl acetate; dimethylbenzylcarbinol; trichloromethylphenylcarbinyl methylphenylcarbinyl acetate; isononyl acetate; vetiveryl acetate; vetiverol; 2-methyl-3-(p-tert-butylphenyl)-propanal; 2-methyl-3-(p-isopropylphenyl)-propanal; 3-(p-tert-butylphenyl)-propanal; 4-(4-methyl-3-pentenyl)-3-cyclohexenecarbaldehyde; 4-acetoxy-3-pentyltetrahydropyran; methyl dihydrojasmonate; 2-n-heptylcyclopentanone; 3-methyl-2-pentyl-cyclopentanone; n-decanal; n-dodecanal; 9-decenol-1; phenoxyethyl isobutyrate; phenylacetaldehyde dimethylacetal; phenylacetaldehyde diethylacetal; geranonitrile; citronellonitrile; cedryl acetal; 3-isocamphylcyclohexanol; cedryl methylether; isolongifolanone; aubepine nitrile; aubepine; heliotropine; eugenol; vanillin; diphenyl oxide; hydroxycitronellal ionones; methyl ionones; isomethyl ionomes; irones; cis-3-hexenol and esters thereof; indane musk fragrances; tetralin musk fragrances; isochroman musk fragrances; macrocyclic ketones; macrolactone musk fragrances; ethylene brassylate.

The perfumes useful in the present invention compositions are substantially free of halogenated materials and nitromusks.

Suitable solvents, diluents or carriers for perfumes ingredients mentioned above are for examples, ethanol, isopropanol, diethylene glycol, monoethyl ether, dipropylene glycol, diethyl phthalate, triethyl citrate, etc. The amount of such solvents, diluents or carriers incorporated in the perfumes is preferably kept to the minimum needed to provide a homogeneous perfume solution.

Perfume can be present at a level of from 0% to about 10%, preferably from about 0.1% to about 5%, and more preferably from about 0.2% to about 3%, by weight of the finished composition. Fabric softener compositions of the present invention provide improved fabric perfume deposition.

(I) Chelating Agents

The compositions and processes herein can optionally employ one or more copper and/or nickel chelating agents ("chelators"). Such water-soluble chelating agents can be selected from the group consisting of amino carboxylates, amino phosphonates, polyfunctionally-substituted aromatic chelating agents and mixtures thereof, all as hereinafter defined. The whiteness and/or brightness of fabrics are substantially improved or restored by such chelating agents and the stability of the materials in the compositions are improved.

Amino carboxylates useful as chelating agents herein include ethylenediaminetetraacetates (EDTA), N-hydroxyethylethylenediaminetriacetates, nitrilotriacetates (NTA), ethylenediamine tetraproprionates, ethylenediamine-N,N'-diglutamates, 2-hyroxypropylenediamine-N,N'-disuccinates, triethylenetetraaminehexacetates, diethylenetriaminepentaacetates (DETPA), and ethanoldiglycines, including their water-soluble salts such as the alkali metal, ammonium, and substituted ammonium salts thereof and mixtures thereof.

Amino phosphonates are also suitable for use as chelating agents in the compositions of the invention when at least low levels of total phosphorus are permitted in detergent compositions, and include ethylenediaminetetrakis (methylenephosphonates), diethylenetriamine-N,N,N',N", N"-pentakis(methane phosphonate) (DETMP) and 1-hydroxyethane-1,1-diphosphonate (HEDP). Preferably, these amino phosphonates to not contain alkyl or alkenyl groups with more than about 6 carbon atoms.

The chelating agents are typically used in the present rinse process at levels from about 2 ppm to about 25 ppm, for periods from 1 minute up to several hours' soaking.

The preferred EDDS chelator used herein (also known as ethylenediamine-N,N'-disuccinate) is the material described in U.S. Pat. No. 4,704,233, cited hereinabove, and has the formula (shown in free acid form):

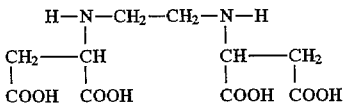

As disclosed in the patent, EDDS can be prepared using maleic anhydride and ethylenediamine. The preferred biodegradable [S,S] isomer of EDDS can be prepared by reacting L-aspartic acid with 1,2-dibromoethane. The EDDS has advantages over other chelators in that it is effective for chelating both copper and nickel cations, is available in a biodegradable form, and does not contain phosphorus. The EDDS employed herein as a chelator is typically in its salt form, i.e., wherein one or more of the four acidic hydrogens are replaced by a water-soluble cation M, such as sodium, potassium, ammonium, triethanolammonium, and the like. As noted before, the EDDS chelator is also typically used in the present rinse process at levels from about 2 ppm to about 25 ppm for periods from 1 minute up to several hours' soaking. At certain pH's the EDDS is preferably used in combination with zinc cations.

As can be seen from the foregoing, a wide variety of chelators can be used herein. Indeed, simple polycarboxylates such as citrate, oxydisuccinate, and the like, can also be used, although such chelators are not as effective as the amino carboxylates and phosphonates, on a weight basis. Accordingly, usage levels may be adjusted to take into account differing degrees of chelating effectiveness. The chelators herein will preferably have a stability constant (of the fully ionized chelator) for copper ions of at least about 5, preferably at least about 7. Typically, the chelators will comprise from about 0.5% to about 10%, more preferably from about 0.75% to about 5%, by weight of the compositions herein. Preferred chelators include DETMP, DETPA, NTA, EDDS and mixtures thereof.

(J) Other Optional Ingredients

The present invention can include optional components conventionally used in textile treatment compositions, for example: colorants; preservatives; surfactants; anti-shrinkage agents; fabric crisping agents; spotting agents; germicides; fungicides; anti-oxidants such as butylated hydroxy toluene, anti-corrosion agents, and the like.

Particularly preferred ingredients include water soluble calcium and/or magnesium compounds, which provide additional stability. The chloride salts are preferred, but acetate, nitrate, etc. salts can be used. The level of said calcium and/or magnesium salts is from 0% to about 2%, preferably from about 0.05% to about 0.5%, more preferably from about 0.1% to about 0.25%.

The present invention can also include other compatible ingredients, including those as disclosed in copending applications Ser. Nos.: 08/372,068, filed Jan. 12, 1995, Rusche, et al.; U.S. Pat. No. 08/372,490, filed Jan. 12, 1995, Shaw, et al.; and U.S. Pat. No. 08/277,558, filed Jul. 19, 1994, Hartman, et al., incorporated herein by reference.

Solid Compositions

1. Solid particulate compositions

As discussed hereinbefore, the invention also comprises solid particulate composition comprising:

(A) from about 50% to about 95%, preferably from about 60% to about 90%, of said biodegradable fabric softening active;

(B) optionally, from 0% to about 30%, preferably from about 3% to about 15%, of dispersibility modifier; and (D) from 0% to about 10% of a pH modifier.

Optional pH Modifier

Since the biodegradable ester fabric softener actives are somewhat labile to hydrolysis , it is preferable to include optional pH modifiers in the solid particulate composition to which water is to be added, to form stable dilute or concentrated liquid softener compositions. Said stable liquid compositions should have a pH (neat) of from about 2 to about 5, preferably from about 2 to about 4.5, more preferably from about 2 to about 4.

The pH can be adjusted by incorporating a solid, water soluble Bronsted acid. Examples of suitable Bronsted acids include inorganic mineral acids, such as boric acid, sodium bisulfate, potassium bisulfate, sodium phosphate monobasic, potassium phosphate monobasic, and mixtures thereof; organic acids, such as citric acid, fumaric acid, maleic acid, malic acid, tannic acid, gluconic acid, glutamic acid, tartaric acid, glycolic acid, chloroacetic acid, phenoxyacetic acid, 1,2,3,4-butane tetracarboxylic acid, benzene sulfonic acid, benzene phosphonic acid, ortho-toluene sulfonic acid, para-toluene sulfonic acid, phenol sulfonic acid, naphthalene sulfonic acid, oxalic acid, 1,2,4,5-pyromellitic acid, 1,2,4-trimellitic acid, adipic acid, benzoic acid, phenylacetic acid, salicylic acid, succinic acid, and mixtures thereof; and mixtures of mineral inorganic acids and organic acids. Preferred pH modifiers are citric acid, gluconic acid, tartaric acid, 1,2,3,4-butane tetracarboxylic acid, malic acid, and mixtures thereof.

Optionally, materials that can form solid clathrates such as cyclodextrins and/or zeolites, etc., can be used as adjuvants in the solid particulate composition as host carriers of concentrated liquid acids and/or anhydrides, such as acetic acid, HCl, sulfuric acid, phosphoric acid, nitric acid, carbonic acid, etc. An example of such solid clatherates is carbon dioxide adsorbed in zeolite A, as disclosed in U.S. Pat. No. 3,888,998, Whyte and Samps, issued Jun. 10, 1975 and U.S. Pat. No. 4,007,134, Liepe and Japikse, issued Feb. 8, 1977, both of said patents being incorporated herein by reference. Examples of inclusion complexes of phosphoric acid, sulfuric acid, and nitric acid, and process for their preparation are disclosed in U.S. Pat. No. 4,365,061, issued Dec. 21, 1982 to Szejtli et al., said patent being incorporated herein by reference.

When used, the pH modifier is typically used at a level of from about 0.01% to about 10%, preferably from about 0.1% to about 5%, by weight of the composition.

Preparation of Solid Particulate Granular Fabric Softener

The granules can be formed by preparing a melt, solidifying it by cooling, and then grinding and sieving to the desired size. In a three-component mixture e.g., nonionic surfactant, single-long-chain cationic, and DEQA, it is more preferred, when forming the granules, to pre-mix the nonionic surfactant and the more soluble single-long-chain alkyl cationic compound before mixing in a melt of the diester quaternary ammonium cationic compound.

It is highly preferred that the primary particles of the granules have a diameter of from about 50 to about 1,000, preferably from about 50 to about 400, more preferably from about 50 to about 200, microns. The granules can comprise smaller and larger particles, but preferably from about 85% to about 95%, more preferably from about 95% to about 100%, are within the indicated ranges. Smaller and larger particles do not provide optimum emulsions/dispersions when added to water. Other methods of preparing the primary particles can be used including spray cooling of the melt. The primary particles can be agglomerated to form a dust-free, non-tacky, free-flowing powder. The agglomeration can take place in a conventional agglomeration unit (i.e., Zig-Zag Blender, Lodige) by means of a water-soluble binder. Examples of water-soluble binders useful in the above agglomeration process include glycerol, polyethylene glycols, polymers such as PVA, polyacrylates, and natural polymers such as sugars.

The flowability of the granules can be improved by treating the surface of the granules with flow improvers such as clay, silica or zeolite particles, water-soluble inorganic salts, starch, etc.

Method of Use

Water can be added to the particulate, solid, granular compositions to form dilute or concentrated liquid softener compositions for later addition to the rinse cycle of the laundry process with a concentration of said biodegradable cationic softening compound of from about 0.5% to about 50%, preferably from about 1% to about 35%, more preferably from about 4% to about 32%,. The particulate, rinse-added solid composition (1) can also be used directly in the rinse bath to provide adequate usage concentration (e.g., from about 10 to about 1,000 ppm, preferably from about 50 to about 500 ppm, of total softener active ingredient). The liquid compositions can be added to the rinse to provide the same usage concentrations.

The water temperature for preparation should be from about 20° C. to about 90° C., preferably from about 25° C. to about 80° C. Single-long-chain alkyl cationic surfactants as the viscosity/dispersibility modifier at a level of from 0% to about 15%, preferably from about 3% to about 15%, more preferably from about 5% to about 15%, by weight of the composition, are preferred for the solid composition. Nonionic surfactants at a level of from about 5% to about 20%, preferably from about 8% to about 15%, as well as mixtures of these agents can also serve effectively as the viscosity/dispersibility modifier.

The emulsified/dispersed particles, formed when the said granules are added to water to form aqueous concentrates, typically have an average particle size of less than about 10 microns, preferably less than about 2 microns, and more preferably from about 0.2 to about 2 microns, in order that effective deposition onto fabrics is achieved. The term "average particle size," in the context of this specification, means a number average particle size, i.e., more than 50% of the particles have a diameter less than the specified size.

Particle size for the emulsified/dispersed particles is determined using, e.g., a Malvern particle size analyzer.

Depending upon the particular selection of nonionic and cationic surfactant, it may be desirable in certain cases, when using the solids to prepare the liquid, to employ an efficient means for dispersing and emulsifying the particles (e.g., blender).

Solid particulate compositions used to make liquid compositions can, optionally, contain electrolytes, perfume, antifoam agents, flow aids (e.g., silica), dye, preservatives, and/or other optional ingredients described hereinbefore.

The benefits of adding water to the particulate solid composition to form aqueous compositions to be added later to the rinse bath include the ability to transport less weight thereby making shipping more economical, and the ability to form liquid compositions similar to those that are normally sold to consumers, e.g., those that are described herein, with lower energy input (i.e., less shear and/or lower temperature). Furthermore, the particulate granular solid fabric softener compositions, when sold directly to the consumers, have less packaging requirements and smaller, more disposable containers. The consumers will then add the compositions to available, more permanent, containers, and add water to pre-dilute the compositions, which are then ready for use in the rinse bath, just like the liquid compositions herein. The liquid form is easier to handle, since it simplifies measuring and dispensing.

2. Dryer Activated compositions

The present invention also relates to improved solid dryer-activated fabric softener compositions which are either (A) incorporated into articles of manufacture, e.g., on a substrate, or, are (B) in the form of particles similar to those disclosed above. (including, where appropriate, agglomerates, pellets, and tablets of said particles). Such compositions typically contain from about 10% to about 95% of fabric softening agent.

A. Substrate Articles

In preferred embodiments, the present invention encompasses articles of manufacture. Representative articles are those that are adapted for use to provide unique perfume benefits and to soften fabrics in an automatic laundry dryer, of the types disclosed in U.S. Pat. No. : 3,989,631 Marsan, issued Nov. 2, 1976; U.S. Pat. No. 4,055,248, Marsan, issued Oct. 25, 1977; U.S. Pat. No. 4,073,996, Bedenk et al., issued Feb. 14, 1978; U.S. Pat. No. 4,022,938, Zaki et al., issued May 10, 1977; U.S. Pat. No. 4,764,289, Trinh, issued Aug. 16, 1988; U.S. Pat. No. 4,808,086, Evans et al., issued Feb. 28, 1989; U.S. Pat. No. 4,103,047, Zaki et al., issued Jul. 25, 1978; U.S. Pat. No. 3,736,668, Dillarstone, issued Jun. 5, 1973; U.S. Pat. No. 3,701,202, Compa et al., issued Oct. 31,1972; U.S. Pat. No. 3,634,947, Furgal, issued Jan. 18, 1972; U.S. Pat. No. 3,633,538, Hoeflin, issued Jan. 11, 1972; and U.S. Pat. No. 3,435,537, Rumsey, issued Apr. 1, 1969; and U.S. Pat. No. 4,000,340, Murphy et al., issued Dec. 28, 1976, all of said patents being incorporated herein by reference.

Typical articles of manufacture of this type include articles comprising:

I. a fabric conditioning composition comprising from about 30% to about 95% of normally solid, dryer softenable fabric softening agent comprising said biodegradable fabric softening active; and II. a dispensing means which provides for release of an effective amount of said composition including an effective amount of ii, sufficient to provide odor control, to fabrics in an automatic laundry dryer at automatic laundry dryer operating temperatures, e.g., from about 35° C. to 115° C.

When the dispensing means is a flexible substrate, e.g., in sheet configuration, the fabric conditioning composition is releasably affixed on the substrate to provide a weight ratio of conditioning composition to dry substrate ranging from about 10:1 to about 0.5:1, preferably from about 5:1 to about 1:1.

The solid fabric softener compositions herein can include cationic and nonionic fabric softener actives used in combination with each other.

PREPARATION OF PRINCIPAL SOLVENTS PREPARATION OF DIOL PRINCIPAL SOLVENTS

Many synthesis methods can be used to prepare the diol principal solvents of this invention. The appropriate method is selected for each specific structural requirement of each principal solvent. Futhermore, most principal solvents can also be prepared by more than one method. Therefore, the method cited herein for each specific principal solvent are for illustrative purposes only and should not be considered as limiting.

METHOD A

Preparation of 1,5-, 1,6-, and 1,7-Diols

Method 1

This synthesis method is a general preparation of α,ω-type diols derived from substituted cyclic alkenes. Examples of cyclic alkenes are the alkylated isomers of cyclopentene, cyclohexene, and cycloheptene. The general formula of useful alkylated cyclic alkenes is

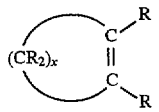

wherein each R is H, or $C_1$–$C_4$-alkyl, and where x is 3,4, or 5.

Cyclic alkenes may be converted to the terminal diols by a three step reaction sequence.

Step 1 is the reaction of the cyclic alkene with ozone ($O_3$) in a solvent such as anhydrous ethyl acetate to form the intermediate ozonide. In Step 2 the ozonide is reduced by, e.g., palladium catalyst /$H_2$ to the dialdehyde which is then converted in Step 3 to the target diol by borohydride reduction.

The 1,2-diols are generally prepared by direct hydroxylation of the appropriate substituted olefins. Example:

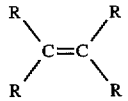

wherein each R is H, alkyl, etc.

In a typical reaction the alkene is reacted with hydrogen peroxide (30%) and a catalytic amount of osmium tetroxide in t-butyl alcohol or other suitable solvent. The reaction is cooled to about 0° C. and allowed to run overnight. Unreacted compounds and solvent are removed by distillation and the desired 1,2-diol isolated by distillation or crystallization.

Method 2

An alternate method is the conversion of the olefin to the epoxide by the reaction of m-chloroperbenzoic acid, or peracetic acid, in a solvent such as methylene chloride at temperatures below about 25° C. The epoxide generated by this chemistry is then opened to the diol by, e.g., hydrolysis with dilute sulfuric acid. Step 3 to the target diol by borohydride reduction.

Method 3

An alternate method for the preparation of these compounds is by direct hydroxylation of the cyclic alkene with hydrogen peroxide and a catalytic amount of osmium tetroxide. The reaction yields the cyclic diol which is then converted to the open chain dialdehyde by periodate or lead tetraacetate. The dialdehyde is then reduced with borohydride as in Method 1, to give the desired 1,5- or 1,6-diols, etc.

METHOD B

Preparation of 1,2 Diols

Method 1

METHOD C

Preparation of 1,3-Diols

Acylation of Enamines

This preparation is for the general type of 1,3-diols and accommodates a variety of structural features. Enamines are formed from both ketones and aldehydes which react with acid chlorides to form the acylated product. The acylated amine derivative is hydrolyzed back to its acylated carbonyl compound which is the 1,3-dicarbonyl precursor to the desired 1,3-diol. The diol is generated by borohydride reduction of the 1,3-dicarbonyl compound.

Thus acetaldehyde (aldehydes) may be reacted with a secondary amine, preferably cyclic amines such as pyrrolidine or morpholine, by heating at reflux in a solvent such as toluene and with a catalytic amount of p-toluene sulfonic acid. As the amine reacts (condenses) with the carbonyl compound, water is produced and is removed, e.g., by reflux through a water trap. After the theoretical amount of water has been removed, the reaction mixture is stripped, e.g., under vacuum, to remove the solvent, if desired (the acylation can be done in the same solvent systems in most cases).

The anhydrous crude enamine containing some excess amine is reacted with the appropriate acid chloride at about 20° C. to give the acylated enamine. This reaction is usually allowed to stir overnight at room temperature. The total reaction mixture is then poured over crushed ice, stirred, and the mixture made acidic with 20% HCl. This treatment hydrolyzes the enamine to the acylated dicarbonyl compound. This intermediate is then isolated by extraction and distillation to remove low boiling impurities, then reduced by sodium borohydride to the desired 1,3-diol.

METHOD D

Preparation of 1,4 Diols, by Aldol Condensation and Reduction

The typical reactions involve one or more aldehydes, one or more ketones, and mixtures thereof, which have at least one alpha-hydrogen atom on the carbon atom next to the carbonyl group. Typical examples of some reactants and some potential final products are as follows $$2\ R{-}CH_2{-}CHO \rightarrow HO{-}CH_2{-}CH(R){-}CHOH{-}CH_2{-}R$$

$$R{-}CH_2{-}CHO + R'{-}CH_2{-}CHO \rightarrow HO{-}CH_2{-}CH(R){-}CHOH{-}CH_2{-}R + HO{-}CH_2{-}CH(R'){-}CHOH{-}CH_2{-}R' + HO{-}CH_2{-}CH(R'){-}CHOH{-}CH_2{-}R + HO{-}CH_2{-}CH(R){-}CHOH{-}CH_2{-}R'$$

$$R{-}CH_2{-}CHO + R'{-}CO{-}CH_3 \rightarrow HO{-}CH_2{-}CH(R){-}CHOH{-}CH_2{-}R + R{-}CH_2{-}CHOH\ CH_2{-}CHOH{-}R'$$

The aldehyde, ketone, or mixture thereof which is to be condensed is placed in an autoclave under an inert atmosphere with a solvent such as butanol or with a phase transfer medium such as polyethylene glycol. When a mixed condensation such as with a ketone and an aldehyde is the target, typically the two reactants are used in about 1:1 mole ratio. A catalytic amount of strongly alkaline catalyst such as sodium methoxide is added, typically about 0.5–10 mole % of the reactants. The autoclave is sealed, and the mixture is heated at about 35°–100° C. until most of the original reactants have been converted, usually about 5 minutes to about 3 hours. The crude mixture is neutralized and the carbonyl functions present are reduced by hydrogenation over Raney Ni at about 100° C. and about 50 atm for about 1 hour. Volatile components are removed by distillation and the desired diol principal solvents are obtained by vacuum distillation.

More information about this preparation process is disclosed in Synthesis, (3), 164-5 (1975), A. Pochini and R. Ungaro; PCT Int. Appl. WO 9,507,254, Kulmala et al, 16 Mar. 1995; Japan Pat. Appl. No. 40,333, Sato et al, 9 Feb. 1990; Japan Pat. Appl. No. 299,240, Sato et al, 4 Dec. 1989; Eur. Pat. Appl. No. 367,743, Ankner et al, 9 May 1990; all of said article and patents being incorporated herein by reference.

ILLUSTRATIVE EXAMPLES

Condensation of Butyraldehyde and/or Isobutyraldehyde and Conversion to Form Eight-Carbon-1,3-Diols A portion of n-butanol (about 148 g, about 2 mole, Aldrich) in a 500 ml, 3-neck, round-bottom flask equipped with a stirring bar, internal thermometer, condenser, and connection for blanketing with a nitrogen atmosphere is treated with sodium metal (about 2.3 g, about 0.1 mole, Aldrich) until the sodium has all dissolved. Then, a mixture of butyraldehyde (about 72 g, about 1 mole, Aldrich) and isobutyraldehyde (about 72 g, about 1 mole, Aldrich) is added and the system is held at about 40° C. until most of the original aldehydes have undergone reaction. The base catalyst is neutralized by careful addition of sulfuric acid, any salts are removed by filtration, and the solution is hydrogenated over Raney Ni at about 100° C. at about 50 atm of pressure for about 1 hour to yield a mixture of 8-carbon, 1,3-diols. The butanol solvent and any isobutanol formed during the hydrogenation are removed by distillation to yield the eight-carbon-1,3-diol mixture of: 2,2,4-trimethyl-1,3-pentanediol; 2-ethyl-1,3-hexanediol; 2,2-dimethyl-1,3-hexanediol; and 2-ethyl-4-methyl-1,3-pentanediol. Optionally, this mixture is further purified by vacuum distillation, or by decolorization with activated charcoal. The recovered solvent is used for further batches of diol production.

When only butyraldehyde is used in the reaction, the major product obtained is 2-ethyl-1,3-hexanediol.

When only isobutyraldehyde is used in the reaction, the major product obtained is 2,2,4-trimethyl-1,3-pentanediol.

Mixed Condensation of Butyraldehyde and Methyl Ethyl Ketone and Conversion to Form a Mixture of Eight-Carbon-1,3-Diols Condition A. A portion of n-butanol (about 148 g, about 2 mole, Aldrich) in a 500 ml, 3-neck, round-bottom flask equipped with a stirring bar, internal thermometer, condenser, and connection for blanketing with a nitrogen atmosphere is treated with sodium metal (about 2.3 g, about 0.1 mole, Aldrich) until the sodium has all dissolved. Then, a mixture of butyraldehyde (about 72 g, about 1 mole, Aldrich) and 2-butanone (about 72 g, about 1 mole, Aldrich) is added and the system is held at about 40° C. until most of the original butyraldehyde has undergone reaction. The base catalyst is neutralized by careful addition of sulfuric acid and any salts are removed by filtration. Optionally, unreacted starting materials are removed by distillation along with the reaction solvent. The mixture containing the condensation products is hydrogenated over Raney Ni at about 100° C. and about 50 atm. for about 1 hour to yield a mixture of 8-carbon-1,3-diols including 2-ethyl-1,3-hexanediol, 2-ethyl-3-methyl-1,3-pentanediol, 3,5-octanediol; 3-methyl-3,5-heptanediol; and lesser amounts of other 1,3-diol isomers, e.g., 3-methyl-2,4-heptanediol and 3,4-dimethyl-2,4-hexanediol. The crude diol mixture can be further purified by fractional distillation.

Condition B. The above reaction is repeated except that about 2 moles of butyraldehyde are used for each one mole of 2-butanone. This results in a reaction product with a higher proportion of diols resulting from self-condensation of the aldehyde (i.e., 2-ethyl-3-hexanediol), and from mixed condensation of aldehyde and 2-butanone (e.g., 2-ethyl-3-methyl-1,3-pentanediol and 3,5-octanediol), and a smaller proportion of those diols resulting from self-condensation of 2-butanone (e.g., 3-methyl-3,5-heptanediol and 3,4-dimethyl-2,4-hexanediol).

Condition C. The above condensation is repeated except that about one mole of 2-butanone is placed in the reaction vessel with the solvent and catalyst and about one mole of butyraldehyde is gradually added. Conditions are adjusted such that the self-condensation rate of 2-butanone is slow and the more reactive carbonyl of the aldehyde reacts promptly upon addition. This results in a reaction product with a higher proportion of the diols resulting from the condensation of 2-butanone with butyraldehyde and from self-condensation of 2-butanone and a smaller proportion of thediol resulting from self-condensation of butyraldehyde.

Condition D. The above condensation C. is repeated under low temperature conditions. About 1.0 mole portion of 2-butanone is dissolved in about 5 volumes of dry tetrahydrofuran. The solution is cooled to about −78° C., and about 0.95 mole of potassium hydride is added in portions. After the hydrogen evolution has ceased, the solution is held for about one hour to allow for equilibration to the more stable enolate and then one mole of n-butyraldehyde is added slowly with good stirring while maintaining the temperature at about −78° C. After addition is complete, the solution is allowed to gradually warm to room temperature and is neutralized by careful addition of sulfuric acid. Salts are removed by filtration. Optionally, unreacted starting materials are removed by distillation along with the reaction solvent. The mixture containing the condensation products is hydrogenated over Raney Ni at about 100° C. and about 50 atm. for about 1 hour to yield predominantly the diol resulting from the condensation of the enolate of 2-butanone with butyraldehyde, 3,5-octanediol. Purification is optionally accomplished by distillation.

Mixed Condensation of Isobutyraldehyde and Methyl Ethyl Ketone and Conversion to Form a Mixture of Eight-Carbon-1,3-Diols The reaction of Condition A above is repeated except that the butyraldehyde is replaced by isobutyraldehyde. The condensation and reduction proceed analogously, and the final diol products are mainly 2,2,4-trimethyl-1,3-pentanediol; 2,2,3-trimethyl-1,3-pentanediol; 2-methyl-3,5-heptanediol; and 3-methyl-3,5-heptanediol.

Mixed Condensation of Butyraldehyde, Isobutyraldehyde and Methyl Ethyl Ketone and Conversion to Form a Mixture of Eight-Carbon-1,3-Diols The reaction of Condition A above is repeated, except that about one mole each of butyraldehyde, isobutyraldehyde, and 2-butanone are used. The condensation and reduction proceed analogously to yield a mixture of 8-carbon-1,3-diols primarily consisting of: 2,2,4-trimethyl-1,3-pentanediol; 2-ethyl-1,3-hexanediol; 2,2-dimethyl-1,3-hexanediol; 2-ethyl-4-methyl-1,3-pentanediol; 2-ethyl-3-methyl-1,3-pentanediol; 3,5-octanediol; 2,2,3-trimethyl-1,3-pentanediol; 2-methyl-3,5-heptanediol; and 3-methyl-3,5-heptanediol, along with other minor isomers resulting from condensation on the methylene of 2-butanone instead of the methyl.

The mixtures prepared by the condensation of butyraldehyde, isobutyraldehyde, and/or methyl ethyl ketone, preferably have no more than about 90%, preferably no more than about 80%, more preferably no more than about 70%, even more preferably no more than about 60%, and most preferably no more than about 50%, by weight of any one specific compound. Also, the reaction mixtures should not contain more than about 95%, preferably no more than about 90%, more preferably no more than about 85%, and most preferably no more than about 80%, by weight, of butyraldehyde or isobutyraldehyde.

METHOD E

Preparation of 1,4 Diols, by the Addition of Acetylide to Carbonyl Compounds Dimetallic acetylides $Na^{+-}:C{\equiv}C:^{-}Na^{+}$ react with aldehydes or ketones to form unsaturated alcohols, e.g.,

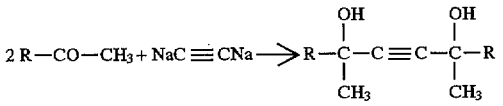

The resulting acetylenic diol is then reduced to the alkene or completely reduced to the saturated diol. The reaction can also be done by using an about 18% slurry of mono-sodium acetylide with the carbonyl compound to form the acetylenic alcohol which can be converted to the sodium salt and reacted with another mole of carbonyl compound to give the unsaturated 1,4-diol. Where mixed carbonyl compounds are used with the diacetylides, diol mixtures will result. Where the mono-acetylide is used, specific structures can be made in higher yields.

ILLUSTRATIVE EXAMPLE

Preparation of 6-Methyl-2,5-heptanediol

A sodium acetylide (about 18% in xylene) slurry is reacted with isobutyraldehyde to form the acetylenic alcohol

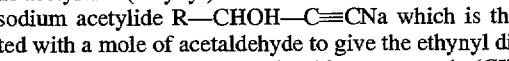

The acetylenic (ethynyl) alcohol is converted with base to the sodium acetylide R—CHOH—C≡CNa which is then reacted with a mole of acetaldehyde to give the ethynyl diol R—CHOH—C≡C—CHOH—R'. This compound, $(CH_3)_2CH$—CHOH—C≡C—CHOH—CH3, can be isolated as the unsaturated diol, if desired, reduced by catalytic hydrogenation to the corresponding material containing a double bond in place of the acetylenic bond, or further reduced by catalytic hydrogenation to the saturated 1,4-diol.

METHOD F

Preparation of Substituted Diols Derived from Cyclic Anhydrides, Lactones and Esters of Dicarboxylic Acids This method of preparation is for the synthesis of diols, especially several 1,4-diols, which are derived from dicarboxylic acid anhydrides, diesters and lactones, but not limited to the 1,4-diols or four-carbon diacids.

These types of diols are generally synthesized by the reduction of the parent anhydride, lactone or diester with sodium bis(2-methoxyethoxy)aluminum hydride (Red-Al) as the reducing agent. This reducing agent is commercially available as a 3.1 molar solution in toluene and delivers one mole of hydrogen per mole of reagent. Diesters and cyclic anhydrides require about 3 moles of Red-Al per mole of substrate. Using an alkyl substituted succinic anhydride to illustrate this method, the typical reduction is carried out as follows.

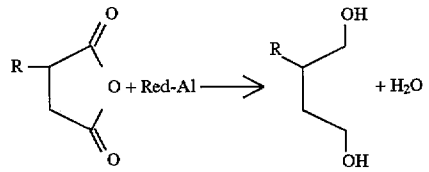

The anhydride is first dissolved in anhydrous toluene and placed in a reaction vessel equipped with dropping funnel, mechanical stirrer, thermometer and a reflux condenser connected to calcium chloride and soda lime tubes to exclude moisture and carbon dioxide. The reducing agent, in toluene, is placed in the dropping funnel and is added slowly to the stirred anhydride solution. The reaction is exothermic and the temperature is allowed to reach about 80° C. It is maintained at about 80° C. during the remaining addition time and for about two hours following addition.

The reaction mixture is then allowed to cool back to room temperature. Next, the mixture is added to a stirred aqueous HCl solution (about 20% concentration) which is cooled in an ice bath, and the temperature is maintained at about 20° to 30° C. After acidification the mixture is separated in a separatory funnel and the organic layer washed with a dilute salt solution until neutral to pH paper. The neutral diol solution is dried over anhydrous magnesium sulfate, filtered, then stripped under vacuum to yield the desired 1,4-diol.

METHOD G

Preparation of Diols with One or Both Alcohol Functions Being Secondary or Tertiary This is a general method to prepare substituted diols from lactones and/or diesters by alkylation of the carboxyl group (s) using methyl magnesium bromide (Grignard reagent) or alkyl lithium compounds usually methyl lithium, e.g.,

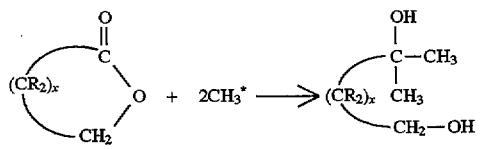

This type of alkylation can be extended to diesters. An excess of methylating reagent will generate diols where both alcohol groups are tertiary.

METHOD H

Preparation of Substituted 1,3-, 1,4- and 1,5-Diols

This method is a general preparation of some 1,3-, 1,4- and 1,5-diols which utilizes the chemistry outlined in Method A-1 and Method A-2. The variation here is the use of a cyclic alkadienes in place of the cycloalkenes described in Methods A. The general formula for the starting materials is

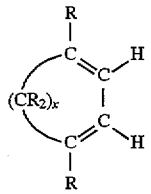

wherein each R is H, or $C_1$–$C_4$-alkyl and wherein x is 1, 2 or 3.

The reactions are those of Methods A with the variation of having one mole of ethylene glycol generated for each mole of the desired diol principal solvent formed, e.g., the following preparation of 2,2-dimethyl-1,4-haxanediol from 1-ethyl-5,5-dimethyl-1,3-cyclohexanediol (CAS No. 79419-18-4):

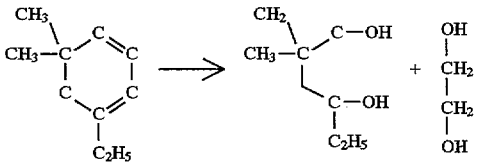

PREPARATION OF POLYETHOXYLATED DERIVATIVES

The polyethoxylated derivatives of diol principal solvents are typically prepared in a high-pressure reactor under a nitrogen atmosphere. A suitable amount of ethylene oxide is added to a mixture of a diol solvent and potassium hydroxide at high temperature (from about 80° C. to about 170° C.). The amount of ethylene oxide is calculated relative to the amount of the diol solvent in order to add the right number of ethylene oxide groups per molecule of diol. When the reaction is completed, e.g., after about 1 hour, residual unreacted ethylene oxide is removed by vacuum.

ILLUSTRATIVE EXAMPLE

Preparation of Tetraethoxylated 3,3-Dimethyl-1,2-butanediol

To a 2-liter Parr reactor that is equipped for temperature control, is charged with about 354 grams (about 3.0 moles) of 3,3-dimethyl-1,2-butanediol and about 0.54 grams of potassium hydroxide. The reactor is sparged with nitrogen and evacuated three times to a pressure of about 30 mm Hg. The reactor is then filled again with nitrogen to atmospheric pressure, and heated to about 130° C. The pressure of the reactor is then adjusted to slightly below the atmospheric pressure by applying a slight vacuum. Ethylene oxide (about 528 grams, about 12.0 moles) is added over one hour while controlling the temperature to about 130° C. After about an additional one hour reaction time, the contents are cooled to about 90° C. and a vacuum is pulled to remove any residual ethylene oxide.

PREPARATION OF METHYL-CAPPED POLYETHOXYLATED DERIVATIVES

Methyl-capped polyethoxylated derivatives of diols are typically prepared either by reacting a methoxypoly(ethoxy) ethyl chloride (i.e., $CH_3O—(CH_2CH_2O)_n—CH_2CH_2—Cl$) of the desired chain length with the selected diol, or by reacting a methyl-capped polyethylene glycol (i.e., $CH_3O—(CH_2CH_2O)_n—CH_2CH_2—OH$) of the desired chain length with the epoxy precursor of the diol, or a combination of these methods.

ILLUSTRATIVE EXAMPLES

Synthesis of $(CH_3)_2C(OH)CH(CH_3)(OCH_2CH_2)_4OCH_3$, the methyl-capped tetraethoxylated derivative of 2-methyl-2,3-butanediol To a 1-liter, three-neck round bottom flask equipped with a magnetic stirbar, condenser, thermometer, and temperature controller (Thermowatch $I^2R$)® is added tetraethylene glycol methyl ether (about 208 grams, about 1.0 mole) and sodium metal (Aldrich, about 2.3 grams, about 0.10 mole), and the mixture is heated to about 100° C. under argon. After the sodium dissolves, 2-methyl-2,3-epoxybutane (about 86 grams, about 1.0 mole) is added and the solution is stirred overnight under argon at about 120° C. A $^{13}$C-NMR (dmso-$d_6$) shows that the reaction is complete by the disappearance of the epoxide peaks. The reaction mixture is cooled, poured into an equal volume of water, neutralized with 6N HCl, saturated with sodium chloride, and extracted twice with dichloromethane. The combined dichloromethane layers are dried over sodium sulfate and solvent is stripped to yield the desired polyether alcohol in crude form. Optionally, purification is accomplished by fractional vacuum distillation.

Synthesis of Methoxytriethoxyethyl Chloride

To a 1-liter, three-neck round bottom flask equipped with a magnetic stirring bar, condenser, and temperature controller (Thermowatch, $I^2R$) is added tetraethylene glycol methyl ether (about 208 grams, about 1.0 mole ) under argon. Thionyl chloride (about 256.0 grams, about 2.15 moles) is added dropwise with good stirring over about 3 hours, keeping the temperature in the 50°–60° C. range. The reaction mixture is then heated overnight at about 55° C. A $^{13}$C-NMR ($D_2O$) is taken which shows only a small peak at ~60 ppm for unreacted alcohol and a sizable peak at ~43.5 ppm representing chlorinated product (—$\underline{C}H_2Cl$). Saturated sodium chloride solution is slowly added to the material until the thionyl chloride is destroyed. The material is taken up in about 300 ml of saturated sodium chloride solution and extracted with about 500 ml of methylene chloride. The organic layer is dried and solvent is stripped on a rotary evaporator to yield crude methoxyethoxyethyl chloride. Optionally, purification is accomplished by fractional vacuum distillation.

Synthesis of $C_2H_5CH(OH)CH(CH_3)CH_2(OCH_2CH_2)_4OCH_3$, the Methyl-Capped Tetraethoxylated Derivative of 2-Methyl-1,3-pentanediol The alcohol, $C_2H_5CH(OH)CH(CH_3)CH_2OH$ (about 116 grams, about 1.0 mole), is placed in a 1-liter, three-neck round bottom flask equipped with a magnetic stirring bar, condenser, and temperature controller (Thermowatch®, $I^2R$) along with about 100 ml of tetrahydrofuran as solvent. To this solution, sodium hydride (about 32 grams, about 1.24 moles) is added in portions and the system is held at reflux until gas evolution ceases. Methoxytriethoxyethyl chloride (about 242 grams, about 1.2 moles, prepared as above) is added and the system is held at reflux for about 48 hours. The reaction mixture is cooled to room temperature and water is cautiously added dropwise with stirring to decompose excess hydride. The tetrahydrofuran is stripped off on a rotary evaporator. The crude product is dissolved in about 400 ml of water and enough sodium chloride is dissolved in the water to bring it nearly to the saturation level. The mixture is then extracted twice with about 300 ml portions of dichloromethane. The combined dichloromethane layers are dried over sodium sulfate and the solvent is then stripped on a rotary evaporator to yield the crude product. Optionally, purification is accomplished by further stripping of unreacted starting materials and low MW by-products by utilizing a kugelrohr apparatus at about 150° C. under vacuum. Optionally, further purification is accomplished by vacuum distillation to yield the title polyether.

PREPARATION OF POLYPROPOXYLATED DERIVATIVES

A three neck, round bottom flask is equipped with a magnetic stir bar, a solid $CO_2$-cooled condenser, an addition funnel, a thermometer, and a temperature control device (Therm-O-Watch, I2R). The system is swept free of air by a stream of nitrogen and then is equipped for blanketing the reaction mixture with a nitrogen atmosphere. To the reaction flask is added the dry alcohol or diol to be propoxylated. About 0.1–5 mole % of sodium metal is added cautiously to the reaction vessel in portions with heating if necessary to get all the sodium to react. The reaction mixture is then heated to about 80°–130° C. and propylene oxide (Aldrich) is added dropwise from the dropping funnel at a rate to maintain a small amount of relux from the solid $CO_2$-cooled condenser. Addition of propylene oxide is continued until the desired amount has been added for the target degree of propoxylation. Heating is continued until all reflux of propylene oxide ceases and the temperature is maintained for about an additional hour to ensure complete reaction. The reaction mixture is then cooled to room temperature and is neutralized by careful addition of a convenient acid such as methanesulfonic acid. Any salts are removed by filtration to give the desired propoxylated product. The average degree of propoxylation is typically confirmed by integration of the $^1$H-NMR spectrum.

PREPARATION OF POLYBUTOXYLATED DERIVATIVES

A three neck, round bottom flask is equipped with a magnetic stir bar, a solid $CO_2$-cooled condenser, an addition funnel, a thermometer, and a temperature control device (Therm-O-Watch, I2R). The system is swept free of air by a stream of nitrogen and then is equipped for blanketing the reaction mixture with a nitrogen atmosphere. To the reaction flask is added the dry alcohol or diol to be butoxylated. About 0.1–5 mole % of sodium metal is added cautiously to the reaction vessel in portions with heating if necessary to get all the sodium to react. The reaction mixture is then heated to about 80°–130° C. and α-butylene oxide (Aldrich) is added dropwise from the dropping funnel at a rate to maintain a small amount of reflux from the solid $CO_2$-cooled condenser. Addition of butylene oxide is continued until the desired amount has been added for the target degree of butoxylation. Heating is continued until all reflux of butylene oxide ceases and the temperature is maintained for about an additional one to two hours to ensure complete reaction. The reaction mixture is then cooled to room temperature and is neutralized by careful addition of a convenient acid such as methanesulfonic acid. Any salts are removed by filtration to give the desired butoxylated product. The average degree of butoxylation is typically confirmed by integration of the $^1$H-NMR spectrum.

PREPARATION OF POLYTETRAMETHYLENEOXYLATED DERIVATIVES

A dry portion of about 0.1 mole of the desired alcohol or diol starting material is placed in a 3-neck, round bottom flask equipped with magnetic stirrer, condenser, internal thermometer and an argon blanketing system. If the desired average degree of "tetramethyleneoxylation" is about one per hydroxyl group, about 0.11 moles of 2-(4-chlorobutoxy) tetrahydropyran (ICI) is added per mole of alcohol function. A solvent is added if necessary such as dry tetrahydrofuran, dioxane or dimethylformamide. Then sodium hydride (about 5 mole % excess relative to the chloro compound) is added in small portions with good stirring while maintaining a temperature of about 30°–120° C. After all the hydride has reacted, the temperature is maintained until all of the alcohol groups have been alkylated, usually about 4–24 hours. After the reaction is complete, it is cooled and the excess hydride is decomposed by careful addition of methanol in small portions. Then about an equal volume of water is added and the pH is adjusted to about 2 with sulfuric acid. After warming to about 40° C. and holding it there for about 15 minutes to hydrolyze the tetrahydropyranyl protecting group, the reaction mixture is neutralized with sodium hydroxide and the solvents are stripped on a rotary evaporator. The residue is taken up in ether or methylene chloride and salts are removed by filtration. Stripping yields the crude tetramethyleneoxylated alcohol or diol. Further purification may be accomplished by vacuum distillation. If a final average degree of tetramethyleneoxylation of less than one is desired, a correspondingly lesser amount of chloro compound and hydride are used. For average degrees of tetramethyleneoxylation greater than one, the entire process is repeated in cycles until the buildup reaches the target level.

PREPARATION OF ALKYL AND ARYL MONOGLYCERYL ETHERS

A convenient method to prepare alkyl and/or aryl monoglycerol ethers consists of first preparing the corresponding alkyl glycidyl ether precursor. This is then converted to a ketal, which is then hydrolyzed to the monoglyceryl ether (diol). Following is the illustrative example of the preparation of the preferred n-pentyl monoglycerol ether, (i.e., 3-(pentyloxy)-1,2-propanediol)$_n$—$C_5H_{11}$—O—CHOH—$CH_2$OH.

Preparation of 3-(pentyloxy)-1,2-propanediol

A 3-neck, 2-liter round bottomed reaction flask (equipped with overhead stirrer, cold water condenser, mercury thermometer and addition funnel) are charged with about 546 g of aqueous NaOH (about 50% concentration) and about 38.5 g of tetrabutylammonium hydrogen sulfate (PTC, phase transfer catalyst). The content of the flask is stirred to achieve dissolution and then about 200 g of 1-pentanol is added along with about 400 ml hexanes (a mixture of isomers, with about 85% n-hexane). Into the addition funnel is charged about 418 g of epichlorohydrin which is slowly added (dropwise) to the stirring reaction mix. The temperature gradually rises to about 68° C. due to the reaction exotherm. The reaction is allowed to continue for about 1 hr after complete addition of the epichlorohydrin (no additional heat).

The crude reaction mix is diluted with about 500 ml of warm water, stirred gently and then the aqueous layer is settled and removed. The hexane layer is mixed diluted again with about 1 liter of warm water and the pH of the mix is adjusted to about 6.5 by the addition of dilute aqueous sulfuric acid. The water layer is again separated and discarded and the hexane layer is then washed 3 times with fresh water. The hexane layer is then separated and evaporated to dryness via a rotary evaporator to obtain the crude n-pentyl glycidyl ether.

Acetonation (Conversion to the Ketal)

A 3-neck, 2 liter round bottomed flask (equipped with an overhead stirrer, cold water condenser, mercury thermometer and addition funnel) is charged with about 1 liter of acetone. To the acetone is added about 1 ml of $SnCl_4$ with stirring. Into an addition funnel positioned over the reaction flask is added about 200 g of the just prepared n-pentyl glycidyl ether. The glycidyl ether is added very slowly to the stirring acetone solution (the rate is adjusted to control the exotherm). The reaction is allowed to proceed for about 1 hr after complete addition of the glycidyl ether (maximum temperature about 52° C.).

Hydrolysis

The apparatus is converted for distillation and a heating mantle and temperature controller are added. The crude reaction mix is concentrated via distillation of about 600 ml of acetone. To the cooled concentrated solution are added about 1 liter of aqueous sulfuric acid (about 20% concentration) and about 500 ml of hexanes. The content of the flask is then heated to about 50° C. with stirring (the apparatus is adjusted to collect and separate the liberated acetone). The hydrolysis reaction is continued until TLC (Thin Layer Chromatography) analysis confirms the completion of reaction.

The crude reaction mix is cooled and the aqueous layer is separated and discarded. The organic layer is then diluted with about 1 liter of warm water and the pH is adjusted to about 7 by the addition of dilute aqueous NaOH (1N). The aqueous layer is again separated and the organic phase is washed 3 times with fresh water. The organic phase is then separated and evaporated via a rotary evaporator. The residue is then diluted with fresh hexanes and the desired product is extracted into methanol/water solution (about 70/30 weight ratio). The methanol/water solution is again evaporated to dryness via a rotary evaporator (with additional methanol added to facilitate the water evaporation). The residue is then filtered hot through glass microfiber filter paper to obtain the n-pentyl monoglycerol ether.

PREPARATION OF DI(HYDROXYALKYL) ETHERS

Synthesis of bis(2-hydroxybutyl)ether

A 500 ml, three neck, round bottom flask equipped with magnetic stirrer, internal thermometer, addition funnel, condenser, argon supply, and heating mantle, is flushed with argon. Then 1,2-butanediol (about 270 g, about 3 moles, Aldrich) is added and sodium metal (about 1.2 g, about 0.05 moles, Aldrich) is added and the sodium is allowed to dissolve. Then the reaction mixture is heated to about 100° C. and epoxybutane (about 71 g. about 1 mole, Aldrich) is added dropwise with stirring. Heating is continued until the reflux of epoxybutane has ceased and heating is continued for an additional hour to drive the conversion to completion. The reaction mixture is neutralized with sulfuric acid, the salts are removed by filtration, and the liquid is fractionally distilled under vacuum to recover the excess butanediol. The desired ether is obtained as a residue. Optionally, it is purified by further vacuum distillation.

Synthesis of bis(2-hydroxycyclopentyl)ether

A 1-liter, three neck, round bottom flask equipped with magnetic stirrer, internal thermometer, addition funnel, condenser, argon supply, and heating mantle, is flushed with argon. Then 1,2-cyclopentanediol (about 306 g, about 3 moles, Aldrich) is added and boron trifluoride diethyl etherate (about 0.14 g. about 0.01 moles, cis-trans isomer mixture, Aldrich) is added. Then the reaction mixture is held at about 10°–40° C. as cyclopentene oxide (about 84 g. about 1 mole, Aldrich) is added dropwise with stirring until all the cyclopentene oxide has reacted. The reaction mixture is neutralized with sodium hydroxide, and the liquid is fractionally distilled under vacuum to recover the excess cyclopentanediol. The desired ether is obtained as a residue. Optionally, it is purified by further vacuum distillation.

The above disclosed methods are illustrative only, for purposes of assisting those skilled in the art in the practice of the invention, and are not limiting.

In the specification and examples herein, all percentages, ratios and parts are by weight unless otherwise specified and all numerical limits are normal approximations. All documents cited are, in relevant part, incorporated herein by reference.

The following are non-limiting examples of the present invention:

The following are suitable N,N-di(unsaturated fatty acyl-oxyethyl)-N,N-dimethyl ammonium chloride fabric softening actives (DEQA's), with approximate distributions of fatty acyl groups given, that are used hereinafter for preparing the following compositions.

| Fatty Acyl Group | DEQA[1] | DEQA[2] | DEQA[3] | DEQA[4] | DEQA[5] |
|---|---|---|---|---|---|
| C12 | trace | trace | 0 | 0 | 0 |
| C14 | 3 | 3 | 0 | 0 | 0 |
| C16 | 4 | 4 | 5 | 5 | 5 |
| C18 | 0 | 0 | 5 | 6 | 6 |
| C14:1 | 3 | 3 | 0 | 0 | |
| C16:1 | 11 | 7 | 0 | 0 | 3 |
| C18:1 | 74 | 73 | 71 | 68 | 67 |
| C18:2 | 4 | 8 | 8 | 11 | 11 |
| C18:3 | 0 | 1 | 1 | 2 | 2 |
| C20:1 | 0 | 0 | 2 | 2 | 2 |
| C20 and up | 0 | 0 | 2 | 0 | 0 |
| Unknowns | 0 | 0 | 6 | 6 | 7 |
| Total | 99 | 99 | 100 | 100 | 102 |
| IV | 86–90 | 88–95 | 99 | 100 | 95 |
| cis/trans | 20–30 | 20–30 | 4 | 5 | 5 |
| TPU | 4 | 9 | 10 | 13 | 13 |

| Fatty Acyl Group | DEQA[6] | DEQA[7] | DEQA[8] |
|---|---|---|---|
| C14 | | 1 | 0 |
| C16 | 11 | 25 | 5 |
| C18 | 4 | 20 | 14 |
| C14:1 | 0 | 0 | 0 |
| C16:1 | 1 | 0 | 1 |
| C18:1 | 27 | 45 | 74 |
| C18:2 | 50 | 6 | 3 |
| C18:3 | 7 | 0 | 0 |
| Other | 0 | 3 | 3 |
| Total | 100 | 100 | 100 |
| IV | 125–138 | 56 | Not Available |
| cis/trans (C18:1) | Not Available | 7 | Not Available |
| TPU | 57 | 6 | Not Available |

TPU = Total polyunsaturated fatty acyl groups, by weight.

The following are suitable N,N-di(branched chain fatty acyl-oxyethyl)-N,N-dimethyl ammonium chloride fabric softening actives (DEQA's), with approximate distributions of fatty acyl groups given, that are used hereinafter for preparing the following compositions.

| Fatty Acyl Group | DEQA[10] | DEQA[11] | DEQA[12] |
|---|---|---|---|
| Isomyristic acid | — | 1–2 | — |
| Myristic acid | 7–11 | 0.5–1 | — |
| Isopalmitic acid | 6–7 | 6–7 | 1–3 |
| Palmitic acid | 4–5 | 6–7 | — |
| Isostearic acid | 70–76 | 80–82 | 60–66 |
| Stearic acid | — | 2–3 | 8–10 |
| Isooleic acid | — | — | 13–17 |
| Oleic acid | — | — | 6–12 |
| IV | 3 | 2 | 7–12 |

| Softener Actives | DEQA[13] | DEQA[14] | DEQA[15] | DEQA[16] | DEQA[17] |
|---|---|---|---|---|---|
| Fatty Acyl Group | Branched fatty acid 1 | Branched fatty acid 2 | Branched fatty acid 3 | Branched fatty acid 4 | α-Heptyl decanoic acid |

| Softener Actives | DEQA[18] | DEQA[19] | DEQA[20] | DEQA[21] |
|---|---|---|---|---|
| Fatty Acyl Group | 9- and 10-Methoxy octadecanoic acids | 9- and 10-Isopropoxy-octadecanoic acids | Methoxyoctadecanoic acid isomeric mixture | Phenyl octadecanoic acid |

| Softener Actives | DEQA[22] | DEQA[23] | DEQA[24] | DEQA[25] |
|---|---|---|---|---|
| Fatty Acyl Group | Methyl-phenyl octadecanoic acids | Phenoxy-octadecanoic acid | 65:35 Mixture of fatty acids used to make DEQA[2] and DEQA[10] | 65:35 Mixture of fatty acids used to make DEQA[8] and DEQA[10] |

The following Examples show clear, or translucent, products with acceptable viscosities.

The compositions in the Examples below are made by first preparing a softener premix by blending at room temperature the appropriate branched DEQA and unsaturated DEQA actives. The softener actives can be heated to melting at, e.g., about 130°–150° F. (about 55°–66° C.), if the softener active(s) is not fluid at room temperature. The softener active is mixed using an IKA RW 25® mixer for about 2 to about 5 minutes at about 150 rpm. Separately, an acid/water seat is prepared by mixing the HCl with deionized (DI) water at room temperature. If the softener actives and/or the principal solvent(s) are not fluid at room temperature and need to be heated, the acid/water seat should also be heated to about 100° F. (about 38° C.) and maintaining said temperature with a water bath. The principal solvent(s) (melted at suitable temperatures if their melting points are above room temperature) are added to the softener premix and said premix is mixed for about 5 minutes. The acid/water seat is then added to the softener premix and mixed for about 20 to about 30 minutes or until the composition is clear and homogeneous. The composition is allowed to air cool to ambient temperature, if necessary.

EXAMPLES 1 TO 6

| Ingredients | Ex. 1 Wt. % | Ex. 2 Wt. % | Ex. 3 Wt. % | Ex. 4 Wt. % | Ex. 5 Wt. % | Ex. 6 Wt. % |
|---|---|---|---|---|---|---|
| DEQA[2] (85% active in ethanol) | 19.9 | — | 15.3 | — | 32.5 | — |
| DEQA[8] (85% active in ethanol) | — | 19.9 | — | 15.3 | — | 32.5 |
| DEQA[10] (85% active in ethanol) | 10.7 | 10.7 | 15.3 | 15.3 | 17.5 | 17.5 |
| Ethanol | — | — | 2 | 2 | 2 | 2 |
| 1,2-Hexanediol | 18 | 18 | 18 | 18 | 28 | 28 |
| Perfume | 1.2 | 1.2 | 1 | 1.35 | 1.3 | 1.3 |
| HCl (pH 2–3.5) | 0.005 | 0.005 | 0.005 | 0.005 | 0.005 | 0.005 |
| Distilled Water | Bal. | Bal. | Bal. | Bal. | Bal. | Bal. |

EXAMPLES 7 TO 12

| Ingredients | Ex. 7 Wt. % | Ex. 8 Wt. % | Ex. 9 Wt. % | Ex. 10 Wt. % | Ex. 11 Wt. % | Ex. 12 Wt. % |
|---|---|---|---|---|---|---|
| DEQA[2] (85% active in ethanol) | 19.9 | — | — | — | 32 | — |
| DEQA[8] (85% active in ethanol) | — | — | 19.9 | 19 | — | 19 |
| DEQA[11] (85% active in ethanol) | 10.7 | — | — | — | — | — |
| DEQA[12] (85% active in ethanol) | — | 28 | — | — | — | — |
| DEQA[13] (85% active in ethanol) | — | — | 5.4 | — | — | — |
| DEQA[14] (85% active in ethanol) | — | — | 5.4 | — | — | — |
| DEQA[15] (85% active in ethanol) | — | — | — | 5 | 9 | — |
| DEQA[16] (85% active in ethanol) | — | — | — | 6 | 9 | — |
| DEQA[18] (85% active in ethanol) | — | — | — | — | — | 6 |
| DEQA[19] (85% active in ethanol) | — | — | — | — | — | 6 |
| 1,2-Hexanediol | 18 | 15 | 18 | 18 | 28 | 18 |
| Ethanol | — | 1 | — | — | — | 1 |
| Perfume | 1.2 | 1 | 1.2 | 1.35 | 2 | 1.3 |
| HCl (pH 2–3.5) | 0.005 | 0.005 | 0.005 | 0.005 | 0.005 | 0.005 |
| Distilled Water | Bal. | Bal. | Bal. | Bal. | Bal. | Bal. |

EXAMPLES 13 TO 18

| Ingredients | Ex. 13 Wt. % | Ex. 14 Wt. % | Ex. 15 Wt. % | Ex. 16 Wt. % | Ex. 17 Wt. % | Ex. 18 Wt. % |
|---|---|---|---|---|---|---|
| DEQA[1] (85% active in ethanol) | 19.9 | — | — | 19.9 | | |
| DEQA[6] (85% active in ethanol) | — | 17 | — | — | — | — |
| DEQA[8] (85% active in ethanol) | — | — | 19.9 | — | — | — |
| DEQA[9] (85% active in ethanol) | — | | | | 19.9 | 19.9 |
| DEQA[10] (85% active in ethanol) | — | 6.8 | 7 | 7 | 7 | 7 |
| DEQA[11] (85% active in ethanol) | 5.3 | — | — | — | — | — |
| DEQA[20] (85% active in ethanol) | 5.3 | — | — | — | — | — |
| DEQA[21] (85% active in ethanol) | — | 6.8 | — | — | — | — |
| DEQA[22] (85% active in ethanol) | — | — | 3.7 | — | — | — |
| DEQA[23] (85% active in ethanol) | — | — | — | 3.7 | — | — |
| DEQA[24] (85% active in ethanol) | — | — | — | — | 3.7 | — |
| DEQA[25] (85% active in ethanol) | — | — | — | — | — | 3.7 |
| 1,2-Hexanediol | 9 | 9 | 18 | 18 | 18 | 9 |
| 2-Ethyl-1,3-hexanediol | 8 | — | — | — | | 9 |
| 2,2,4-Trimethyl-1,3-pentanediol | — | 9 | — | — | | |
| Ethanol | 2 | — | — | — | — | — |
| Perfume | 1.2 | 1.2 | 1.2 | 1.2 | 1.2 | 1.2 |
| HCl (pH 2–3.5) | 0.005 | 0.005 | 0.005 | 0.005 | 0.005 | 0.005 |
| Distilled Water | Bal. | Bal. | Bal. | Bal. | Bal. | Bal. |

-continued

EXAMPLES 19–21

| Ingredients | Ex. 19 Wt. % | Ex. 20 Wt. % | Ex. 3 Wt. % |
|---|---|---|---|
| DEQA[24] (85% active in ethanol) | 30 | — | 15 |
| DEQA[25] (85% active in ethanol) | — | 30 | 15 |
| 1,2-Hexanediol | 18 | 18 | 18 |
| HCl (pH 2–3.5) | 0.005 | 0.005 | 0.005 |
| Distilled Water | Bal. | Bal. | Bal. |

The above Examples show clear, or translucent, products with acceptable viscosities.

The compositions of Examples 22 are made at ambient temperature by the following process:

1. Prepare the water seat containing HCl.
2. Separately, mix perfume and Tenox antioxidant to the diester softener active.
3. Add the diester active blend into the water seat with mixing.
4. Add about 10–20% of the $CaCl_2$ solution at approximately halfway through the diester addition.
5. Add the remainder of the $CaCl_2$ solution after the diester addition is complete with mixing.

EXAMPLES 22 TO 27

| Ingredients | Ex. 22 Wt. % | Ex. 23 Wt. % | Ex. 24 Wt. % | Ex. 25 Wt. % | Ex. 26 Wt. % | Ex. 27 Wt. % |
|---|---|---|---|---|---|---|
| DEQA[2] (85% active in ethanol) | 18 | — | 15 | — | — | — |
| DEQA[8] (85% active in ethanol) | — | 18 | — | 12 | — | — |
| DEQA[10] (85% active in ethanol) | 9.2 | 9.2 | 15 | 12 | — | — |
| DEQA[24] (85% active in ethanol) | — | — | — | — | 20.8 | — |
| DEQA[25] (85% active in ethanol) | — | — | — | — | — | 28 |
| Perfume | 1.35 | 1.35 | 1.35 | 1.35 | 1.35 | 1.35 |
| Tenox 6 | 0.04 | 0.04 | 0.04 | 0.04 | 0.04 | 0.04 |
| $CaCl_2$ (25% solution) | 2 | 2 | 2 | 2 | 2 | 2 |
| HCl 1N | 0.30 | 0.30 | 0.30 | 0.30 | 0.30 | 0.30 |
| Distilled Water | Bal. | Bal. | Bal. | Bal. | Bal. | Bal. |

The above Examples show dispersion compositions with good stability and performance.

PROCESSING ASPECTS

The principal solvents B. and some mixtures of principal solvents B. and secondary solvents, as disclosed hereinbefore, allow the preparation of premixes comprising the softener active A. (from about 55% to about 85%, preferably from about 60% to about 80%, more preferably from about 65% to about 75%, by weight of the premix); the principal solvent B. (from about 10% to about 30%, preferably from about 13% to about 25%, more preferably from about 15% to about 20%, by weight of the premix); and optionally, the water soluble solvent C (from about 5% to about 20%, preferably from about 5% to about 17%, more preferably from about 5% to about 15%, by weight of the premix). The principal solvents B. can optionally be replaced by a mixture of an effective amount of principal solvents B. and some inoperable solvents, as disclosed hereinbefore. These premixes contain the desired amount of fabric softening active A. and sufficient principal solvent B., and, optionally, solvent C., to give the premix the desired viscosity for the desired temperature range. Typical viscosities suitable for processing are less than about 1000 cps, preferably less than about 500 cps, more preferably less than about 300 cps. Use of low temperatures improves safety, by minimizing solvent vaporization, minimizes the degradation and/or loss of materials such as the biodegradable fabric softener active, perfumes, etc., and reduces the need for heating, thus saving on the expenses for processing. Additional protection for the softener active can be provided by adding, e.g., chelant such as ethylenediaminepentaacetic acid, during preparation of the active. The result is improved environmental impact and safety from the manufacturing operation.

Examples of premixes and processes using them include premixes which typically contain from about 55% to about 85%, preferably from about 60% to about 80%, more preferably from about 65% to about 75%, of fabric softener active A., as exemplified in the above Examples, mixed with from about 10% to about 30%, preferably from about 13% to about 25%, more preferably from about 15% to about 20%, of principal solvent such as 1,2-hexanediol, and from about 5% to about 20%, preferably from about 5% to about 15%, of water soluble solvent C. like ethanol and/or isopropanol.

These premixes can be used to formulate finished compositions in processes comprising the steps of:

1. Make premix of fabric softening active, about 11% ethanol, and about 17% principal solvent, let cool to ambient temperature.
2. Mix perfume in the premix.
3. Make up water seat of water and HCl at ambient temperature. Optionally add chelant.
4. Add premix to water under good agitation.
5. Trim with $CaCl_2$ solution to desired viscosity.
6. Add dye solution to get desired colour.

The fabric softening actives (DEQAs); the principal solvents B.; and, optionally, the water soluble solvents, can be formulated as premixes which can be used to prepare the above compositions.

For commercial purposes, the above clear compositions are introduced into containers, specifically bottles, and more specifically clear bottles (although translucent bottles can be used), made from polypropylene (although glass, oriented polyethylene, etc., can be substituted), the bottle having a light blue tint to compensate for any yellow color that is present, or that may develop during storage (although, for short times, and perfectly clear products, clear containers with no tint, or other tints, can be used), and having an ultraviolet light absorber in the bottle to minimize the effects of ultraviolet light on the materials inside, especially the highly unsaturated actives (the absorbers can also be on the surface). The overall effect of the clarity and the container being to demonstrate the clarity of the compositions, thus assuring the consumer of the quality of the product.

What is claimed is:

1. Biodegradable fabric softener actives having formulas selected from the group consisting of:

1.

$$[(R)_{4-m}-N^{(+)}-[(CH_2)_n-Y-R^1]_m]\ X^{(-)} \quad (1)$$

wherein each R substituent is hydrogen or a short chain $C_1$–$C_6$ alkyl or hydroxyalkyl group; each m is 2 or 3; each n is from 1 to about 4; each Y is —O—(O)C—, —(R)N—(O)C—, —C(O)—N(R)—, or —C(O)—O—; the sum of carbons in each $R^1$, plus one when Y is —O—(O)C— or —(R)N—(O)C—, is $C_6$–$C_{22}$, but no more than one $R^1$, or $YR^1$, sum being less than about 12 and then the other $R^1$, or $YR^1$, sum is at least about 16, with each $R^1$ comprising a long chain $C_5$–$C_{21}$branched alkyl or unsaturated alkyl, optionally substituted, the ratio of branched alkyl to unsaturated alkyl being from about 5:95 to about 95:5, and for the unsaturated alkyl group, the Iodine Value of the parent fatty acid of this $R^1$ group is from about 20 to about 140, and wherein the counterion, $X^-$, can be any softener-compatible anion;

2. softener having the formula:

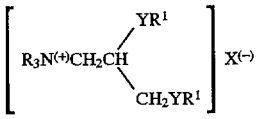

(2)

wherein each Y, R, $R^1$, and $X^{(-)}$ have the same meanings as before; and 3. mixtures thereof, the softener active optionally containing up to about 20% of mono-long chain softener in which one $YR^1$ group is —OH, —N(R)H, or —C(O)OH.

2. The fabric softener active of claim 1 wherein each R substituent is hydrogen or a short chain $C_1$–$C_3$ alkyl or hydroxyalkyl group; each n is 2; each Y is —O—(O)C—; the sum of carbons in each $R^1$ plus one is $C_{12}$–$C_{22}$, and $R^1$ is branched alkyl or unsaturated alkyl, the ratio of branched alkyl to unsaturated alkyl being from about 75:25 to about 25:75, and for the unsaturated alkyl group, the Iodine Value of the parent fatty acid of this $R^1$ group is from about 50 to about 130; and wherein the counterion, $X^-$, is selected from the group consisting of: chloride, bromide, methylsulfate, ethylsulfate, sulfate, and nitrate.

3. The fabric softener active of claim 1 wherein each R substituent is selected from the group consisting of: methyl, ethyl, propyl, hydroxyethyl, and benzyl; each m is 2; each n is 2; each Y is —O—(O)C—; the sum of carbons in each $R^1$, plus one is $C_{14}$–$C_{20}$, with each $R^1$ being a long chain $C_{13}$–$C_{19}$ branched alkyl or unsaturated alkyl, the ratio of branched alkyl to unsaturated alkyl being from about 50:50 to about 30:70, and for the unsaturated alkyl group, the Iodine Value of the parent fatty acid of this $R^1$ group is from about 70 to about 115; and wherein the counterion, $X^-$, is chloride.

4. The fabric softener active of claim 1 having the formula:

$$[(R)_{4-m}-N^{(+)}-[(CH_2)_n-Y-R^1]_m]\ X^{(-)} \quad (1)$$

wherein each R substituent is hydrogen or a short chain $C_1$–$C_6$ alkyl or hydroxyalkyl group; each m is 2 or 3; each Y is —O—(O)C—; the sum of carbons in each $R^1$, plus one, is $C_6$–$C_{22}$, but no more than one $YR^1$ sum being less than about 12 and then the other $YR^1$ sum is at least about 16, with each $R^1$ being a long chain $C_5$–$C_{21}$ branched alkyl or unsaturated alkyl, optionally substituted, the ratio of branched alkyl to unsaturated alkyl being from about 75:25 to about 25:75, and for the unsaturated alkyl group, the Iodine Value of the parent fatty acid of this $R^1$ group is from about 50 to about 130.

5. The fabric softener active of claim 4 wherein each R substituent is hydrogen or a short chain $C_1$–$C_3$ alkyl or hydroxyalkyl group; each n is 2; the sum of carbons in each $R^1$ plus one is $C_{12}$–$C_{20}$; and wherein the counterion, $X^-$, is selected from the group consisting of: chloride, bromide, methylsulfate, ethylsulfate, sulfate, and nitrate.

6. The fabric softener active of claim 4 wherein each R substituent is selected from the group consisting of: methyl, ethyl, propyl, hydroxyethyl, and benzyl; each m is 2; each n is 2; the sum of carbons in each $R^1$, plus one is $C_{14}$–$C_{20}$, with each $R^1$ being a long chain $C_{13}$–$C_{19}$ branched alkyl or unsaturated alkyl, the ratio of branched alkyl to unsaturated alkyl being from about 50:50 to about 30:70; for the unsaturated alkyl group, the Iodine Value of the parent fatty acid of this $R^1$ group is from about 70 to about 115; and wherein the counterion, $X^-$, is chloride.

7. The fabric softener active of claim 1 comprising mixtures of compounds containing (1) primarily branched chain alkyl $R^1$ groups and (2) primarily unsaturated alkyl $R^1$ groups.

8. The fabric softener active of claim 1 comprising compounds containing mixtures of (1) primarily branched chain alkyl $R^1$ groups and (2) primarily unsaturated alkyl $R^1$ groups.

9. Fabric softener composition comprising:

A. from about 2% to about 80%, by weight of the composition, of biodegradable fabric softener active selected from the group consisting of:

1. softener having the formula:

$$[(R)_{4-m}-N^{(+)}-[(CH_2)_n-Y-R^1]_m]\ X^{(-)} \quad (1)$$

wherein each R substituent is hydrogen or a short chain $C_1$–$C_6$ alkyl or hydroxyalkyl group; each m is 2 or 3; each n is from 1 to about 4; each Y is —O—(O)C—, —(R)N—(O)C—, —C(O)—N(R)—, or —C(O)—O—; the sum of carbons in each $R^1$, plus one when Y is —O—(O)C— or —(R)N—(O)C—, is $C_6$–$C_{22}$, but no more than one $R^1$, or $YR^1$, sum being less than about 12 and then the other $R^1$, or $YR^1$, sum is at least about 16, with each $R^1$ comprising a long chain $C_5$–$C_{21}$ branched alkyl or unsaturated alkyl, optionally substituted, the ratio of branched alkyl to unsaturated alkyl being from about 5:95 to about 95:5, and for the unsaturated alkyl group, the Iodine Value of the parent fatty acid of this $R^1$ group is from about 20 to about 140, and wherein the counterion, $X^-$, can be any softener-compatible anion;

2. softener having the formula:

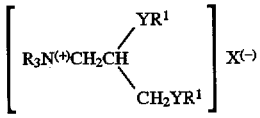

(2)

wherein each Y, R, $R^1$, and $X^{(-)}$ have the same meanings as before; and 3. mixtures thereof, the softener active optionally containing up to about 20% of mono-long chain softener in which one $YR^1$ group is —OH, —N(R)H, or —C(O)OH;

B. optionally, less than about 40%, by weight of the composition of principal solvent having a ClogP of from about 0.15 to about 0.64;

C. optionally, an effective amount, sufficient to improve clarity, of low molecular weight water soluble solvents selected from the group consisting of: ethanol, isopropanol, propylene glycol, 1,3-propanediol, propylene carbonate, and mixtures thereof, said water soluble solvents being at a level that will not form clear compositions by themselves;

D. optionally, an effective amount to improve clarity, of water soluble calcium and/or magnesium salt; and E. the balance being water.

10. The fabric softener composition of claim 9 containing from about 13% to about 75% of said softener active, wherein, in said softener active, each R substituent is hydrogen or a short chain $C_1$–$C_3$ alkyl or hydroxyalkyl group; each n is 2; each Y is —O—(O)C—; the sum of carbons in each $R^1$ plus one is $C_{12}$–$C_{22}$, and $R^1$ is branched alkyl or unsaturated alkyl, the ratio of branched alkyl to unsaturated alkyl being from about 75:25 to about 25:75, and for the unsaturated alkyl group, the Iodine Value of the parent fatty acid of this $R^1$ group is from about 50 to about 130; and wherein the counterion, $X^-$, is selected from the group consisting of: chloride, bromide, methylsulfate, ethylsulfate, sulfate, and nitrate.

11. The fabric softener composition of claim 9 containing from about 15% to about 70% of said softener active, wherein, in said softener active, each R substituent is selected from the group consisting of: methyl, ethyl, propyl, hydroxyethyl, and benzyl; each m is 2; each n is 2; each Y is —O—(O)C—; the sum of carbons in each $R^1$, plus one is $C_{14}$–$C_{20}$, with each $R^1$ being a long chain $C_{13}$–$C_{19}$ branched alkyl or unsaturated alkyl, the ratio of branched alkyl to unsaturated alkyl being from about 50:50 to about 30:70, and for the unsaturated alkyl group, the Iodine Value of the parent fatty acid of this $R^1$ group is from about 70 to about 115; and wherein the counterion, $X^-$, is chloride.

12. The fabric softener composition of claim 9 containing from about 15% to about 70% of said softener active, wherein, said fabric softener active has the formula:

$$[(R)_{4-m}-N^{(+)}-[(CH_2)_n-Y-R^1]_m]\ X^{(-)} \quad (1)$$

wherein each R substituent is hydrogen or a short chain $C_1$–$C_6$ alkyl or hydroxyalkyl group; each m is 2 or 3; each Y is —O—(O)C—; the sum of carbons in each $R^1$, plus one is $C_6$–$C_{22}$, but no more than one $YR^1$ sum being less than about 12 and then the other $YR^1$ sum is at least about 16, with each $R^1$ being a long chain $C_5$–$C_{21}$ branched alkyl or unsaturated alkyl, optionally substituted, the ratio of branched alkyl to unsaturated alkyl being from about 75:25 to about 25:75, and for the unsaturated alkyl group, the Iodine Value of the parent fatty acid of this $R^1$ group is from about 50 to about 130.

13. The fabric softener composition of claim 12 wherein each R substituent is hydrogen or a short chain $C_1$–$C_3$ alkyl or hydroxyalkyl group; each n is 2; the sum of carbons in each $R^1$ plus one is $C_{12}$–$C_{20}$; and wherein the counterion, $X^-$, is selected from the group consisting of: chloride, bromide, methylsulfate, ethylsulfate, sulfate, and nitrate.

14. The fabric softener composition of claim 12 wherein each R substituent is selected from the group consisting of: methyl, ethyl, propyl, hydroxyethyl, and benzyl; each m is 2; each n is 2; the sum of carbons in each $R^1$, plus one is $C_{14}$–$C_{20}$, with each $R^1$ being a long chain $C_{13}$–$C_{19}$ branched alkyl or unsaturated alkyl, the ratio of branched alkyl to unsaturated alkyl being from about 50:50 to about 30:70; for the unsaturated alkyl group, the Iodine Value of the parent fatty acid of this $R^1$ group is from about 70 to about 115; and wherein the counterion, $X^-$, is chloride.

15. The fabric softener composition of claim 9 wherein said ClogP is from about 0.25 to about 0.62.

16. The fabric softener composition of claim 10 wherein said ClogP is from about 0.40 to about 0.60.

17. The fabric softener composition of claim 9 wherein at low water levels of from about 5% to about 15%, the softener active-to-principal solvent weight ratio is from about 55:45 to about 85:15; at water levels of from about 15% to about 70%, the softener active-to-principal solvent weight ratio is from about 45:55 to about 70:30; and at high water levels of from about 70% to about 80%, the softener active-to-principal solvent weight ratio is from about 30:70 to about 55:45.

18. The fabric softener composition of claim 17 wherein at low water levels of from about 5% to about 15%, the softener active-to-principal solvent weight ratio is from about 60:40 to about 80:20; at water levels of from about 15% to about 70%, the softener active-to-principal solvent weight ratio is from about 55:45 to about 70:30; and at high water levels of from about 70% to about 80%, the softener active-to-principal solvent weight ratio is from about 35:65 to about 45:55.

19. The fabric softener composition of claim 9 wherein said principal solvent is selected from the group consisting of:

I. mono-ols including:

a. n-propanol; and/or b. 2-butanol and/or 2-methyl-2-propanol;

II. hexane diol isomers including: 2,3-butanediol, 2,3-dimethyl-; 1,2-butanediol, 2,3-dimethyl-; 1,2-butanediol, 3,3-dimethyl-; 2,3-pentanediol, 2-methyl-; 2,3-pentanediol, 3-methyl-; 2,3-pentanediol, 4-methyl-; 2,3-hexanediol; 3,4-hexanediol; 1,2-butanediol, 2-ethyl-; 1,2-pentanediol, 2-methyl-; 1,2-pentanediol, 3-methyl-; 1,2-pentanediol, 4-methyl-; and/or 1,2-hexanediol;

III. heptane diol isomers including: 1,3-propanediol, 2-butyl-; 1,3-propanediol, 2,2-diethyl-; 1,3-propanediol, 2-(1-methylpropyl)-; 1,3-propanediol, 2-(2-methylpropyl)-; 1,3-propanediol, 2-methyl-2-propyl-; 1,2-butanediol, 2,3,3-trimethyl-; 1,4-butanediol, 2-ethyl-2-methyl-; 1,4-butanediol, 2-ethyl-3-methyl-; 1,4-butanediol, 2-propyl-; 1,4-butanediol, 2-isopropyl-; 1,5-pentanediol, 2,2-dimethyl-; 1,5-pentanediol, 2,3-dimethyl-; 1,5-pentanediol, 2,4-dimethyl-; 1,5-pentanediol, 3,3-dimethyl-; 2,3-pentanediol, 2,3-dimethyl-; 2,3-pentanediol, 2,4-dimethyl-; 2,3-pentanediol, 3,4-dimethyl-; 2,3-pentanediol, 4,4-dimethyl-; 3,4-pentanediol, 2,3-dimethyl-; 1,5-pentanediol, 2-ethyl-; 1,6-hexanediol, 2-methyl-; 1,6-hexanediol, 3-methyl-; 2,3-hexanediol, 2-methyl-; 2,3-hexanediol, 3-methyl-; 2,3-hexanediol, 4-methyl-; 2,3-hexanediol, 5-methyl-; 3,4-hexanediol, 2-methyl-; 3,4-hexanediol, 3-methyl-; 1,3-heptanediol; 1,4-heptanediol; 1,5-heptanediol; and/or 1,6-heptanediol;

IV. octane diol isomers including: 1,3-propanediol, 2-(2-methylbutyl)-; 1,3-propanediol, 2-(1,1-dimethylpropyl)-1,3-propanediol, 2-(1,2-dimethylpropyl)-; 1,3-propanediol, 2-(1-ethylpropyl)-; 1,3-propanediol, 2-(1-methylbutyl)-; 1,3-propanediol, 2-(2,2-dimethylpropyl)-; 1,3-propanediol, 2-(3-methylbutyl)-; 1,3-propanediol, 2-butyl-2-methyl-; 1,3-propanediol, 2-ethyl-2-isopropyl-; 1,3-propanediol, 2-ethyl-2-propyl-; 1,3-propanediol, 2-methyl-2-(1-methylpropyl)-; 1,3-propanediol, 2-methyl-2-(2-methylpropyl)-; 1,3-propanediol, 2-tertiary-butyl-2-methyl-; 1,3-butanediol, 2,2-diethyl-; 1,3-butanediol, 2-(1-methylpropyl)-; 1,3-butanediol, 2-butyl-; 1,3-butanediol, 2-ethyl-2,3-dimethyl-; 1,3-butanediol, 2-(1,1-dimethylethyl)-; 1,3-butanediol, 2-(2-methylpropyl)-; 1,3-butanediol, 2-methyl-2-isopropyl-; 1,3-butanediol, 2-methyl-2-propyl-; 1,3-butanediol, 3-methyl-2-isopropyl-; 1,3-butanediol, 3-methyl-2-propyl-; 1,4-butanediol, 2,2-diethyl-; 1,4-butanediol, 2-methyl-2-propyl-; 1,4-butanediol, 2-(1-methylpropyl)-; 1,4-butanediol, 2-ethyl-2,3-dimethyl-; 1,4-butanediol, 2-ethyl-3,3-dimethyl-; 1,4-butanediol, 2-(1,1-dimethylethyl)-; 1,4-butanediol, 2-(2-methylpropyl)-; 1,4-butanediol, 2-methyl-3-propyl-; 1,4-butanediol, 3-methyl-2-isopropyl-; 1,3-pentanediol, 2,2,3-trimethyl-; 1,3-pentanediol, 2,2,4-trimethyl-; 1,3-pentanediol, 2,3,4-trimethyl-; 1,3-pentanediol, 2,4,4-trimethyl-; 1,3-pentanediol, 3,4,4-trimethyl-; 1,4-pentanediol, 2,2,3-trimethyl-; 1,4-pentanediol, 2,2,4-trimethyl-; 1,4-pentanediol, 2,3,3-trimethyl-; 1,4-pentanediol, 2,3,4-trimethyl-; 1,4-pentanediol, 3,3,4-trimethyl-; 1,5-pentanediol, 2,2,3-trimethyl-; 1,5-pentanediol, 2,2,4-trimethyl-; 1,5-pentanediol, 2,3,3-trimethyl-; 1,5-pentanediol, 2,3,4-trimethyl-; 2,4-pentanediol, 2,3,3-trimethyl-; 2,4-pentanediol, 2,3,4-trimethyl-; 1,3-pentanediol, 2-ethyl-2-methyl-; 1,3-pentanediol, 2-ethyl-3-methyl-; 1,3-pentanediol, 2-ethyl-4-methyl-; 1,3-pentanediol, 3-ethyl-2-methyl-; 1,4-pentanediol, 2-ethyl-2-methyl-; 1,4-pentanediol, 2-ethyl-3-methyl-; 1,4-pentanediol, 2-ethyl-4-methyl-; 1,4-pentanediol, 3-ethyl-2-methyl-; 1,4-pentanediol, 3-ethyl-3-methyl-; 1,5-pentanediol, 2-ethyl-2-methyl-; 1,5-pentanediol, 2-ethyl-3-methyl-; 1,5-pentanediol, 2-ethyl-4-methyl-; 1,5-pentanediol, 3-ethyl-3-methyl-; 2,4-pentanediol, 3-ethyl-2-methyl-; 1,3-pentanediol, 2-isopropyl-; 1,3-pentanediol, 2-propyl-; 1,4-pentanediol, 2-isopropyl-; 1,4-pentanediol, 2-propyl-; 1,4-pentanediol, 3-isopropyl-; 1,5-pentanediol, 2-isopropyl-; 2,4-pentanediol, 3-propyl-; 1,3-hexanediol, 2,2-dimethyl-; 1,3-hexanediol, 2,3-dimethyl-; 1,3-hexanediol, 2,4-dimethyl-; 1,3-hexanediol, 2,5-dimethyl-; 1,3-hexanediol, 3,4-dimethyl-; 1,3-hexanediol, 3,5-dimethyl-; 1,3-hexanediol, 4,5-dimethyl-; 1,4-hexanediol, 2,2-dimethyl-; 1,4-hexanediol, 2,3-dimethyl-; 1,4-hexanediol, 2,4-dimethyl-; 1,4-hexanediol, 2,5-dimethyl-; 1,4-hexanediol, 3,3-dimethyl-; 1,4-hexanediol, 3,4-dimethyl-; 1,4-hexanediol, 3,5-dimethyl-; 1,3-hexanediol, 4,4-dimethyl-; 1,4-hexanediol, 4,5-dimethyl-; 1,4-hexanediol, 5,5-dimethyl-; 1,5-hexanediol, 2,2-dimethyl-; 1,5-hexanediol, 2,3-dimethyl-; 1,5-hexanediol, 2,4-dimethyl-; 1,5-hexanediol, 2,5-dimethyl-; 1,5-hexanediol, 3,3-dimethyl-; 1,5-hexanediol, 3,4-dimethyl-; 1,5-hexanediol, 3,5-dimethyl-; 1,5-hexanediol, 4,5-dimethyl-; 1,6-hexanediol, 2,2-dimethyl-; 1,6-hexanediol, 2,3-dimethyl-; 1,6-hexanediol, 2,4-dimethyl-; 1,6-hexanediol, 2,5-dimethyl-; 1,6-hexanediol, 3,3-dimethyl-; 1,6-hexanediol, 3,4-dimethyl-; 2,4-hexanediol, 2,3-dimethyl-; 2,4-hexanediol, 2,4-dimethyl-; 2,4-hexanediol, 2,5-dimethyl-; 2,4-hexanediol, 3,3-dimethyl-; 2,4-hexanediol, 3,4-dimethyl-; 2,4-hexanediol, 3,5-dimethyl-; 2,4-hexanediol, 4,5-dimethyl-; 2,4-hexanediol, 5,5-dimethyl-; 2,5-hexanediol, 2,3-dimethyl-; 2,5-hexanediol, 2,4-dimethyl-; 2,5-hexanediol, 2,5-dimethyl-; 2,5-hexanediol, 3,3-dimethyl-; 2,5-hexanediol, 3,4-dimethyl-; 2,6-hexanediol, 3,3-dimethyl-; 1,3-hexanediol, 2-ethyl-; 1,3-hexanediol, 4-ethyl-; 1,4-hexanediol, 2-ethyl-; 1,4-hexanediol, 4-ethyl-; 1,5-hexanediol, 2-ethyl-; 2,4-hexanediol, 3-ethyl-; 2,4-hexanediol, 4-ethyl-; 2,5-hexanediol, 3-ethyl-; 1,3-heptanediol, 2-methyl-; 1,3-heptanediol, 3-methyl-; 1,3-heptanediol, 4-methyl-; 1,3-heptanediol, 5-methyl-; 1,3-heptanediol, 6-methyl-; 1,4-heptanediol, 2-methyl-; 1,4-heptanediol, 3-methyl-; 1,4-heptanediol, 4-methyl-; 1,4-heptanediol, 5-methyl-; 1,4-heptanediol, 6-methyl-; 1,5-heptanediol, 2-methyl; 1,5-heptanediol, 3-methyl-; 1,5-heptanediol, 4-methyl-; 1,5-heptanediol, 5-methyl-; 1,5-heptanediol, 6-methyl-; 1,6-heptanediol, 2-methyl-; 1,6-heptanediol, 3-methyl-; 1,6-heptanediol, 4-methyl-; 1,6-heptanediol, 5-methyl-; 1,6-heptanediol, 6-methyl-; 2,4-heptanediol, 2-methyl-; 2,4-heptanediol, 3-methyl-; 2,4-heptanediol, 4-methyl-; 2,4-heptanediol, 5-methyl-; 2,4-heptanediol, 6-methyl-; 2,5-heptanediol, 2-methyl-; 2,5-heptanediol, 3-methyl-; 2,5-heptanediol, 4-methyl-; 2,5-heptanediol, 5-methyl-; 2,5-heptanediol, 6-methyl-; 2,6-heptanediol, 2-methyl-; 2,6-heptanediol, 3-methyl-; 2,6-heptanediol, 4-methyl-; 3,4-heptanediol, 3-methyl-; 3,5-heptanediol, 2-methyl-; 3,5-heptanediol, 3-methyl-; 3,5-heptanediol, 4-methyl-; 2,4-octanediol; 2,5-octanediol; 2,6-octanediol; 2,7-octanediol; 3,5-octanediol; and/or 3,6-octanediol;

V. nonane diol isomers including: 2,4-pentanediol, 2,3,3,4-tetramethyl-; 2,4-pentanediol, 3-tertiarybutyl-; 2,4-hexanediol, 2,5,5-trimethyl-; 2,4-hexanediol, 3,3,4-trimethyl-; 2,4-hexanediol, 3,3,5-trimethyl-; 2,4-hexanediol, 3,5,5-trimethyl-; 2,4-hexanediol, 4,5,5-trimethyl-; 2,5-hexanediol, 3,3,4-trimethyl-; and/or 2,5-hexanediol, 3,3,5-trimethyl-;

VI. glyceryl ethers and/or di(hydroxyalkyl)ethers including: 1,2-propanediol, 3-(n-pentyloxy)-; 1,2-propanediol, 3-(2-pentyloxy)-; 1,2-propanediol, 3-(3-pentyloxy)-; 1,2-propanediol, 3-(2-methyl-1-butyloxy)-; 1,2-propanediol, 3-(iso-amyloxy)-; 1,2-propanediol, 3-(3-methyl-2-butyloxy)-; 1,2-propanediol, 3-(cyclohexyloxy)-; 1,2-propanediol, 3-(1-cyclohex-1-enyloxy)-; 1,3-propanediol, 2-(pentyloxy)-; 1,3-propanediol, 2-(2-pentyloxy)-; 1,3-propanediol, 2-(3-pentyloxy)-; 1,3-propanediol, 2-(2-methyl-1-butyloxy)-; 1,3-propanediol, 2-(iso-amyloxy)-; 1,3-propanediol, 2-(3-methyl-2-butyloxy)-; 1,3-propanediol, 2-(cyclohexyloxy)-; 1,3-propanediol, 2-(1-cyclohex-1-enyloxy)-; 1,2-propanediol, 3-(butyloxy)-, triethoxylated; 1,2-propanediol, 3-(butyloxy)-, tetraethoxylated; 1,2-propanediol, 3-(butyloxy)-, pentaethoxylated; 1,2-propanediol, 3-(butyloxy)-, hexaethoxylated; 1,2-propanediol, 3-(butyloxy)-, heptaethoxylated; 1,2-propanediol, 3-(butyloxy)-, octaethoxylated; 1,2-propanediol, 3-(butyloxy)-, nonaethoxylated; 1,2-propanediol, 3-(butyloxy)-, monopropoxylated; 1,2-propanediol, 3-(butyloxy)-, dibutyleneoxylated; 1,2-propanediol, 3-(butyloxy)-, tributyleneoxylated; 1,2-propanediol, 3-phenyloxy-; 1,2-propanediol, 3-benzyloxy-; 1,2-propanediol, 3-(2-phenylethyloxy)-; 1,2-propanediol, 3-(1-phenyl-2-propanyloxy)-; 1,3-propanediol, 2-phenyloxy-; 1,3-propanediol, 2-(m-cresyloxy)-; 1,3-propanediol, 2-(p-cresyloxy)-; 1,3-propanediol, -benzyloxy-; 1,3-propanediol, 2-(2-phenylethyloxy)-; 1,3-propanediol, 2-(1-phenylethyloxy)-; bis(2-hydroxybutyl)ether; and/or bis(2-hydroxycyclopentyl)ether VII. saturated and unsaturated alicyclic diols and their derivatives including:

(a) the saturated diols and their derivatives, including: 1-isopropyl-1,2-cyclobutanediol; 3-ethyl-4-methyl-1,2-cyclobutanediol; 3-propyl-1,2-cyclobutanediol; 3-isopropyl-1,2-cyclobutanediol; 1-ethyl-1,2-cyclopentanediol; 1,2-dimethyl-1,2-cyclopentanediol; 1,4-dimethyl-1,2-cyclopentanediol; 2,4,5-trimethyl-1,3-cyclopentanediol; 3,3-dimethyl-1,2-cyclopentanediol; 3,4-dimethyl-1,2-cyclopentanediol; 3,5-dimethyl-1,2-cyclopentanediol; 3-ethyl-1,2-cyclopentanediol; 4,4-dimethyl-1,2-cyclopentanediol; 4-ethyl-1,2-cyclopentanediol; 1,1-bis(hydroxymethyl)cyclohexane; 1,2-bis(hydroxymethyl)cyclohexane; 1,2-dimethyl-1,3-cyclohexanediol; 1,3-bis(hydroxymethyl)cyclohexane; 1,3-dimethyl-1,3-cyclohexanediol; 1,6-dimethyl-1,3-cyclohexanediol; 1-hydroxy-cyclohexaneethanol; 1-hydroxy-cyclohexanemethanol; 1-ethyl-1,3-cyclohexanediol; 1-methyl-1,2-cyclohexanediol; 2,2-dimethyl-1,3-cyclohexanediol; 2,3-dimethyl-1,4-cyclohexanediol; 2,4-dimethyl-1,3-cyclohexanediol; 2,5-dimethyl-1,3-cyclohexanediol; 2,6-dimethyl-1,4-cyclohexanediol; 2-ethyl-1,3-cyclohexanediol; 2-hydroxycyclohexaneethanol; 2-hydroxyethyl-1-cyclohexanol; 3-hydroxyethyl-1-cyclohexanol; 3-hydroxycyclohexaneethanol; 3-hydroxymethylcyclohexanol; 3-methyl- 1,2-cyclohexanediol; 4,4-dimethyl-1,3-cyclohexanediol; 4,5-dimethyl-1,3-cyclohexanediol; 4,6-dimethyl-1,3-cyclohexanediol; 4-ethyl-1,3-cyclohexanediol; 4-hydroxyethyl-1-cyclohexanol; 4-methyl-1,2-cyclohexanediol; 5,5-dimethyl-1,3-cyclohexanediol; 5-ethyl-1,3-cyclohexanediol; 1,2-cycloheptanediol; 2-methyl-1,3-cycloheptanediol; 2-methyl-1,4-cycloheptanediol; 4-methyl-1,3-cycloheptanediol; 5-methyl-1,3-cycloheptanediol; 5-methyl-1,4-cycloheptanediol; 6-methyl-1,4-cycloheptanediol; 1,3-cyclooctanediol; 1,4-cyclooctanediol; 1,5-cyclooctanediol; 1,2-cyclohexanediol, diethoxylate; 1,2-cyclohexanediol, triethoxylate; 1,2-cyclohexanediol, tetraethoxylate; 1,2-cyclohexanediol, pentaethoxylate; 1,2-cyclohexanediol, hexaethoxylate; 1,2-cyclohexanediol, heptaethoxylate; 1,2-cyclohexanediol, octaethoxylate; 1,2-cyclohexanediol, nonaethoxylate; 1,2-cyclohexanediol, monopropoxylate; 1,2-cyclohexanediol, monobutylenoxylate; 1,2-cyclohexanediol, dibutylenoxylate; and/or 1,2-cyclohexanediol, tributylenoxylate; and (b). the unsaturated alicyclic diols including: 1,2-cyclobutanediol, 1-ethenyl-2-ethyl-; 3-cyclobutene-1,2-diol, 1,2,3,4-tetramethyl-; 3-cyclobutene-1,2-diol, 3,4-diethyl-; 3-cyclobutene-1,2-diol, 3-(1,1-dimethylethyl)-; 3-cyclobutene-1,2-diol, 3-butyl-; 1,2-cyclopentanediol, 1,2-dimethyl-4-methylene-; 1,2-cyclopentanediol, 1-ethyl-3-methylene-; 1,2-cyclopentanediol, 4-(1-propenyl); 3-cyclopentene-1,2-diol, 1-ethyl-3-methyl-; 1,2-cyclohexanediol, 1-ethenyl-; 1,2-cyclohexanediol, 1-methyl-3-methylene-; 1,2-cyclohexanediol, 1-methyl-4-methylene-; 1,2-cyclohexanediol, 3-ethenyl-; 1,2-cyclohexanediol, 4-ethenyl-; 3-cyclohexene-1,2-diol, 2,6-dimethyl-; 3-cyclohexene-1,2-diol, 6,6-dimethyl-; 4-cyclohexene-1,2-diol, 3,6-dimethyl-; 4-cyclohexene-1,2-diol, 4,5-dimethyl-; 3-cyclooctene-1,2-diol; 4-cyclooctene-1,2-diol; and/or 5-cyclooctene-1,2-diol;

VIII. Alkoxylated derivatives of $C_{3-8}$ diols including: p2

1. 1,2-propanediol (C3) 2(Me-$E_{1-4}$); 1,2-propanediol (C3) $PO_4$; 1,2-propanediol, 2-methyl- (C4) (Me-$E_{4-10}$); 1,2-propanediol, 2-methyl- (C4) 2(Me-$E_1$); 1,2-propanediol, 2-methyl- (C4) $PO_3$; 1,2-propanediol, 2-methyl- (C4) $BO_1$; 1,3-propanediol (C3) 2(Me-$E_{6-8}$); 1,3-propanediol (C3) $PO_{5-6}$; 1,3-propanediol, 2,2-diethyl- (C7) $E_{1-7}$; 1,3-propanediol, 2,2-diethyl- (C7) $PO_1$; 1,3-propanediol, 2,2-diethyl- (C7) n-$BO_{1-2}$; 1,3-propanediol, 2,2-dimethyl- (C5) 2(Me $E_{1-2}$); 1,3-propanediol, 2,2-dimethyl- (C5) $PO_{3-4}$; 1,3-propanediol, 2-(1-methylpropyl)- (C7) $E_{1-7}$; 1,3-propanediol, 2-(1-methylpropyl)- (C7) $PO_1$; 1,3-propanediol, 2-(1-methylpropyl)- (C7) n-$BO_{1-2}$; 1,3-propanediol, 2-(2-methylpropyl)- (C7) $E_{1-7}$; 1,3-propanediol, 2-(2-methylpropyl)- (C7) $PO_1$; 1,3-propanediol, 2-(2-methylpropyl)- (C7) n-$BO_{1-2}$; 1,3-propanediol, 2-ethyl- (C5) (Me $E_{6-10}$); 1,3-propanediol, 2-ethyl- (C5) 2(Me $E_1$); 1,3-propanediol, 2-ethyl- (C5) $PO_3$; 1,3-propanediol, 2-ethyl-2-methyl- (C6) (Me E-$_{1-6}$); 1,3-propanediol, 2-ethyl-2-methyl- (C6) $PO_2$; 1,3-propanediol, 2-ethyl-2-methyl- (C6) $BO_1$; 1,3-propanediol, 2-isopropyl- (C6) (Me $E_{1-6}$); 1,3-propanediol, 2-isopropyl- (C6) $PO_2$; 1,3-propanediol, 2-isopropyl- (C6) $BO_1$; 1,3-propanediol, 2-methyl- (C4) 2(Me $E_{2-5}$); 1,3-propanediol, 2-methyl- (C4) $PO_{4-5}$; 1,3-propanediol, 2-methyl- (C4) $BO_2$; 1,3-propanediol, 2-methyl-2-isopropyl- (C7) $E_{2-9}$; 1,3-propanediol, 2-methyl-2-isopropyl- (C7) $PO_1$; 1,3-propanediol, 2-methyl-2-isopropyl- (C7) n-$BO_{1-3}$; 1,3-propanediol, 2-methyl-2-propyl- (C7) $E_{1-7}$; 1,3-propanediol, 2-methyl-2-propyl- (C7) $PO_1$; 1,3-propanediol, 2-methyl-2-propyl- (C7) n-$BO_{1-2}$; 1,3-propanediol, 2-propyl- (C6) (Me $E_{1-4}$); 1,3-propanediol, 2-propyl- (C6) $PO_2$; 1,3-propanediol, 2-propyl- (C6) $BO_1$;

2. 1,2-butanediol (C4) (Me $E_{2-8}$); 1,2-butanediol (C4) $PO_{2-3}$; 1,2-butanediol (C4) $BO_1$; 1,2-butanediol, 2,3-dimethyl- (C6) $E_{1-6}$; 1,2-butanediol, 2,3-dimethyl- (C6) n-$BO_{1-2}$; 1,2-butanediol, 2-ethyl- (C6) $E_{1-3}$; 1,2-butanediol, 2-ethyl- (C6) n-$BO_1$; 1,2-butanediol, 2-methyl- (C5) (Me $E_{1-2}$); 1,2-butanediol, 2-methyl- (C5) $PO_1$; 1,2-butanediol, 3,3-dimethyl- (C6) $E_{1-6}$; 1,2-butanediol, 3,3-dimethyl- (C6) n-$BO_{1-2}$; 1,2-butanediol, 3-methyl- (C5) (Me $E_{1-2}$); 1,2-butanediol, 3-methyl- (C5) $PO_1$; 1,3-butanediol (C4) 2(Me $E_{3-6}$); 1,3-butanediol (C4) $PO_5$; 1,3-butanediol (C4) $BO_2$; 1,3-butanediol, 2,2,3-trimethyl- (C7) (Me $E_{1-3}$); 1,3-butanediol, 2,2,3-trimethyl- (C7) $PO_{1-2}$; 1,3-butanediol, 2,2-dimethyl- (C6) (Me $E_{3-8}$); 1,3-butanediol, 2,2-dimethyl- (C6) $PO_3$; 1,3-butanediol, 2,3-dimethyl- (C6) (Me $E_{3-8}$); 1,3-butanediol, 2,3-dimethyl- (C6) $PO_3$; 1,3-butanediol, 2-ethyl- (C6) (Me $E_{1-6}$); 1,3-butanediol, 2-ethyl- (C6) $PO_{2-3}$; 1,3-butanediol, 2-ethyl- (C6) $BO_1$; 1,3-butanediol, 2-ethyl-2-methyl- (C7) (Me $E_1$); 1,3-butanediol, 2-ethyl-2-methyl- (C7) $PO_1$; 1,3-butanediol, 2-ethyl-2-methyl- (C7) n-$BO_{2-4}$; 1,3-butanediol, 2-ethyl-3-methyl- (C7) (Me $E_1$); 1,3-butanediol, 2-ethyl-3-methyl- (C7) $PO_1$; 1,3-butanediol, 2-ethyl-3-methyl- (C7) n-$BO_{2-4}$; 1,3-butanediol, 2-isopropyl- (C7) (Me $E_1$); 1,3-butanediol, 2-isopropyl- (C7) $PO_1$; 1,3-butanediol, 2-isopropyl- (C7) n-$BO_{2-4}$; 1,3-butanediol, 2-methyl- (C5) 2(Me $E_{1-3}$); 1,3-butanediol, 2-methyl- (C5) $PO_4$; 1,3-butanediol, 2-propyl- (C7) $E_{2-9}$; 1,3-butanediol, 2-propyl- (C7) $PO_1$; 1,3-butanediol, 2-propyl- (C7) n-$BO_{1-3}$; 1,3-butanediol, 3-methyl- (C5) 2(Me $E_{1-3}$); 1,3-butanediol, 3-methyl- (C5) $PO_4$; 1,4-butanediol (C4)

2(Me $E_{2-4}$); 1,4-butanediol (C4) $PO_{4-5}$; 1,4-butanediol (C4) $BO_2$; 1,4-butanediol, 2,2,3-trimethyl- (C7) $E_{2-9}$; 1,4-butanediol, 2,2,3-trimethyl- (C7) $PO_1$; 1,4-butanediol, 2,2,3-trimethyl- (C7) n-$BO_{1-3}$; 1,4-butanediol, 2,2-dimethyl- (C6) (Me $E_{1-6}$); 1,4-butanediol, 2,2-dimethyl- (C6) $PO_2$; 1,4-butanediol, 2,2-dimethyl- (C6) $BO_1$; 1,4-butanediol, 2,3-dimethyl- (C6) (Me $E_{1-6}$); 1,4-butanediol, 2,3-dimethyl- (C6) $PO_2$; 1,4-butanediol, 2,3-dimethyl- (C6) $BO_1$; 1,4-butanediol, 2-ethyl- (C6) (Me $E_{1-4}$); 1,4-butanediol, 2-ethyl- (C6) $PO_2$; 1,4-butanediol, 2-ethyl- (C6) $BO_1$; 1,4-butanediol, 2-ethyl-2-methyl- (C7) $E_{1-7}$; 1,4-butanediol, 2-ethyl-2-methyl- (C7) $PO_1$; 1,4-butanediol, 2-ethyl-2-methyl- (C7) n-$BO_{1-2}$; 1,4-butanediol, 2-ethyl-3-methyl- (C7) $E_{1-7}$; 1,4-butanediol, 2-ethyl-3-methyl- (C7) $PO_1$; 1,4-butanediol, 2-ethyl-3-methyl- (C7) n-$BO_{1-2}$; 1,4-butanediol, 2-isopropyl- (C7) $E_{1-7}$; 1,4-butanediol, 2-isopropyl- (C7) $PO_1$; 1,4-butanediol, 2-isopropyl- (C7) n-$BO_{1-2}$; 1,4-butanediol, 2-methyl- (C5) (Me $E_{6-10}$); 1,4-butanediol, 2-methyl- (C5) 2(Me $E_1$); 1,4-butanediol, 2-methyl- (C5) $PO_3$; 1,4-butanediol, 2-methyl- (C5) $BO_1$; 1,4-butanediol, 2-propyl- (C7) $E_{1-5}$; 1,4-butanediol, 2-propyl- (C7) n-$BO_{1-2}$; 1,4-butanediol, 3-ethyl-1-methyl- (C7) $E_{2-9}$; 1,4-butanediol, 3-ethyl-1-methyl- (C7) $PO_1$; 1,4-butanediol, 3-ethyl-1-methyl- (C7) n-$BO_{1-3}$; 2,3-butanediol (C4) (Me $E_{6-10}$); 2,3-butanediol (C4) 2(Me $E_1$); 2,3-butanediol (C4) $PO_{3-4}$; 2,3-butanediol (C4) $BO_1$; 2,3-butanediol, 2,3-dimethyl- (C6) $E_{3-9}$; 2,3-butanediol, 2,3-dimethyl- (C6) $PO_1$; 2,3-butanediol, 2,3-dimethyl- (C6) n-$BO_{1-3}$; 2,3-butanediol, 2-methyl- (C5) (Me $E_{1-5}$); 2,3-butanediol, 2-methyl- (C5) $PO_2$; 2,3-butanediol, 2-methyl- (C5) $BO_1$;

3. 1,2-pentanediol (C5) $E_{3-10}$; 1,2-pentanediol, (C5) $PO_1$; 1,2-pentanediol, (C5) n-$BO_{2-3}$; 1,2-pentanediol, 2-methyl (C6) $E_{1-3}$; 1,2-pentanediol, 2-methyl (C6) n-$BO_1$; 1,2-pentanediol, 2-methyl (C6) $BO_1$; 1,2-pentanediol, 3-methyl (C6) $E_{1-3}$; 1,2-pentanediol, 3-methyl (C6) n-$BO_1$; 1,2-pentanediol, 4-methyl (C6) $E_{1-3}$; 1,2-pentanediol, 4-methyl (C6) n-$BO_1$; 1,3-pentanediol (C5) 2(Me-$E_{1-2}$); 1,3-pentanediol (C5) $PO_{3-4}$; 1,3-pentanediol, 2,2-dimethyl- (C7) (Me-$E_1$); 1,3-pentanediol, 2,2-dimethyl- (C7) $PO_1$; 1,3-pentanediol, 2,2-dimethyl- (C7) n-$BO_{2-4}$; 1,3-pentanediol, 2,3-dimethyl- (C7) (Me-$E_1$); 1,3-pentanediol, 2,3-dimethyl- (C7) $PO_1$; 1,3-pentanediol, 2,3-dimethyl- (C7) n-$BO_{2-4}$; 1,3-pentanediol, 2,4-dimethyl- (C7) (Me-$E_1$); 1,3-pentanediol, 2,4-dimethyl- (C7) $PO_1$; 1,3-pentanediol, 2,4-dimethyl- (C7) n-$BO_{2-4}$; 1,3-pentanediol, 2-ethyl- (C7) $E_{2-9}$; 1,3-pentanediol, 2-ethyl- (C7) $PO_1$; 1,3-pentanediol, 2-ethyl- (C7) n-$BO_{1-3}$; 1,3-pentanediol, 2-methyl- (C6) 2(Me-$E_{1-6}$); 1,3-pentanediol, 2-methyl- (C6) $PO_{2-3}$; 1,3-pentanediol, 2-methyl- (C6) $BO_1$; 1,3-pentanediol, 3,4-dimethyl- (C7) (Me-$E_1$); 1,3-pentanediol, 3,4-dimethyl- (C7) $PO_1$; 1,3-pentanediol, 3,4-dimethyl- (C7) n-$BO_{2-4}$; 1,3-pentanediol, 3-methyl- (C6) (Me-$E_{1-6}$); 1,3-pentanediol, 3-methyl- (C6) $PO_{2-3}$; 1,3-pentanediol, 3-methyl- (C6) $BO_1$; 1,3-pentanediol, 4,4-dimethyl- (C7) (Me-$E_1$); 1,3-pentanediol, 4,4-dimethyl- (C7) $PO_1$; 1,3-pentanediol, 4,4-dimethyl- (C7) n-$BO_{2-4}$; 1,3-pentanediol, 4-methyl- (C6) (Me-$E_{1-6}$); 1,3-pentanediol, 4-methyl- (C6) $PO_{2-3}$; 1,3-pentanediol, 4-methyl- (C6) $BO_1$; 1,4-pentanediol, (C5) 2(Me-$E_{1-2}$); 1,4-pentanediol (C5) $PO_{3-4}$; 1,4-pentanediol, 2,2-dimethyl- (C7) (Me-$E_1$); 1,4-pentanediol, 2,2-dimethyl- (C7) $PO_1$; 1,4-pentanediol, 2,2-dimethyl- (C7) n-$BO_{2-4}$; 1,4-pentanediol, 2,3-dimethyl- (C7) (Me-$E_1$); 1,4-pentanediol, 2,3-dimethyl- (C7) $PO_1$; 1,4-pentanediol, 2,3-dimethyl- (C7) n-$BO_{2-4}$; 1,4-pentanediol, 2,4-dimethyl- (C7) (Me-$E_1$); 1,4-pentanediol, 2,4-dimethyl- (C7) $PO_1$; 1,4-pentanediol, 2,4-dimethyl- (C7) n-$BO_{2-4}$; 1,4-pentanediol, 2-methyl- (C6) (Me-$E_{1-6}$); 1,4-pentanediol, 2-methyl- (C6) $PO_{2-3}$; 1,4-pentanediol, 2-methyl- (C6) $BO_1$; 1,4-pentanediol, 3,3-dimethyl- (C7) (Me-$E_1$); 1,4-pentanediol, 3,3-dimethyl- (C7) $PO_1$; 1,4-pentanediol, 3,3-dimethyl- (C7) n-$BO_{2-4}$; 1,4-pentanediol, 3,4-dimethyl- (C7) (Me-$E_1$); 1,4-pentanediol, 3,4-dimethyl- (C7) $PO_1$; 1,4-pentanediol, 3,4-dimethyl- (C7) n-$BO_{2-4}$; 1,4-pentanediol, 3-methyl- (C6) 2(Me-$E_{1-6}$); 1,4-pentanediol, 3-methyl- (C6) $PO_{2-3}$; 1,4-pentanediol, 3-methyl- (C6) $BO_1$; 1,4-pentanediol, 4-methyl- (C6) 2(Me-$E_{1-6}$); 1,4-pentanediol, 4-methyl- (C6) $PO_{2-3}$; 1,4-pentanediol, 4-methyl- (C6) $BO_1$; 1,5-pentanediol, (C5) (Me-$E_{4-10}$); 1,5-pentanediol (C5) 2(Me-$E_1$); 1,5-pentanediol (C5) $PO_3$; 1,5-pentanediol, 2,2-dimethyl- (C7) $E_{1-7}$; 1,5-pentanediol, 2,2-dimethyl- (C7) $PO_1$; 1,5-pentanediol, 2,2-dimethyl- (C7) n-$BO_{1-2}$; 1,5-pentanediol, 2,3-dimethyl- (C7) $E_{1-7}$; 1,5-pentanediol, 2,3-dimethyl- (C7) $PO_1$; 1,5-pentanediol, 2,3-dimethyl- (C7) n-$BO_{1-2}$; 1,5-pentanediol, 2,4-dimethyl- (C7) $E_{1-7}$; 1,5-pentanediol, 2,4-dimethyl- (C7) $PO_1$; 1,5-pentanediol, 2,4-dimethyl- (C7) n-$BO_{1-2}$; 1,5-pentanediol, 2-ethyl- (C7) $E_{1-5}$; 1,5-pentanediol, 2-ethyl- (C7) n-$BO_{1-2}$; 1,5-pentanediol, 2-methyl- (C6) (Me-$E_{1-4}$); 1,5-pentanediol, 2-methyl- (C6) $PO_2$; 1,5-pentanediol, 3,3-dimethyl- (C7) $E_{1-7}$; 1,5-pentanediol, 3,3-dimethyl- (C7) $PO_1$; 1,5-pentanediol, 3,3-dimethyl- (C7) n-$BO_{1-2}$; 1,5-pentanediol, 3-methyl- (C6) (Me-$E_{1-4}$); 1,5-pentanediol, 3-methyl- (C6) $PO_2$; 2,3-pentanediol, (C5) (Me-$E_{1-3}$); 2,3-pentanediol, (C5) $PO_2$; 2,3-pentanediol, 2-methyl- (C6) $E_{1-7}$; 2,3-pentanediol, 2-methyl- (C6) $PO_1$; 2,3-pentanediol, 2-methyl- (C6) n-$BO_{1-2}$; 2,3-pentanediol, 3-methyl- (C6) $E_{1-7}$; 2,3-pentanediol, 3-methyl- (C6) $PO_1$; 2,3-pentanediol, 3-methyl- (C6) n-$BO_{1-2}$; 2,3-pentanediol, 4-methyl- (C6) $E_{1-7}$; 2,3-pentanediol, 4-methyl-(C6) $PO_1$; 2,3-pentanediol, 4-methyl- (C6) n-$BO_{1-2}$; 2,4-pentanediol, (C5) 2(Me-$E_{1-4}$); 2,4-pentanediol (C5) $PO_4$; 2,4-pentanediol, 2,3-dimethyl- (C7) (Me-$E_{1-4}$); 2,4-pentanediol, 2,3-dimethyl- (C7) $PO_2$; 2,4-pentanediol, 2,4-dimethyl- (C7) (Me-$E_{1-4}$); 2,4-pentanediol, 2,4-dimethyl- (C7) $PO_2$; 2,4-pentanediol, 2-methyl- (C7) (Me-$E_{5-10}$); 2,4-pentanediol, 2-methyl- (C7) $PO_3$; 2,4-pentanediol, 3,3-dimethyl- (C7) (Me-$E_{1-4}$); 2,4-pentanediol, 3,3-dimethyl- (C7) $PO_2$; 2,4-pentanediol, 3-methyl- (C6) (Me-$E_{5-10}$); 2,4-pentanediol, 3-methyl- (C6) $PO_3$;

4. 1,3-hexanediol (C6) (Me-$E_{1-5}$); 1,3-hexanediol (C6) $PO_2$; 1,3-hexanediol (C6) $BO_1$; 1,3-hexanediol, 2-methyl- (C7) $E_{2-9}$; 1,3-hexanediol, 2-methyl- (C7) $PO_1$; 1,3-hexanediol, 2-methyl- (C7) n-$BO_{1-3}$; 1,3-hexanediol, 2-methyl- (C7) $BO_1$; 1,3-hexanediol, 3-methyl- (C7) $E_{2-9}$; 1,3-hexanediol, 3-methyl-(C7) $PO_1$; 1,3-hexanediol, 3-methyl- (C7) n-$BO_{1-3}$; 1,3-hexanediol, 4-methyl- (C7) $E_{2-9}$; 1,3-hexanediol, 4-methyl- (C7) $PO_1$; 1,3-hexanediol, 4-methyl- (C7) n-$BO_{1-3}$; 1,3-hexanediol, 5-methyl- (C7) $E_{2-9}$; 1,3-hexanediol, 5-methyl- (C7) $PO_1$; 1,3-hexanediol, 5-methyl- (C7) n-$BO_{1-3}$; 1,4-hexanediol (C6) (Me-$E_{1-5}$); 1,4-hexanediol (C6) $PO_2$; 1,4-hexanediol (C6) $BO_1$; 1,4-hexanediol, 2-methyl- (C7) $E_{2-9}$; 1,4-hexanediol, 2-methyl- (C7) $PO_1$; 1,4-hexanediol, 2-methyl- (C7) n-$BO_{1-3}$; 1,4-hexanediol, 3-methyl- (C7) $E_{2-9}$; 1,4-hexanediol, 3-methyl- (C7) $PO_1$; 1,4-hexanediol, 3-methyl- (C7) n-$BO_{1-3}$; 1,4-hexanediol, 4-methyl- (C7) $E_{2-9}$; 1,4-hexanediol, 4-methyl- (C7) $PO_1$; 1,4-hexanediol, 4-methyl- (C7) n-$BO_{1-3}$; 1,4-hexanediol, 5-methyl- (C7) $E_{2-9}$; 1,4-hexanediol, 5-methyl- (C7) $PO_1$; 1,4-hexanediol, 5-methyl- (C7) n-$BO_{1-3}$; 1,5-hexanediol (C6) (Me-$E_{1-5}$); 1,5-hexanediol (C6) $PO_2$; 1,5-hexanediol (C6) $BO_1$; 1,5-hexanediol, 2-methyl- (C7) $E_{2-9}$; 1,5-hexanediol, 2-methyl- (C7) $PO_1$; 1,5-hexanediol, 2-methyl- (C7) n-$BO_{1-3}$; 1,5-hexanediol, 3-methyl- (C7) $E_{2-9}$; 1,5-hexanediol, 3-methyl- (C7) $PO_1$; 1,5-hexanediol, 3-methyl- (C7) n-$BO_{1-3}$; 1,5-hexanediol, 4-methyl- (C7) $E_{2-9}$; 1,5-hexanediol, 4-methyl- (C7) $PO_1$; 1,5-hexanediol, 4-methyl- (C7) n-$BO_{1-3}$; 1,5-hexanediol, 5-methyl- (C7) $E_{2-9}$; 1,5-hexanediol, 5-methyl- (C7) $PO_1$; 1,5-hexanediol, 5-methyl- (C7) n-$BO_{1-3}$; 1,6-hexanediol (C6) (Me-$E_{1-2}$); 1,6-hexanediol (C6) $PO_{1-2}$; 1,6-hexanediol (C6) n-$BO_4$; 1,6-hexanediol, 2-methyl- (C7) $E_{1-5}$; 1,6-hexanediol, 2-methyl- (C7) n-$BO_{1-2}$; 1,6-hexanediol, 3-methyl- (C7) $E_{1-5}$; 1,6-hexanediol, 3-methyl- (C7) n-$BO_{1-2}$; 2,3-hexanediol (C6) $E_{1-5}$; 2,3-hexanediol (C6) n-$BO_1$; 2,3-hexanediol (C6) $BO_1$; 2,4-hexanediol (C6) (Me-$E_{3-8}$); 2,4-hexanediol (C6) $PO_3$; 2,4-hexanediol, 2-methyl- (C7) (Me-$E_{1-2}$); 2,4-hexanediol 2-methyl- (C7) $PO_{1-2}$; 2,4-hexanediol, 3-methyl- (C7) (Me-$E_{1-2}$); 2,4-hexanediol 3-methyl- (C7) $PO_{1-2}$; 2,4-hexanediol, 4-methyl- (C7) (Me-$E_{1-2}$); 2,4-hexanediol 4-methyl- (C7) $PO_{1-2}$; 2,4-hexanediol, 5-methyl- (C7) (Me-$E_{1-2}$); 2,4-hexanediol 5-methyl- (C7) $PO_{1-2}$; 2,5-hexanediol (C6) (Me-$E_{3-8}$); 2,5-hexanediol (C6) $PO_3$; 2,5-hexanediol, 2-methyl- (C7) (Me-$E_{1-2}$); 2,5-hexanediol 2-methyl- (C7) $PO_{1-2}$; 2,5-hexanediol, 3-methyl- (C7) (Me-$E_{1-2}$); 2,5-hexanediol 3-methyl- (C7) $PO_{1-2}$; 3,4-hexanediol (C6) $EO_{1-5}$; 3,4-hexanediol (C6) n-$BO_1$; 3,4-hexanediol (C6) $BO_1$;

5. 1,3-heptanediol (C7) $E_{1-7}$; 1,3-heptanediol (C7) $PO_1$; 1,3-heptanediol (C7) n-$BO_{1-2}$; 1,4-heptanediol (C7) $E_{1-7}$; 1,4-heptanediol (C7) $PO_1$; 1,4-heptanediol (C7) n-$BO_{1-2}$; 1,5-heptanediol (C7) $E_{1-7}$; 1,5-heptanediol (C7) $PO_1$; 1,5-heptanediol (C7) n-$BO_{1-2}$; 1,6-heptanediol (C7) $E_{1-7}$; 1,6-heptanediol (C7) $PO_1$; 1,6-heptanediol (C7) n-$BO_{1-2}$; 1,7-heptanediol (C7) $E_{1-2}$; 1,7-heptanediol (C7) n-$BO_1$; 2,4-heptanediol (C7) $E_{3-10}$; 2,4-heptanediol (C7) (Me-$E_1$); 2,4-heptanediol (C7) $PO_1$; 2,4-heptanediol (C7) n-$BO_3$; 2,5-heptanediol (C7) $E_{3-10}$; 2,5-heptanediol (C7) (Me-$E_1$); 2,5-heptanediol (C7) $PO_1$; 2,5-heptanediol (C7) n-$BO_3$; 2,6-heptanediol (C7) $E_{3-10}$; 2,6-heptanediol (C7) (Me-$E_1$); 2,6-heptanediol (C7) $PO_1$; 2,6-heptanediol (C7) n-$BO_3$; 3,5-heptanediol (C7) $E_{3-10}$; 3,5-heptanediol (C7) (Me-$E_1$); 3,5-heptanediol (C7) $PO_1$; 3,5-heptanediol (C7) n-$BO_3$;

6. 1,3-butanediol, 3-methyl-2-isopropyl- (C8) $PO_1$; 2,4-pentanediol, 2,3,3-trimethyl- (C8) $PO_1$; 1,3-butanediol, 2,2-diethyl- (C8) $E_{2-5}$; 2,4-hexanediol, 2,3-dimethyl- (C8) $E_{2-5}$; 2,4-hexanediol, 2,4-dimethyl- (C8) $E_{2-5}$; 2,4-hexanediol, 2,5-dimethyl- (C8) $E_{2-5}$; 2,4-hexanediol, 3,3-dimethyl- (C8) $E_{2-5}$; 2,4-hexanediol, 3,4-dimethyl- (C8) $E_{2-5}$; 2,4-hexanediol, 3,5-dimethyl- (C8) $E_{2-5}$; 2,4-hexanediol, 4,5-dimethyl- (C8) $E_{2-5}$; 2,4-hexanediol, 5,5-dimethyl- (C8) $E_{2-5}$; 2,5-hexanediol, 2,3-dimethyl- (C8) $E_{2-5}$; 2,5-hexanediol, 2,4-dimethyl- (C8) $E_{2-5}$; 2,5-hexanediol, 2,5-dimethyl- (C8) $E_{2-5}$; 2,5-hexanediol, 3,3-dimethyl- (C8) $E_{2-5}$; 2,5-hexanediol, 3,4-dimethyl- (C8) $E_{2-5}$; 3,5-heptanediol, 3-methyl- (C8) $E_{2-5}$; 1,3-butanediol, 2,2-diethyl- (C8) n-$BO_{1-2}$; 2,4-hexanediol, 2,3-dimethyl- (C8) n-$BO_{1-2}$; 2,4-hexanediol, 2,4-dimethyl- (C8) n-$BO_{1-2}$; 2,4-hexanediol, 2,5-dimethyl- (C8) n-$BO_{1-2}$; 2,4-hexanediol, 3,3-dimethyl- (C8) n-$BO_{1-2}$; 2,4-hexanediol, 3,4-dimethyl-(C8) n-$BO_{1-2}$; 2,4-hexanediol, 3,5-dimethyl- (C8) n-$BO_{1-2}$; 2,4-hexanediol, 4,5-dimethyl- (C8) n-$BO_{1-2}$; 2,4-hexanediol, 5,5-dimethyl-, n-$BO_{1-2}$; 2,5-hexanediol, 2,3-dimethyl- (C8) n-$BO_{1-2}$; 2,5-hexanediol, 2,4-dimethyl- (C8) n-$BO_{1-2}$; 2,5-hexanediol, 2,5-dimethyl- (C8) n-$BO_{1-2}$; 2,5-hexanediol, 3,3-dimethyl- (C8) n-$BO_{1-2}$; 2,5-hexanediol, 3,4-dimethyl- (C8) n-$BO_{1-2}$; 3,5-heptanediol, 3-methyl- (C8) n-$BO_{1-2}$; 1,3-propanediol, 2-(1,2-dimethylpropyl)- (C8) n-$BO_1$; 1,3-butanediol, 2-ethyl-2,3-dimethyl- (C8) n-$BO_1$; 1,3-butanediol, 2-methyl-2-isopropyl- (C8) n-$BO_1$; 1,4-butanediol, 3-methyl-2-isopropyl- (C8) n-$BO_1$; 1,3-pentanediol, 2,2,3-trimethyl- (C8) n-$BO_1$; 1,3-pentanediol, 2,2,4-trimethyl- (C8) n-$BO_1$; 1,3-pentanediol, 2,4,4-trimethyl- (C8) n-$BO_1$; 1,3-pentanediol, 3,4,4-trimethyl- (C8) n-$BO_1$; 1,4-pentanediol, 2,2,3-trimethyl- (C8) n-$BO_1$; 1,4-pentanediol, 2,2,4-trimethyl- (C8) n-$BO_1$; 1,4-pentanediol, 2,3,3-trimethyl- (C8) n-$BO_1$; 1,4-pentanediol, 2,3,4-trimethyl- (C8) n-$BO_1$; 1,4-pentanediol, 3,3,4-trimethyl- (C8) n-$BO_1$; 2,4-pentanediol, 2,3,4-trimethyl- (C8) n-$BO_1$; 2,4-hexanediol, 4-ethyl- (C8) n-$BO_1$; 2,4-heptanediol, 2-methyl- (C8) n-$BO_1$; 2,4-heptanediol, 3-methyl- (C8) n-$BO_1$; 2,4-heptanediol, 4-methyl- (C8) n-$BO_1$; 2,4-heptanediol, 5-methyl- (C8) n-$BO_1$; 2,4-heptanediol, 6-methyl- (C8) n-$BO_1$; 2,5-heptanediol, 2-methyl- (C8) n-$BO_1$; 2,5-heptanediol, 3-methyl- (C8) n-$BO_1$; 2,5-heptanediol, 4-methyl- (C8) n-$BO_1$; 2,5-heptanediol, 5-methyl- (C8) n-$BO_1$; 2,5-heptanediol, 6-methyl- (C8) n-$BO_1$; 2,6-heptanediol, 2-methyl- (C8) n-$BO_1$; 2,6-heptanediol, 3-methyl- (C8) n-$BO_1$; 2,6-heptanediol, 4-methyl- (C8) n-$BO_1$; 3,5-heptanediol, 2-methyl- (C8) n-$BO_1$; 1,3-propanediol, 2-(1,2-dimethylpropyl)- (C8) $E_{1-3}$; 1,3-butanediol, 2-ethyl-2,3-dimethyl- (C8) $E_{1-3}$; 1,3-butanediol, 2-methyl-2-isopropyl- (C8) $E_{1-3}$; 1,4-butanediol, 3-methyl-2-isopropyl- (C8) $E_{1-3}$; 1,3-pentanediol, 2,2,3-trimethyl- (C8) $E_{1-3}$; 1,3-pentanediol, 2,2,4-trimethyl- (C8) $E_{1-3}$; 1,3-pentanediol, 2,4,4-trimethyl- (C8) $E_{1-3}$; 1,3-pentanediol, 3,4,4-trimethyl- (C8) $E_{1-3}$; 1,4-pentanediol, 2,2,3-trimethyl- (C8) $E_{1-3}$; 1,4-pentanediol, 2,2,4-trimethyl- (C8) $E_{1-3}$; 1,4-pentanediol, 2,3,3-trimethyl- (C8) $E_{1-3}$; 1,4-pentanediol, 2,3,4-trimethyl- (C8) $E_{1-3}$; 1,4-pentanediol, 3,3,4-trimethyl- (C8) $E_{1-3}$; 2,4-pentanediol, 2,3,4-trimethyl- (C8) $E_{1-3}$; 2,4-hexanediol, 4-ethyl- (C8) $E_{1-3}$; 2,4-heptanediol, 2-methyl- (C8) $E_{1-3}$; 2,4-heptanediol, 3-methyl- (C8) $E_{1-3}$; 2,4-heptanediol, 4-methyl- (C8) $E_{1-3}$; 2,4-heptanediol, 5-methyl- (C8) $E_{1-3}$; 2,4-heptanediol, 6-methyl- (C8) $E_{1-3}$; 2,5-heptanediol, 2-methyl- (C8) $E_{1-3}$; 2,5-heptanediol, 3-methyl- (C8) $E_{1-3}$; 2,5-heptanediol, 4-methyl- (C8) $E_{1-3}$; 2,5-heptanediol, 5-methyl- (C8) $E_{1-3}$; 2,5-heptanediol, 6-methyl- (C8) $E_{1-3}$; 2,6-heptanediol, 2-methyl- (C8) $E_{1-3}$; 2,6-heptanediol, 3-methyl- (C8) $E_{1-3}$; 2,6-heptanediol, 4-methyl- (C8) $E_{1-3}$; and/or 3,5-heptanediol, 2-methyl- (C8) $E_{1-3}$; and 7. mixtures thereof;

IX. aromatic diols including: 1-phenyl-1,2-ethanediol; 1-phenyl-1,2-propanediol; 2-phenyl-1,2-propanediol; 3-phenyl-1,2-propanediol; 1-(3-methylphenyl)-1,3-propanediol; 1-(4-methylphenyl)-1,3-propanediol; 2-methyl-1-phenyl-1,3-propanediol; 1-phenyl-1,3-butanediol; 3-phenyl-1,3-butanediol; 1-phenyl-1,4-butanediol; 2-phenyl-1,4-butanediol; and/or 1-phenyl-2,3-butanediol;

X. solvents which have a ClogP value of from about 0.15 to about 0.64 and are homologs, or analogs, of the above structures where one, or more, $CH_2$ groups are added while, for each $CH_2$ group added, two hydrogen atoms are removed from adjacent carbon atoms in the molecule to form one carbon-carbon double bond, thus holding the number of hydrogen atoms in the molecule constant, including the following:

1,3-Propanediol, 2,2-di-2-propenyl-; 1,3-Propanediol, 2-(1-pentenyl)-; 1,3-Propanediol, 2-(2-methyl-2-propenyl)-2-(2-propenyl)-; 1,3-Propanediol, 2-(3-methyl-1-butenyl)-; 1,3-Propanediol, 2-(4-pentenyl)-; 1,3-Propanediol, 2-ethyl-2-(2-methyl-2-propenyl)-; 1,3-Propanediol, 2-ethyl-2-(2-propenyl)-; 1,3-Propanediol, 2-methyl-2-(3-methyl-3-butenyl)-; 1,3-Butanediol, 2,2-diallyl-; 1,3-Butanediol, 2-(1-ethyl-1-propenyl)-; 1,3-Butanediol, 2-(2-butenyl)-2-methyl-; 1,3-Butanediol, 2-(3-methyl-2-butenyl)-; 1,3-Butanediol, 2-ethyl-2-(2-propenyl)-; 1,3-Butanediol, 2-methyl-2-(1-methyl-2-propenyl)-; 1,4-Butanediol, 2,3-bis(1-methylethylidene)-; 1,4-Butanediol, 2-(3-methyl-2-butenyl)-3-methylene-; 2-Butene-1,4-diol, 2-(1,1-dimethylpropyl)-; 2-Butene-1,4-diol, 2-(1-methylpropyl)-; 2-Butene-1,4-diol, 2-butyl-; 1,3-Pentanediol, 2-ethenyl-3-ethyl-; 1,3-Pentanediol, 2-ethenyl-4,4-dimethyl-; 1,4-Pentanediol, 3-methyl-2-(2-propenyl)-; 1,5-Pentanediol, 2-(1-propenyl)-; 1,5-Pentanediol, 2-(2-propenyl)-; 1,5-Pentanediol, 2-ethylidene-3-methyl-; 1,5-Pentanediol, 2-propylidene-; 2,4-Pentanediol, 3-ethylidene-2,4-dimethyl-; 4-Pentene-1,3-diol, 2-(1,1-dimethylethyl)-; 4-Pentene-1,3-diol, 2-ethyl-2,3-dimethyl-; 1,4-Hexanediol, 4-ethyl-2-methylene-; 1,5-Hexadiene-3,4-diol, 2,3,5-trimethyl-; 1,5-Hexadiene-3,4-diol, 5-ethyl-3-methyl-; 1,5-Hexanediol, 2-(1-methylethenyl)-; 1,6-Hexanediol, 2-ethenyl-; 1-Hexene-3,4-diol, 5,5-dimethyl-; 1-Hexene-3,4-diol, 5,5-dimethyl-; 2-Hexene-1,5-diol, 4-ethenyl-2,5-dimethyl-; 3-Hexene-1,6-diol, 2-ethenyl-2,5-dimethyl-; 3-Hexene-1,6-diol, 2-ethyl-; 3-Hexene-1,6-diol, 3,4-dimethyl-; 4-Hexene-2,3-diol, 2,5-dimethyl-; 4-Hexene-2,3-diol, 3,4-dimethyl-; 5-Hexene-1,3-diol, 3-(2-propenyl)-; 5-Hexene-2,3-diol, 2,3-dimethyl-; 5-Hexene-2,3-diol, 3,4-dimethyl-; 5-Hexene-2,3-diol, 3,5-dimethyl-; 5-Hexene-2,4-diol, 3-ethenyl-2,5-dimethyl-; 1,4-Heptanediol, 6-methyl-5-methylene-; 1,5-Heptadiene-3,4-diol, 2,3-dimethyl-; 1,5-Heptadiene-3,4-diol, 2,5-dimethyl-; 1,5-Heptadiene-3,4-diol, 3,5-dimethyl-; 1,7-Heptanediol, 2,6-bis(methylene)-; 1,7-Heptanediol, 4-methylene-; 1-Heptene-3,5-diol, 2,4-dimethyl-; 1-Heptene-3,5-diol, 2,6-dimethyl-; 1-Heptene-3,5-diol, 3-ethenyl-5-methyl; 1-Heptene-3,5-diol, 6,6-dimethyl-; 2,4-Heptadiene-2,6-diol, 4,6-dimethyl-; 2,5-Heptadiene-1,7-diol, 4,4-dimethyl-; 2,6-Heptadiene-1,4-diol, 2,5,5-trimethyl-; 2-Heptene-1,4-diol, 5,6-dimethyl-; 2-Heptene-1,5-diol, 5-ethyl-; 2-Heptene-1,7-diol, 2-methyl-; 3-Heptene-1,5-diol, 4,6-dimethyl-; 3-Heptene-1,7-diol, 3-methyl-6-methylene-; 3-Heptene-2,5-diol, 2,4-dimethyl-; 3-Heptene-2,5-diol, 2,5-dimethyl-; 3-Heptene-2,6-diol, 2,6-dimethyl-; 3-Heptene-2,6-diol, 4,6-dimethyl-; 5-Heptene-1,3-diol, 2,4-dimethyl-; 5-Heptene-1,3-diol, 3,6-dimethyl-; 5-Heptene-1,4-diol, 2,6-dimethyl-; 5-Heptene-1,4-diol, 3,6-dimethyl-; 5-Heptene-2,4-diol, 2,3-dimethyl-; 6-Heptene-1,3-diol, 2,2-dimethyl-; 6-Heptene-1,4-diol, 4-(2-propenyl)-; 6-Heptene-1,4-diol, 5,6-dimethyl-; 6-Heptene-1,5-diol, 2,4-dimethyl-; 6-Heptene-1,5-diol, 2-ethylidene-6-methyl-; 6-Heptene-2,4-diol, 4-(2-propenyl)-; 6-Heptene-2,4-diol, 5,5-dimethyl-; 6-Heptene-2,5-diol, 4,6-dimethyl-; 6-Heptene-2,5-diol, 5-ethenyl-4-methyl-; 1,3-Octanediol, 2-methylene-; 1,6-Octadiene-3,5-diol, 2,6-dimethyl-; 1,6-Octadiene-3,5-diol, 3,7-dimethyl-; 1,7-Octadiene-3,6-diol, 2,6-dimethyl-; 1,7-Octadiene-3,6-diol, 2,7-dimethyl-; 1,7-Octadiene-3,6-diol, 3,6-dimethyl-; 1-Octene-3,6-diol, 3-ethenyl-; 2,4,6-Octatriene-1,8-diol, 2,7-dimethyl-; 2,4-Octadiene-1,7-diol, 3,7-dimethyl-; 2,5-Octadiene-1,7-diol, 2,6-dimethyl-; 2,5-Octadiene-1,7-diol, 3,7-dimethyl-; 2,6-Octadiene-1,4-diol, 3,7-dimethyl- (Rosiridol); 2,6-Octadiene-1,8-diol, 2-methyl-; 2,7-Octadiene-1,4-diol, 3,7-dimethyl-; 2,7-Octadiene-1,5-diol, 2,6-dimethyl-; 2,7-Octadiene-1,6-diol, 2,6-dimethyl-(8-Hydroxylinalool); 2,7-Octadiene-1,6-diol, 2,7-dimethyl-; 2-Octene-1,4-diol; 2-Octene-1,7-diol; 2-Octene-1,7-diol, 2-methyl-6-methylene-; 3,5-Octadiene-1,7-diol, 3,7-dimethyl-; 3,5-Octadiene-2,7-diol, 2,7-dimethyl-; 3,5-Octanediol, 4-methylene-; 3,7-Octadiene-1,6-diol, 2,6-dimethyl-; 3,7-Octadiene-2,5-diol, 2,7-dimethyl-; 3,7-Octadiene-2,6-diol, 2,6-dimethyl-; 3-Octene-1,5-diol, 4-methyl-; 3-Octene-1,5-diol, 5-methyl-; 4,6-Octadiene-1,3-diol, 2,2-dimethyl-; 4,7-Octadiene-2,3-diol, 2,6-dimethyl-; 4,7-Octadiene-2,6-diol, 2,6-dimethyl-; 4-Octene-1,6-diol, 7-methyl-; 2,7-bis(methylene)-; 2-methylene-; 5,7-Octadiene-1,4-diol, 2,7-dimethyl-; 5,7-Octadiene-1,4-diol, 7-methyl-; 5-Octene-1,3-diol; 6-Octene-1,3-diol, 7-methyl-; 6-Octene-1,4-diol, 7-methyl-; 6-Octene-1,5-diol; 6-Octene-1,5-diol, 7-methyl-; 6-Octene-3,5-diol, 2-methyl-; 6-Octene-3,5-diol, 4-methyl-; 7-Octene-1,3-diol, 2-methyl-; 7-Octene-1,3-diol, 4-methyl-; 7-Octene-1,3-diol, 7-methyl-; 7-Octene-1,5-diol; 7-Octene-1,6-diol; 7-Octene-1,6-diol, 5-methyl-; 7-Octene-2,4-diol, 2-methyl-6-methylene-; 7-Octene-2,5-diol, 7-methyl-; 7-Octene-3,5-diol, 2-methyl-; 1-Nonene-3,5-diol; 1-Nonene-3,7-diol; 3-Nonene-2,5-diol; 4,6-Nonadiene-1,3-diol, 8-methyl-; 4-Nonene-2,8-diol; 6,8-Nonadiene-1,5-diol; 7-Nonene-2,4-diol; 8-Nonene-2,4-diol;

8-Nonene-2,5-diol; 1,9-Decadiene-3,8-diol; and/or 1,9-Decadiene-4,6-diol; and

XI. mixtures thereof, said principal solvent containing insufficient amounts of solvents selected from the group consisting of: 2,2,4-trimethyl-1,3-pentane diol; the ethoxylate, diethoxylate, or triethoxylate derivatives of 2,2,4-trimethyl-1,3-pentane diol; and/or 2-ethylhexyl-1,3-diol, to provide an aqueous stable product.

20. Fabric softening composition in the form of a stable aqueous dispersion comprising from about 4% to about 50% of the fabric softener active of claim 1.

21. Fabric softening composition in the form of a stable aqueous dispersion comprising from about 10% to about 40% of the fabric softener active of claim 4.

22. Fabric softening composition in the form of a stable aqueous dispersion comprising from about 15% to about 30% of the fabric softener active of claim 5.

23. Premix composition comprising the fabric softener active of claim 1 and an effective amount of perfume.

24. Premix composition comprising components A., B., and C. of the composition of claim 9.

25. Solid fabric softener composition comprising an effective amount of the fabric softener active of claim 1.

26. Clear aqueous fabric softener composition comprising an effective amount of the fabric softener active of claim 1.

27. The process of making a fabric softener composition comprising adding the premix of claim 24 to water, adjusting the pH to from about 1.5 to about 5, and adding an effective amount to improve viscosity and/or clarity of the composition, of water soluble calcium and/or magnesium salt.

* * * * *